US009202325B2

(12) United States Patent
Umeda

(10) Patent No.: US 9,202,325 B2
(45) **Date of Patent: *Dec. 1, 2015**

(54) COIN DISPENSING APPARATUS

(71) Applicant: ASAHI SEIKO KABUSHIKI KAISHA, Tokyo (JP)

(72) Inventor: Masayoshi Umeda, Saitama (JP)

(73) Assignee: ASAHI SEIKO KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/603,168

(22) Filed: Jan. 22, 2015

(65) Prior Publication Data

US 2015/0213665 A1 Jul. 30, 2015

(30) Foreign Application Priority Data

Jan. 24, 2014 (JP) ..... 2014-011447

(51) Int. Cl.

| | |
|---|---|
| ***G07D 1/00*** | (2006.01) |
| ***G07D 3/12*** | (2006.01) |
| ***G07D 3/00*** | (2006.01) |
| ***G07D 9/00*** | (2006.01) |

(52) U.S. Cl.

CPC .. *G07D 1/00* (2013.01); *G07D 3/00* (2013.01); *G07D 3/128* (2013.01); *G07D 9/008* (2013.01)

(58) Field of Classification Search

CPC ..... G07D 3/128; G07D 9/008; G07D 3/00; G07D 3/02; G07D 3/06; G07D 3/08

USPC ..... 453/6, 10, 12, 13, 33–35, 49, 57

See application file for complete search history.

(56) References Cited

U.S. PATENT DOCUMENTS

| | | | | |
|---|---|---|---|---|
| 1,721,511 | A | 5/1926 | Donnellan | |
| 5,607,352 | A * | 3/1997 | Tani | 453/57 |
| 2003/0148729 | A1 * | 8/2003 | Abe et al. | 453/57 |
| 2012/0145741 | A1 * | 6/2012 | Enomoto | 221/277 |
| 2015/0024668 | A1 * | 1/2015 | Umeda | 453/57 |

FOREIGN PATENT DOCUMENTS

| | | |
|---|---|---|
| EP | 2 131 333 | 12/2009 |
| EP | 2 463 829 | 6/2012 |
| EP | 2 830 025 | 1/2015 |

(Continued)

OTHER PUBLICATIONS

European Application No. 14196107 Extended Search Report dated Mar. 5, 2015, 3 pages.

*Primary Examiner* — Jeffrey Shapiro

(57) ABSTRACT

A coin dispensing apparatus capable of dispensing coins of a plurality of denominations quickly and capable of being fabricated at a low cost is provided. A plurality of coin dispensing units each including a rotary disk having apertures for receiving coins supplied from a coin source are used in combination. Coins received in the apertures are moved along a carrying path. The coins are moved through a dispensing opening from the carrying path toward a coin outlet. A common driving device commonly rotates the disks of the units. A transmission device transmits a driving force of the driving device to the disks. A passage blocking member is formed in a dispensing opening and is selectively positioned at the non-blocking position or the blocking position while simultaneously rotating the disks of the coin dispensing units, thereby dispensing the coins using rotation of the disks based on a dispensing instruction.

17 Claims, 28 Drawing Sheets

(56) References Cited

FOREIGN PATENT DOCUMENTS

| | | |
|---|---|---|
| JP | 01-118988 | 5/1989 |
| JP | 08-320961 | 12/1996 |
| JP | 2007-200369 | 8/2007 |

* cited by examiner

COIN DISPENSING APPARATUS

BACKGROUND OF THE INVENTION

1. Field of the Invention

The present invention relates to a coin dispensing apparatus and more particularly, to a coin dispensing apparatus configured by driving a plurality of coin dispensing units with a common or single driving device, in which each of the coin dispensing units is capable of dropping randomly-stored coins into respective apertures of a rotary disk one by one, and sending the coins thus dropped in the apertures toward the circumference of the disk one by one at a predetermined position.

The term "coin" used in this specification means not only coins as currency in Japan, United States, Europe and so on but also tokens such as medals or the like as a substitute of currency.

2. Description of the Related Art

As the first prior art technique for the present invention, a coin processing apparatus disclosed in Japanese Non-Examined Patent Publication No. 8-320961 published in 1996 is known. This prior-art coin processing apparatus comprises a coin receiving section for receiving and temporarily storing inputted coins of a plurality of denominations; a coin transporting section for separating the coins inputted into the coin receiving section from each other and transporting the coins thus separated along a coin passage; a coin discriminating section, provided at an inlet section of the coin passage, for discriminating true coins and false ones from the coins thus transported and the denominations of the true coins; a coin selecting section, provided at the bottom of the coin passage, for selecting the coins transported in the coin passage by dropping downward the coins at different positions according to the denominations; a coin storing section for storing the coins that have been selected by the coin selecting section for each denomination; a coin dispensing section, provided at the bottom of the coin storing section, for dispensing the coins stored in the coin storing section one by one; a coin dispensing driving section for driving the coin dispensing section; and a horizontal coin transporting section for horizontally transporting the coins dispensed from the coin dispensing section toward the side of the coin receiving section.

The coin dispensing driving section is provided to be apart from the coin dispensing section at a predetermined distance, a power transmission means for transmitting a driving power is provided between the coin dispensing driving section and the coin dispensing section, and the horizontal coin transporting section is located in a space formed between the coin dispensing driving section and the coin dispensing section. (See Paragraph 0057 and FIG. 2.)

As the second prior art technique for the present invention, a coin dispensing apparatus disclosed in Japanese Non-Examined Patent Publication No. 2007-200369 published in 2007 is known. This prior-art coin dispensing apparatus comprises two coin hoppers, which are arranged laterally, for dispensing coins one by one by rotary disks; a common dispensing passage, which extends vertically between the coin hoppers, for guiding the coins dispensed from the coin hoppers; a common driving motor for rotating the disks; and a transmission device for selectively connecting the driving motor to one of the rotating disks. (See Paragraphs 0078 to 0123 and FIGS. 16 to 25.)

As the third prior art technique for the present invention, a safe apparatus configured to be detachably attached to a charging device such as an onboard ticket issuing system disclosed in Japanese Patent No. 2514825 published in 1996 is known. This prior-art safe apparatus comprises a chamber for receiving sales coins such as 50 yen and 500 yen which are selected from inserted coins by users through a coin inlet of the charging device; two hoppers for storing prepared coins of two denominations such as 10 yen and 100 yen which are selected from the inserted coins per denomination, wherein slits are provided for discharging the prepared coins thus stored on one side of the bottom of each hopper; rotary plates supported by the bottom of each hopper to be rotatable along predetermined directions, wherein each plate has circular depressed coin saucers arranged at a predetermined pitch circumferentially and wherein each coin saucer has a gap formed in such a way as to be matched to a corresponding one of the slits whenever the coins saucer is rotated by a predetermined angle; and a rotation force transmitting means having a rotation axis rotatable in both forward and reverse directions, wherein the rotation force transmitting means transmits a rotation force of a driving source in such a way as to rotate one of the rotation plates when the rotation axis is rotated in the forward direction and to rotate the other of the rotation plates when the rotation axis is rotated in the reverse direction.

When the gap of the coin saucer is accorded with the corresponding slit due to the rotation of the rotary plates, the prepared coins placed on the coin saucer are taken out through the slit. (See Column 3, Line 34 to Column 4, Line 30 and FIGS. 1 to 3.)

With the coin processing apparatus as the first prior art technique disclosed in Japanese Non-Examined Patent Publication No. 8-320961, the coin dispensing section comprises coin dispensing circular plates having coin dispensing holes. The coin dispensing plates are respectively rotated in the forward directions by individual driving motors by way of the power transmitting means. The coins are dropped in the coin dispensing holes by the forward rotation of the plates and separated from each other, thereby dispensing a predetermined number of the coins of the predetermined denominations.

Accordingly, with the coin processing apparatus as the first prior art technique, it is necessary to provide a driving motor for each of the coin dispensing plates. This arises a problem that the apparatus is enlarged and the fabrication cost is raised.

With the coin dispensing apparatus as the second prior art technique disclosed in Japanese Non-Examined Patent Publication No. 2007-200369, the coin hoppers for dispensing the coins are provided for the respective denominations. The rotary disks of these coin hoppers are rotated in the forward direction by the common driving motor to thereby drop the coins in the penetrating holes of the disks. In this way, the coins are separated from each other and a predetermined number of the coins of the predetermined denominations are dispensed.

However, the rotation of the common driving motor is transmitted to the rotary disks by way of clutches, and the disk of the coin hopper corresponding to a predetermined denomination is selectively rotated in the forward direction. Thus, a predetermined number of the coins of the predetermined denominations are dispensed by switching the clutches. In other words, in the case where the coins of a plurality of denominations are dispensed, the coins of one denomination is dispensed and thereafter, the next coin dispensing process is carried out. In this way, the coin dispensing operations for the plurality of denominations are performed in series.

As a result, with the coin dispensing apparatus as the second prior art technique, there is a problem that a predetermined number of the coins of the predetermined denominations are unable to be dispensed quickly.

With the safe apparatus as the third prior art technique disclosed in Japanese Patent No. 2514825, the rotary plates are arranged at the bottoms of the cylindrical hoppers, and the coins are separated and dispensed one by one by the rotation of these plates. Two of the safe apparatuses are combined to form a pair. Bevel gear are fixed to the common rotational shaft to be rotated by the driving motor are respectively meshed or engaged with bevel gears connected to the plates. Thus, the plates are configured to be rotated by the rotation of the rotational shaft by way of the bevel gears. In addition, a one-way clutch is provided between the rotational shaft and one of the bevel gears.

By this configuration, when the rotational shaft is rotated in the forward direction, one of the plates is rotated while the other plate is not rotated due to operation of the one-way clutch, thereby dispensing the coins of one denomination by the rotation of the one plate.

On the other hand, when the rotational shaft is rotated in the reverse direction, one of the plates is rotated in the reverse direction and as a result, the coins of the aforementioned dimension are not dispensed. At the same time, the other plate is rotated in the forward direction due to operation of the one-way clutch, thereby dispensing the coins of another denomination.

This means that in the case where the coins of two denominations are to be dispensed, the shaft is rotated in the forward direction to dispense one denomination of the coins and thereafter, the shaft is rotated in the reverse direction to dispense the other denomination of the coins. Thus, the coin dispensing operations for the plurality of denominations are performed in series.

As a result, with the safe apparatus as the third prior art technique, there is a problem that a predetermined number of the coins of the predetermined denominations are unable to be dispensed quickly.

Moreover, the count of the rotary disks that can be driven by a single driving motor is two and therefore, two driving motors are required for dispensing the coins of four denominations. This means that there is a problem that decreasing the mounting capacity or volume necessary for the safe apparatus is not easy and reducing the fabrication cost thereof is limited.

SUMMARY OF THE INVENTION

The present invention was created to solve the aforementioned problems of the first to third prior-art apparatuses.

Accordingly, a chief object of the present invention is to provide a coin dispensing apparatus capable of dispensing coins of a plurality of denominations surely and more quickly compared with the aforementioned prior-art apparatuses and capable of being fabricated at a low cost.

Another object of the present invention is to provide a coin dispensing apparatus that is easy to be downsized.

Still another object of the present invention is to provide a coin dispensing apparatus that is easy to do inspection and maintenance activities.

The above objects together with others not specifically mentioned will become clear to those skilled in the art from the following description.

According to the first aspect of the present invention, a coin dispensing apparatus is provided, which comprises:

a plurality of coin dispensing units each including a rotary disk having apertures for receiving coins which are supplied from a coin source;

a circular carrying path, formed in each of the coin dispensing units, along which the coins received in the apertures are moved in conjunction with rotation of the disk;

a dispensing opening, formed in each of the coin dispensing units, through which the coins are moved from the carrying path toward a coin outlet;

a common driving device for commonly rotating the disks of the coin dispensing units;

a transmission device for transmitting a driving force of the driving device to the disks of the coin dispensing units; and a passage blocking member formed in a dispensing opening of each of the coin dispensing units; wherein the passage blocking member is movable between a non-blocking position where the coins are able to pass through the dispensing opening and a blocking position where the coins are unable to pass through the dispensing opening;

wherein the passage blocking member is selectively positioned at the non-blocking position or the blocking position while simultaneously rotating the disks of the coin dispensing units, thereby dispensing the coins using rotation of the disks based on a dispensing instruction.

With the coin dispensing apparatus according to the first aspect of the present invention, since the aforementioned structure is provided, the rotary disks of the coin dispensing units are simultaneously rotated or stopped by the common driving device by way of the transmission device. Due to the rotation of the disks, the coins are dropped in the apertures of the respective disks and then, sent to the dispensing opening in the respective coin dispensing units.

The passage blocking member is provided in the dispensing opening of each of the coin dispensing units in such a way as to be selectively positioned at the non-blocking position or the blocking position while simultaneously rotating the disks of the coin dispensing units. Thus, if the coins need to be dispensed from one of the coin dispensing units, the passage blocking member of the corresponding coin dispensing unit is positioned at the non-blocking position, allowing the coins to pass through the dispensing passage. On the other hand, if the coins need not to be dispensed from the corresponding coin dispensing unit, the passage blocking member of the corresponding unit is positioned at the blocking position, preventing the coins from passing through the dispensing opening.

Moreover, since the rotary disks of the coin dispensing units are simultaneously rotated or stopped by the common driving device by way of the transmission device, the rotation of the disks are kept until the coins are completely dispensed by the coin dispensing units. This means that the dispensing operations of the coins in the respective units are carried out in parallel.

Therefore, the dispensing operations of the coin dispensing units can be completed within a shorter time than the case where the dispensing operations of the coin dispensing units are carried out in series.

Furthermore, since it is sufficient for the rotation of the disks of the coin dispensing units to provide the common driving device and the transmission device, the fabrication cost of the coin dispensing apparatus can be lowered.

Accordingly, the coin dispensing apparatus according to the first aspect of the present invention is capable of dispensing the coins of a plurality of denominations surely and more quickly compared with the aforementioned prior-art apparatuses and capable of being fabricated at a low cost.

In addition, the rotary disks of the coin dispensing units are driven by the common driving device by way of the transmission device. Therefore, the coin dispensing apparatus according to the first aspect of the present invention is easy to be downsized.

In a preferred embodiment of the coin dispensing apparatus according to the first aspect of the present invention, the apertures of the rotary disks of the coin dispensing units have a same count and a same angular position.

In this embodiment, since the apertures of the rotary disks of the coin dispensing units have a same count and a same angular position, the relative positions of the coins placed in the apertures of the respective coin dispensing units will be the same when the disks are stopped. Thus, by stopping the respective disks at a single phase, in other words, by stopping the rotation of an output shaft of the driving device at a single phase, all the coins of the respective units can be positioned stably as desired. This means that all the disks can be prevented from being placed at subtle positions where it is difficult to judge whether or not the coin is ejected from the dispensing opening. Accordingly, it is sufficient to provide a single detecting device for detecting the angular positions of the respective disks, such as a rotary encoder, thereby lowering the fabrication cost of the coin dispensing apparatus furthermore.

In another preferred embodiment of the coin dispensing apparatus according to the first aspect of the present invention, the coin dispensing units are adjacently arranged along an arrangement line; the transmission device is placed along the arrangement line; and the transmission device comprises a common driving shaft rotated by the driving device, driving bevel gears fixed to the common driving shaft, and driven bevel gears which are respectively engaged with the driving bevel gears and which are respectively connected to the rotary disks of the coin dispensing units.

In this embodiment, since the coin dispensing units are adjacently arranged along the arrangement line and the transmission device is placed along the arrangement line, the size of the combination of these units and the transmission device can be made small. Moreover, the rotary disks of the coin dispensing units are respectively rotated by engagement between the driving bevel gears fixed to the common driving shaft and the driven bevel gears respectively connected to the rotary disks. The driving and driven bevel gears can be made small in diameter. Accordingly, there is an additional advantage that the coin dispensing apparatus can be downsized furthermore.

In still another preferred embodiment of the coin dispensing apparatus according to the first aspect of the present invention, the coin dispensing units are adjacently arranged along an arrangement line; the transmission device is placed along the arrangement line; and the transmission device comprises a common driving shaft rotated by the driving device, driving spiral bevel gears fixed to the common driving shaft, and driven spiral bevel gears which are respectively engaged with the spiral driving bevel gears and which are respectively connected to the rotary disks of the coin dispensing units.

In this embodiment, since the coin dispensing units are adjacently arranged along the arrangement line and the transmission device is placed along the arrangement line, the size of the combination of these units and the transmission device can be made small. Moreover, the rotary disks of the coin dispensing units are respectively rotated by engagement between the driving spiral bevel gears fixed to the common driving shaft and the driven spiral bevel gears respectively connected to the rotary disks. The driving and driven spiral bevel gears can be made smaller in diameter and less in noise level than the case where ordinary bevel gears are used. Accordingly, there is an additional advantage that the coin dispensing apparatus can be downsized furthermore and the noise level can be restrained.

In a further preferred embodiment of the coin dispensing apparatus according to the first aspect of the present invention, the transmitting device comprises a driving spur gear rotated by the driving device, and driven spur gears respectively connected to the rotary disks of the coin dispensing units; wherein the driving spur gear is engaged with an adjacent one of the driven spur gears by way of an idler gear, and wherein the driven spur gears are engaged with each other by way of an idler gear or gears.

In this embodiment, since the driving spur gear and the driven spur gears, which are popular products and inexpensive, are used for rotating the rotary disks, there is an additional advantage that the fabrication cost of the coin dispensing apparatus is lowered furthermore.

According to the second aspect of the present invention, another coin dispensing apparatus is provided, which comprises:

a plurality of coin dispensing units each including a rotary disk having apertures for receiving coins which are supplied from a coin source;

a circular carrying path, formed in each of the coin dispensing units, along which the coins received in the apertures are moved in conjunction with rotation of the disk;

a dispensing opening, formed in each of the coin dispensing units, through which the coins are moved from the carrying path toward a coin outlet;

a common driving device for commonly rotating the disks of the coin dispensing units;

a transmission device for transmitting a driving force of the driving device to the disks of the coin dispensing units;

a passage blocking member formed in a dispensing opening of each of the coin dispensing units; wherein the passage blocking member is movable between a non-blocking position where the coins are able to pass through the dispensing opening and a blocking position where the coins are unable to pass through the dispensing opening; and a guide member movable between a guiding position where the guide member is protruded from the carrying path and a non-guiding position where the guide member is retracted from the carrying path;

wherein when the guide member is located at the guiding position, the passage blocking member is positioned at the non-blocking position, and when the guide member is located at the non-guiding position, the passage blocking member is positioned at the blocking position, while simultaneously rotating the disks of the coin dispensing units, thereby dispensing the coins using rotation of the disks based on a dispensing instruction.

With the coin dispensing apparatus according to the second aspect of the present invention, since the aforementioned structure is provided, the rotary disks of the coin dispensing units are simultaneously rotated or stopped by the common driving device by way of the transmission device. Due to the rotation of the disks, the coins are dropped in the apertures of the respective disks and then, sent to the dispensing opening in the respective coin dispensing units.

The passage blocking member is provided in the dispensing opening of each of the coin dispensing units in such a way that when the guide member is located at the guiding position, the passage blocking member is positioned at the non-blocking position, and when the guide member is located at the non-guiding position, the passage blocking member is positioned at the blocking position, while simultaneously rotating the disks of the coin dispensing units. Thus, if the coins need to be dispensed from one of the coin dispensing units, the passage blocking member of the corresponding coin dispensing unit is positioned at the non-blocking position when the guide member is located at the guiding position, allowing the coins to pass through the dispensing passage. On the other hand, if the coins need not to be dispensed from the corresponding coin dispensing unit, the passage blocking member of the corresponding unit is positioned at the blocking position when the guide member is located at the non-guiding position, preventing the coins from passing through the dispensing opening.

Moreover, since the rotary disks of the coin dispensing units are simultaneously rotated or stopped by the common driving device by way of the transmission device, the rotation of the disks are kept until the coins are completely dispensed by the coin dispensing units. This means that the dispensing operations of the coins in the respective units are carried out in parallel.

Therefore, the dispensing operations of the coin dispensing units can be completed within a shorter time than the case where the dispensing operations of the coin dispensing units are carried out in series.

Furthermore, since it is sufficient for the rotation of the disks of the coin dispensing units to provide the common driving device and the transmission device, the fabrication cost of the coin dispensing apparatus can be lowered.

Accordingly, the coin dispensing apparatus according to the second aspect of the present invention is capable of dispensing the coins of a plurality of denominations surely and more quickly compared with the aforementioned prior-art apparatuses and capable of being fabricated at a low cost.

In addition, the rotary disks of the coin dispensing units are driven by the common driving device by way of the transmission device. Therefore, the coin dispensing apparatus according to the second aspect of the present invention is easy to be downsized.

In a preferred embodiment of the coin dispensing apparatus according to the second aspect of the present invention, the apertures of the rotary disks of the coin dispensing units have a same count and a same angular position.

In this embodiment, since the apertures of the rotary disks of the coin dispensing units have a same count and a same angular position, the relative positions of the coins placed in the apertures of the respective coin dispensing units will be the same when the disks are stopped. Thus, by stopping the respective disks at a single phase, in other words, by stopping the rotation of an output shaft of the driving device at a single phase, all the coins of the respective units can be positioned stably as desired. This means that all the disks can be prevented from being placed at subtle positions where it is subtle to judge whether or not the coin is ejected from the dispensing opening. Accordingly, it is sufficient to provide a single detecting device for detecting the angular positions of the respective disks, such as a rotary encoder, thereby lowering the fabrication cost of the coin dispensing apparatus furthermore.

In another preferred embodiment of the coin dispensing apparatus according to the second aspect of the present invention, the coin dispensing units are adjacently arranged along an arrangement line; the transmission device is placed along the arrangement line; and the transmission device comprises a common driving shaft rotated by the driving device, driving bevel gears fixed to the common driving shaft, and driven bevel gears which are respectively engaged with the driving bevel gears and which are respectively connected to the rotary disks of the coin dispensing units.

In this embodiment, since the coin dispensing units are adjacently arranged along the arrangement line and the transmission device is placed along the arrangement line, the size of the combination of these units and the transmission device can be made small. Moreover, the rotary disks of the coin dispensing units are respectively rotated by engagement between the driving bevel gears fixed to the common driving shaft and the driven bevel gears respectively connected to the rotary disks. The driving and driven bevel gears can be made small in diameter. Accordingly, there is an additional advantage that the coin dispensing apparatus can be downsized furthermore.

In still another preferred embodiment of the coin dispensing apparatus according to the second aspect of the present invention, the coin dispensing units are adjacently arranged along an arrangement line; the transmission device is placed along the arrangement line; and the transmission device comprises a common driving shaft rotated by the driving device, driving spiral bevel gears fixed to the common driving shaft, and driven spiral bevel gears which are respectively engaged with the spiral driving bevel gears and which are respectively connected to the rotary disks of the coin dispensing units.

In this embodiment, since the coin dispensing units are adjacently arranged along the arrangement line and the transmission device is placed along the arrangement line, the size of the combination of these units and the transmission device can be made small. Moreover, the rotary disks of the coin dispensing units are respectively rotated by engagement between the driving spiral bevel gears fixed to the common driving shaft and the driven spiral bevel gears respectively connected to the rotary disks. The driving and driven spiral bevel gears can be made smaller in diameter and less in noise level than the case where ordinary bevel gears are used. Accordingly, there is an additional advantage that the coin dispensing apparatus can be downsized furthermore and the noise level can be restrained.

In a further preferred embodiment of the coin dispensing apparatus according to the second aspect of the present invention, the transmitting device comprises a driving spur gear rotated by the driving device, and driven spur gears respectively connected to the rotary disks of the coin dispensing units; wherein the driving spur gear is engaged with an adjacent one of the driven spur gears by way of an idler gear, and wherein the driven spur gears are engaged with each other by way of an idler gear or gears.

In this embodiment, since the driving spur gear and the driven spur gears, which are popular products and inexpensive, are used for rotating the rotary disks, there is an additional advantage that the fabrication cost of the coin dispensing apparatus is lowered furthermore.

In a further preferred embodiment of the coin dispensing apparatus according to the second aspect of the present invention, a control circuit is further provided, wherein under control of the control circuit, the guide member is located at the guiding position and the passage blocking member is located at the non-blocking position and thereafter, the disk is started to be rotated, dispensing the coins; and wherein the guide member is moved to the non-guiding position and the passage blocking member is moved to the blocking position while simultaneously the rotating the disks, thereby stopping dispensing of the coins.

In this embodiment, due to the operation of the control circuit, when the coins are to be dispensed, the guide member is located at the guiding position and the passage blocking member is located at the non-blocking position while simultaneously rotating the rotary disks of the coin dispensing units. Thus, the coin dispensing operation is surely performed. On the other hand, when the dispensing of the coins is stopped, the guide member is moved to the non-guiding position and the passage blocking member is moved to the blocking position while simultaneously rotating the disks of the units. Thus, even if the disks of the units are being rotated, the coins are not guided toward the dispensing opening. If by any chance the coins are reached the dispensing opening, the coins are blocked by the passage blocking member located at the blocking position, which means that the dispensing of the coins is surely prevented.

In a still further preferred embodiment of the coin dispensing apparatus according to the second aspect of the present invention, a rotary encoder for detecting an angular position of the disk is further provided, wherein based on an angular position signal from the rotary encoder, rotation of the disk is stopped such that the coins moved along the carrying path are not overlaid on the blocking position of the passage blocking member.

In this embodiment, since the movement of the passage blocking member to the blocking position is not disturbed by the coins, the coins are surely dispensed as desired and are not dispensed excessively. In addition, this operation can be realized by a single rotary encoder and thus, the fabrication cost is made low.

According to the third aspect of the present invention, still another coin dispensing apparatus is provided, which comprises:

a plurality of coin dispensing units each including a rotary disk having apertures for receiving coins which are supplied from a coin source;

a circular carrying path, formed in each of the coin dispensing units, along which the coins received in the apertures are moved in conjunction with rotation of the disk;

a dispensing opening, formed in each of the coin dispensing units, through which the coins are moved from the carrying path toward a coin outlet;

a common driving device for commonly rotating the disks of the coin dispensing units;

a transmission device for transmitting a driving force of the driving device to the disks of the coin dispensing units;

a passage blocking member formed in a dispensing opening of each of the coin dispensing units; wherein the passage blocking member is movable between a non-blocking position where the coins are able to pass through the dispensing opening and a blocking position where the coins are unable to pass through the dispensing opening;

a guide member movable between a guiding position where the guide member is protruded from the carrying path and a non-guiding position where the guide member is retracted from the carrying path; and an interlocking device for interlocking the passage blocking member and the guide member in such a way that when the passage blocking member is located at the blocking position, the guide member is located at the non-guiding position, and when the passage blocking member is located at the non-blocking position, the guide member is located at the guiding position;

wherein when the guide member is located at the guiding position, the passage blocking member is positioned at the non-blocking position, and when the guide member is located at the non-guiding position, the passage blocking member is positioned at the blocking position, while simultaneously rotating the disks of the coin dispensing units, thereby dispensing the coins using rotation of the disks based on a dispensing instruction.

With the coin dispensing apparatus according to the third aspect of the present invention, since the aforementioned structure is provided, the rotary disks of the coin dispensing units are simultaneously rotated or stopped by the common driving device by way of the transmission device. Due to the rotation of the disks, the coins are dropped in the apertures of the respective disks and then, sent to the dispensing opening in the respective coin dispensing units.

Since the interlocking device is provided, the passage blocking member formed in the dispensing opening of each of the coin dispensing units is operated in such a way that when the guide member is located at the guiding position, the passage blocking member is positioned at the non-blocking position, and when the guide member is located at the non-guiding position, the passage blocking member is positioned at the blocking position, while simultaneously rotating the disks of the coin dispensing units. Thus, if the coins need to be dispensed from one of the coin dispensing units, the passage blocking member of the corresponding coin dispensing unit is positioned at the non-blocking position and the guide member is located at the guiding position due to the operation of the interlocking device, allowing the coins to pass through the dispensing passage. On the other hand, if the coins need not to be dispensed from the corresponding coin dispensing unit, the passage blocking member of the corresponding unit is positioned at the blocking position and the guide member is located at the non-guiding position, due to the operation of the interlocking device, preventing the coins from passing through the dispensing opening.

Moreover, since the rotary disks of the coin dispensing units are simultaneously rotated or stopped by the common driving device by way of the transmission device, the rotation of the disks are kept until the coins are completely dispensed by the coin dispensing units. This means that the dispensing operations of the coins in the respective units are carried out in parallel.

Therefore, the dispensing operations of the coin dispensing units can be completed within a shorter time than the case where the dispensing operations of the coin dispensing units are carried out in series.

Furthermore, since it is sufficient for the rotation of the disks of the coin dispensing units to provide the common driving device and the transmission device, the fabrication cost of the coin dispensing apparatus can be lowered.

Accordingly, the coin dispensing apparatus according to the third aspect of the present invention is capable of dispensing the coins of a plurality of denominations surely and more quickly compared with the aforementioned prior-art apparatuses and capable of being fabricated at a low cost.

In addition, the rotary disks of the coin dispensing units are driven by the common driving device by way of the transmission device. Therefore, the coin dispensing apparatus according to the third aspect of the present invention is easy to be downsized.

In a preferred embodiment of the coin dispensing apparatus according to the third aspect of the present invention, the interlocking device comprises a mechanical liking mechanism.

In this embodiment, the mechanical linking mechanism is used for the interlocking device and thus, the interlocking device can be formed smaller in size at a lower cost than the case where an electrical linking mechanism is used. Therefore, there is an additional advantage that the fabrication cost of the coin dispensing apparatus can be lowered furthermore.

In another preferred embodiment of the coin dispensing apparatus according to the third aspect of the present invention, the interlocking device comprises an electrical actuator.

In this embodiment, since the electrical actuator is used for the interlocking device, there is an additional advantage that the interlocking device is unlikely to be broken down and can be formed at a low cost.

In still another preferred embodiment of the coin dispensing apparatus according to the third aspect of the present invention, the passage blocking member comprises a bar-shaped member which is protruded into the carrying path at the blocking position and retracted from the carrying path at the non-blocking position; and the guide member comprises a bar-shaped member which is movably supported by a shaft and which is moved by an actuator between the guiding position and the non-guiding position.

In this embodiment, there is an additional advantage that the passage blocking member and the guide member can be realized with a simple structure and at a low cost.

In a further preferred embodiment of the coin dispensing apparatus according to the third aspect of the present invention, a position selector for selectively positioning the guide member between the guiding position and the non-guiding position is further provided, wherein the position selector is rockably supported by a shaft and is rocked around the shaft by an actuator between a dispensing assisting position and a dispensing assisting position; and wherein when the position selector is located at the dispensing assisting position, the guide member is located at the guiding position, and when the position selector is located at the non-dispensing assisting position, the guide member is positioned at the non-guiding position.

In this embodiment, there is an additional advantage that selective positioning mechanism for the guide member between the guiding position and the non-guiding position can be easily realized at a low cost.

In a still further preferred embodiment of the coin dispensing apparatus according to the third aspect of the present invention, a control circuit is further provided, wherein under control of the control circuit, the guide member is located at the guiding position and the passage blocking member is located at the non-blocking position and thereafter, the disk is started to be rotated, dispensing the coins; and wherein the guide member is moved to the non-guiding position and the passage blocking member is moved to the blocking position while simultaneously the rotating the disks, thereby stopping dispensing of the coins.

In this embodiment, due to the operation of the control circuit, when the coins are to be dispensed, the guide member is located at the guiding position and the passage blocking member is located at the non-blocking position while simultaneously rotating the rotary disks of the coin dispensing units. Thus, the coin dispensing operation is surely performed. On the other hand, when the dispensing of the coins is stopped, the guide member is moved to the non-guiding position and the passage blocking member is moved to the blocking position while simultaneously rotating the disks of the units. Thus, even if the disks of the units are being rotated, the coins are not guided toward the dispensing opening. If by any chance the coins are reached the dispensing opening, the coins are blocked by the passage blocking member located at the blocking position, which means that the dispensing of the coins is surely prevented.

In a still further preferred embodiment of the coin dispensing apparatus according to the third aspect of the present invention, a rotary encoder for detecting an angular position of the disk is further provided, wherein based on an angular position signal from the rotary encoder, rotation of the disk is stopped such that the coins moved along the carrying path are not overlaid on the blocking position of the passage blocking member.

In this embodiment, since the movement of the passage blocking member to the blocking position is not disturbed by the coins, the coins are surely dispensed as desired and are not dispensed excessively. In addition, this operation can be realized by a single rotary encoder and thus, the fabrication cost is made low.

BRIEF DESCRIPTION OF THE DRAWINGS

In order that the present invention may be readily carried into effect, it will now be described with reference to the accompanying drawings.

DETAILED DESCRIPTION OF THE INVENTION

Figure 1:
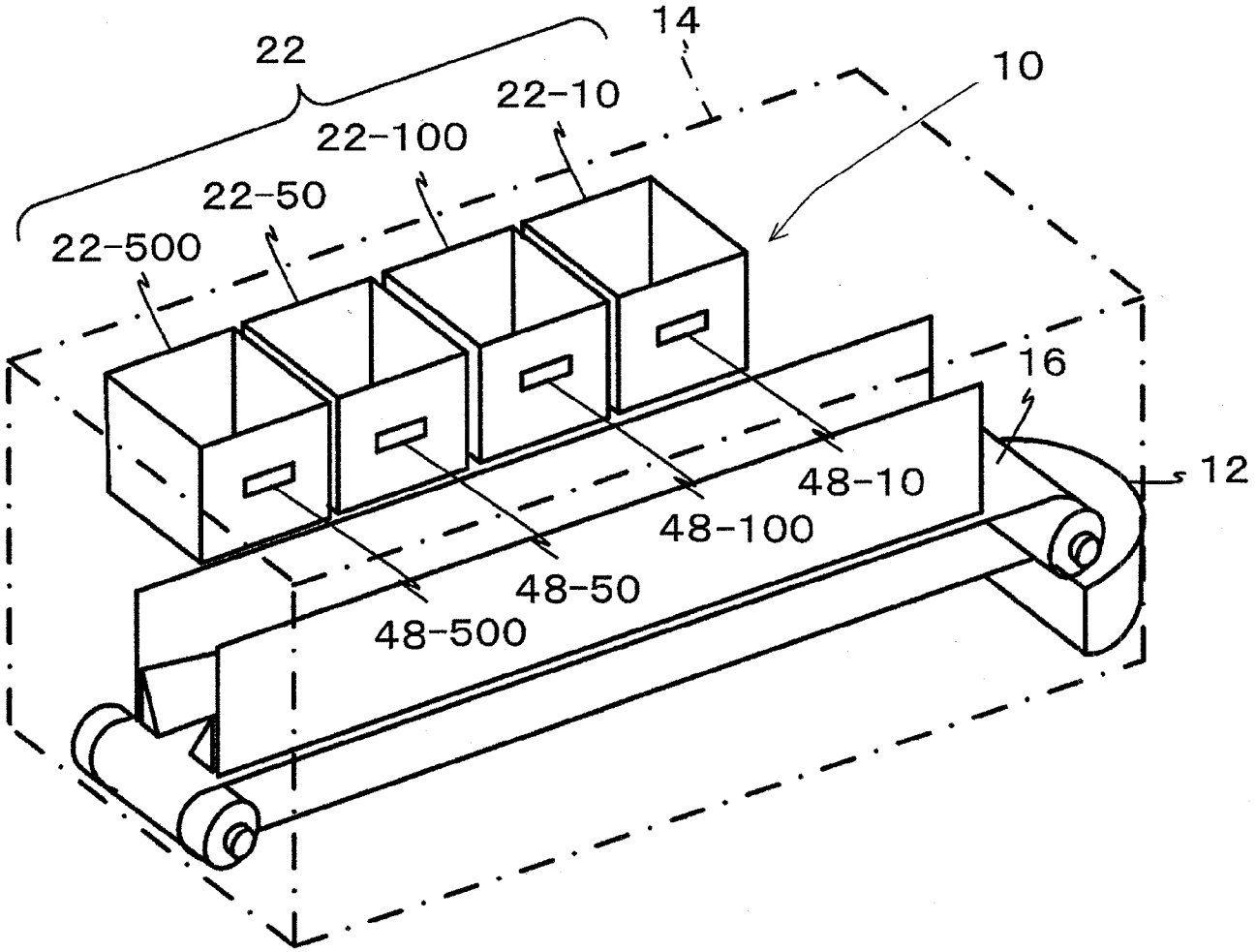
FIG. 1 is a schematic perspective view of a change machine in which a coin dispensing apparatus according to the first embodiment of the present invention is built.

Preferred embodiments of the present invention will be described in detail below while referring to the drawings attached.

First Embodiment

Figure 2:
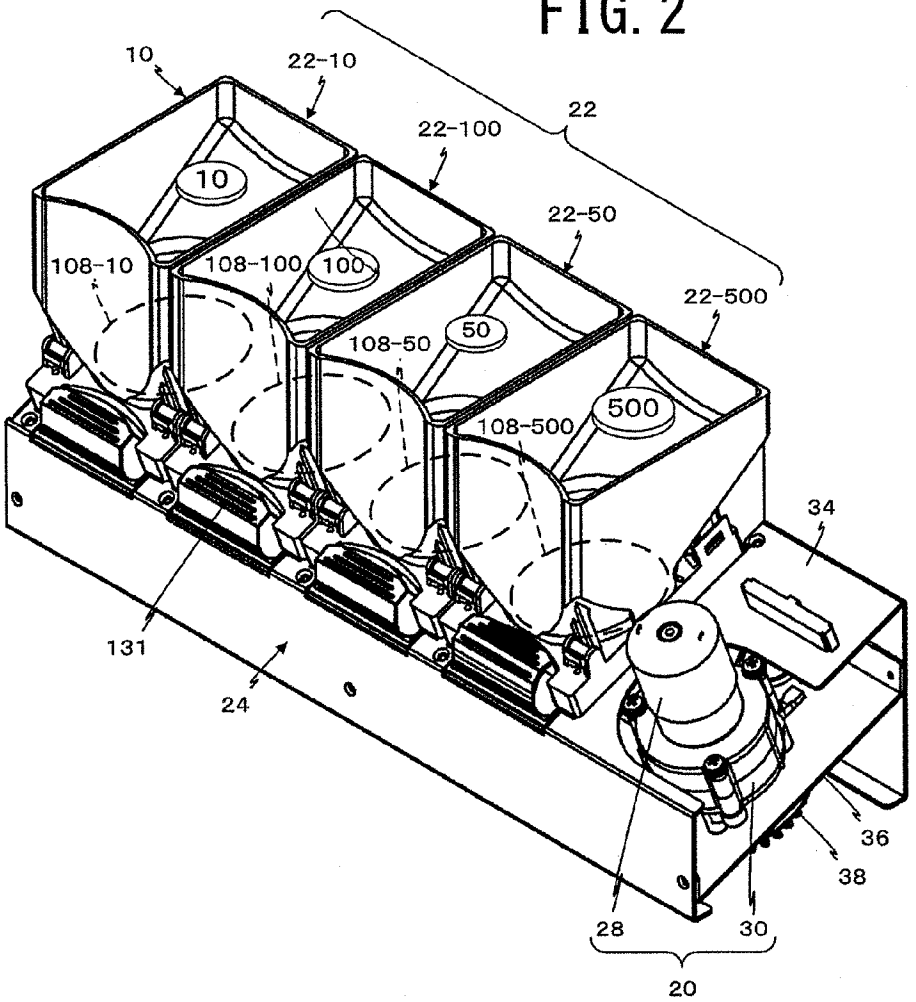
FIG. 2 is a perspective view of the coin dispensing apparatus according to the first embodiment of the present invention.
Figure 3:
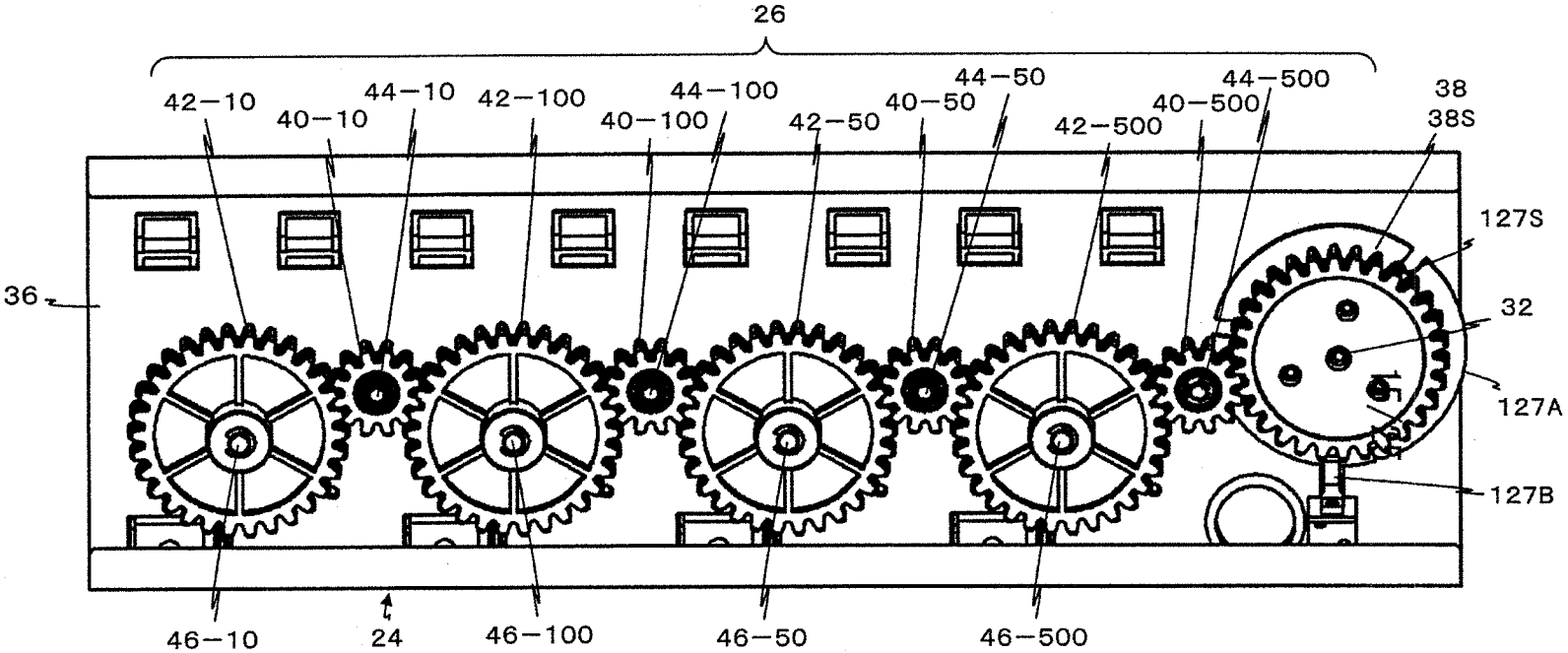
FIG. 3 is a bottom view sowing the transmission device of the coin dispensing apparatus according to the first embodiment of the present invention.

A coin dispensing apparatus 10 according to the first embodiment of the present invention is shown in FIGS. 1 to 3. This apparatus 10 is incorporated into a payment system 14 which receives a dispensing instruction of change from an upper system, e.g., a POS system, and then, dispenses a predetermined number of coins of predetermined denominations to a reception tray 12 in response to the dispensing instruction. An example of the payment system 14 is a change machine.

The coin dispensing apparatus 10 of the first embodiment comprises four coin dispensing units 22 for different denominations of coins, which are laterally aligned on one side of a conveying belt 16 along a straight line. In other words, these four coin dispensing units 22 are arranged near the conveying belt 16 along the conveying direction of the same belt 16. In response to the dispensing instruction, each of the four units 22 dispenses an instructed number of coins of the predetermined denomination which is chosen from Japanese 10 yen coins 10 C, Japanese 50 yen coin 50 C, Japanese 100 yen coin 100 C, and Japanese 500 yen coin 500 C onto the belt 16 as change. The belt 16 conveys the coins thus dispensed as change to the reception tray 12.

However, the coin dispensing apparatus 10 according to the first embodiment is not limited to four denominations but is applicable to two or more denominations. For example, if two of the coin dispensing apparatuses 10 according to the first embodiment are respectively placed at two sides of the conveying belt 16, this combination may be used for a change machine for Euro coins of eight denominations.

Moreover, the coin dispensing apparatus 10 according to the first embodiment may be used for United States coins, Australian coins, Chinese coins and so on, in addition to Japanese and Euro coins. Thus, this apparatus 10 is applicable to any coins used in the world.

In this specification, when a part relating to a specific denomination is explained, a hyphen and the denomination will be attached to a reference numeral which corresponds to the said part. However, when a part is comprehensively explained, only a reference numeral will be attached to the said part. In addition, only when an explanation about a denomination is necessary, a 10 yen coin, a 100 yen coin, a 50 yen coin, and a 500 yen coin will be denoted as 10 C, 50 C, 100 C, and 500 C, respectively. However, an explanation about the coins for all these denominations is comprehensively made, the coins will be simply denoted as C.

[Overall Structure of Coin Dispensing Apparatus]

Next, the overall structure of the coin dispensing apparatus 10 according to the first embodiment of the present invention will be explained below with main reference to FIG. 2. The coin dispensing apparatus 10 is driven by a common driving device 20 and has a function of dispensing a designated number of coins from the four coin dispensing units 22 prepared for the respective denominations. In this first embodiment, the apparatus 10 comprises the driving device 20, the coin dispensing unit 22-10 for the 10 yen coins, the coin dispensing unit 22-100 for the 100 yen coins, the coin dispensing unit 22-50 for the 50 yen coins, and the coin dispensing unit 22-500 for the 500 yen coins, a chassis 24, and a transmission device 26.

The driving device 20 has a function of supplying necessary driving forces to the four coin dispensing units 22 provided for the predetermined denominations by way of the transmission device 26, thereby activating the functions of the units 22, as shown in FIG. 2. In this embodiment, the driving device 20 comprises an electric motor 28 and a speed reducer 30. However, the speed reducer 30 is not essential for the apparatus 10 and may be omitted.

The electric motor 28 has a function of driving the four coin dispensing units 22 provided for the respective denominations. In this embodiment, a known direct current (dc) motor is used as the motor 28. This is because a dc motor is small-sized and inexpensive and because forward and reverse rotations can be realized with a simple device. However, the present invention is not limited to a dc motor, but an alternative current (ac) motor, a pulse motor, an ultrasonic motor or the like may be used for this purpose.

The speed reducer 30 has a function of reducing the rotation speed of the output shaft of the electric motor 28 to a prescribed rotation speed, thereby rotating the reducer output shaft 32. As the speed reducer 30, a known speed reducer may be used.

The chassis 24 has a function of supporting at least the electric motor 28, the four coin dispensing units 22, and the transmission device 26. In this embodiment, the chassis 24 has a trapezoidal side view the upper surface 34 of which is inclined upward to the front of the apparatus 10, i.e., the side of the coin outlets 48 (48-10, 48-100, 48-50 and 48-500) of the coin dispensing units 22 (22-10, 22-100, 22-50 and 22-500). Therefore, the front end edge of the chassis 24 is higher than the rear end edge thereof.

On the upper surface 34 of the chassis 24, the four coin dispensing units 22 which will be explained later are arranged to be adjacent to each other along the longitudinal axis of the chassis 24.

A plate-shaped intermediate base 36 is placed below the upper surface 34 of the chassis 24 so as to be parallel to the surface 34. The electric motor 28 is fixed to the intermediate base 36 by way of the speed reducer 30, where the output shaft (not shown) of the motor 28 is directed obliquely downward. In other words, the speed reducer 30 is fixed to the intermediate base 36, and the electric motor 28 is fixed to the speed reducer 30.

The rotation of the output shaft of the electric motor 28 is reduced by the speed reducer 30 to be outputted as the rotation of the output shaft 32 of the reducer 30, where the output shaft 32 is directed downward. The top end of the output shaft 32 penetrates through the hole (not shown) of the intermediate base 36 to reach the rear side of the base 36.

[Transmission Device of Coin Dispensing Apparatus]

Next, the transmission device 26 will be explained in detail below with main reference to FIG. 3.

The transmission device 26, which is provided on the rear side of the intermediate base 36, has a function of transmitting the rotation of the driving device 20 to the respective coin dispensing units 22. In this first embodiment, the transmission device 26 comprises a driving gear 38, four idler gears 40, and four driven gears 42. The driven gears 42 are respectively provided for the four coin dispensing units 22.

The driving gear 38 is a spur gear having a predetermined diameter and is fixed to the output shaft 32 of the speed reducer 30 on the rear side of the intermediate base 36. Thus, in this first embodiment, the driving gear 38 may be termed a driving spur gear 38S below.

The idler gears 40 (40-10, 40-100, 40-50, 40-500) are rotatably attached to corresponding idler shafts 44 (44-10, 44-100, 44-50, 44-500) which are provided on the rear side of the intermediate base 36 so as to be directed downward. The idler gear 40 located at the closest position to the driving gear 38 (the driving spur gear 38S) is meshed with the driving gear 38. These four idler gears 40 are formed by spur gears having smaller diameters than that of the driving gear 38, thereby decreasing the overall size of the coin dispensing apparatus 10.

The driven gears 42 (42-10, 42-100, 42-50, 42-500) are formed by spur gears and are respectively fixed to the lower ends of the corresponding input shafts 46 (46-10, 46-100, 46-50, 46-500) of the coin dispensing units 22 (22-10, 22-100, 22-50, 22-500). The driven gear 42 may be termed a driven spur gears 42S below. The driven gears 42 are meshed with the corresponding idler gears 40. Specifically, the driven gear 42-500 is meshed with the idler gears 40-500 and 40-50, the driven gear 42-50 is meshed with the idler gears 40-50 and 40-100, the driven gear 42-100 is meshed with the idler gears 40-100 and 40-10, and the driven gear 42-10 is meshed with the idler gear 40-10.

The driving spur gear 38S and the driven spur gears 42S have the same structure, in other words, they have the same pitch circle and the same tooth number.

In this way, the rotation of the output shaft of the electric motor 28 is reduced by the speed reducer 30 at a predetermined ratio to thereby rotate the output shaft 32 of the reducer 30 at a predetermined rate and therefore, the driving spur gear 38S fixed to the shaft 32 is also rotated at a predetermined rate. The driving spur gear 38S rotates all the driven spur gears 42S by way of the idler gears 40 in the same direction at the same rate.

In this first embodiment, the four combinations of the idler gear 40 and the driven gear 42 are provided in accordance with the number of the coin dispensing units 22. However, as described above, the driving spur gear 38S and the driven spur gears 42S have the same structure. Therefore, for the sake of convenience of description, a further explanation is omitted here by attaching a hyphen and the specified denomination to the reference numerals 40 and 42 corresponding to the idler gear 40 and the driven gear 42 in FIG. 3, such as 40-10, 40-100, 40-50, 40-500 and 42-10, 42-100, 42-50, 42-500.

In addition, the idler gears 40 are meshed with the adjoining driven gears 42. Thus, all the driven gears 42 are rotated in the same direction at the same speed as those of the driving gear 38.

[Overall Structure of Coin Dispensing Unit]

Next, the overall structure of the coin dispensing units 22 (22-10, 22-100, 22-50, 22-500) will be described in detail with main reference to FIGS. 4 to 15 below.

Each of the coin dispensing units 22 has a function of separating coins C that have been randomly collected and dispensing the coins C thus separated one by one. In this first embodiment, since 10 yen coins 10 C, 100 yen coins 100 C, 50 yen coins 50 C, and 500 yen coins 500 C are used as change, the four coin dispensing units 22 (22-10, 22-100, 22-50, 22-500) are provided for these four denominations. These units 22 have the same structure except for the parts relating to the size difference among these four types of the coins 10 C, 100 C, 50 C and 500 C. As shown in FIG. 2, the coin dispensing units 22-10, 22-100, 22-50 and 22-500, which are respectively provided for 10 yen coins 10 C, 100 yen coins 100 C, 50 yen coins 50 C, and 500 yen coins 500 C, are arranged in series and fixed onto the upper surface 34 of the chassis 24. The orientations of these units 22-10, 22-100, 22-50 and 22-500 are determined in such a way that the coin dispensing/ejecting directions are the same.

Since the coin dispensing units 22 have almost the same structure, the structure of the unit 22-100 for 100 yen coins 100 C will be explained on behalf of these four units 22 below. In this case, a hyphen and "100" as the denomination of 100 yen coins 100 C should be attached to the reference numerals, e.g., 108-100; however, they are omitted here for the sake of simplification.

Figure 4:
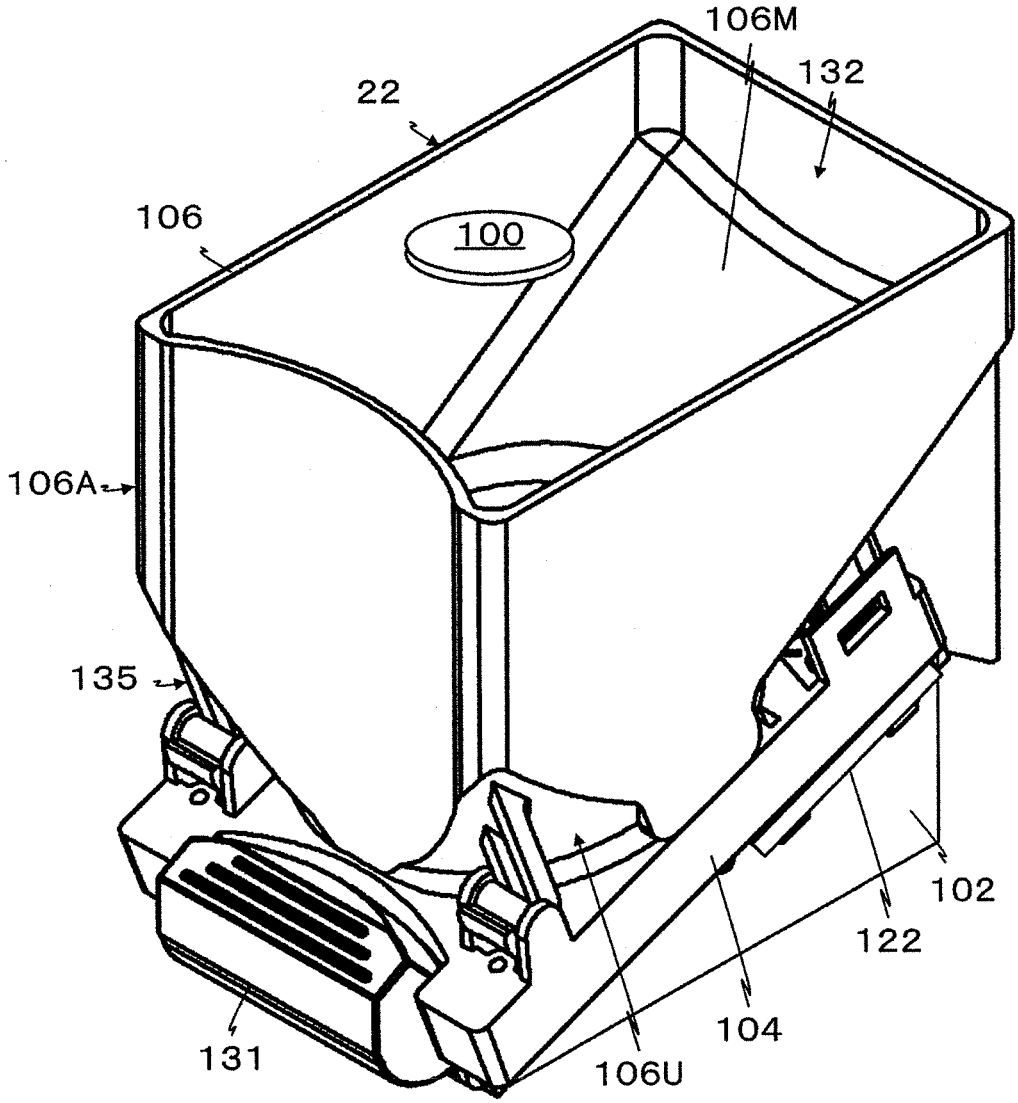
FIG. 4 is a perspective view of the coin dispensing unit used for the coin dispensing apparatus according to the first embodiment of the present invention.
Figure 5:
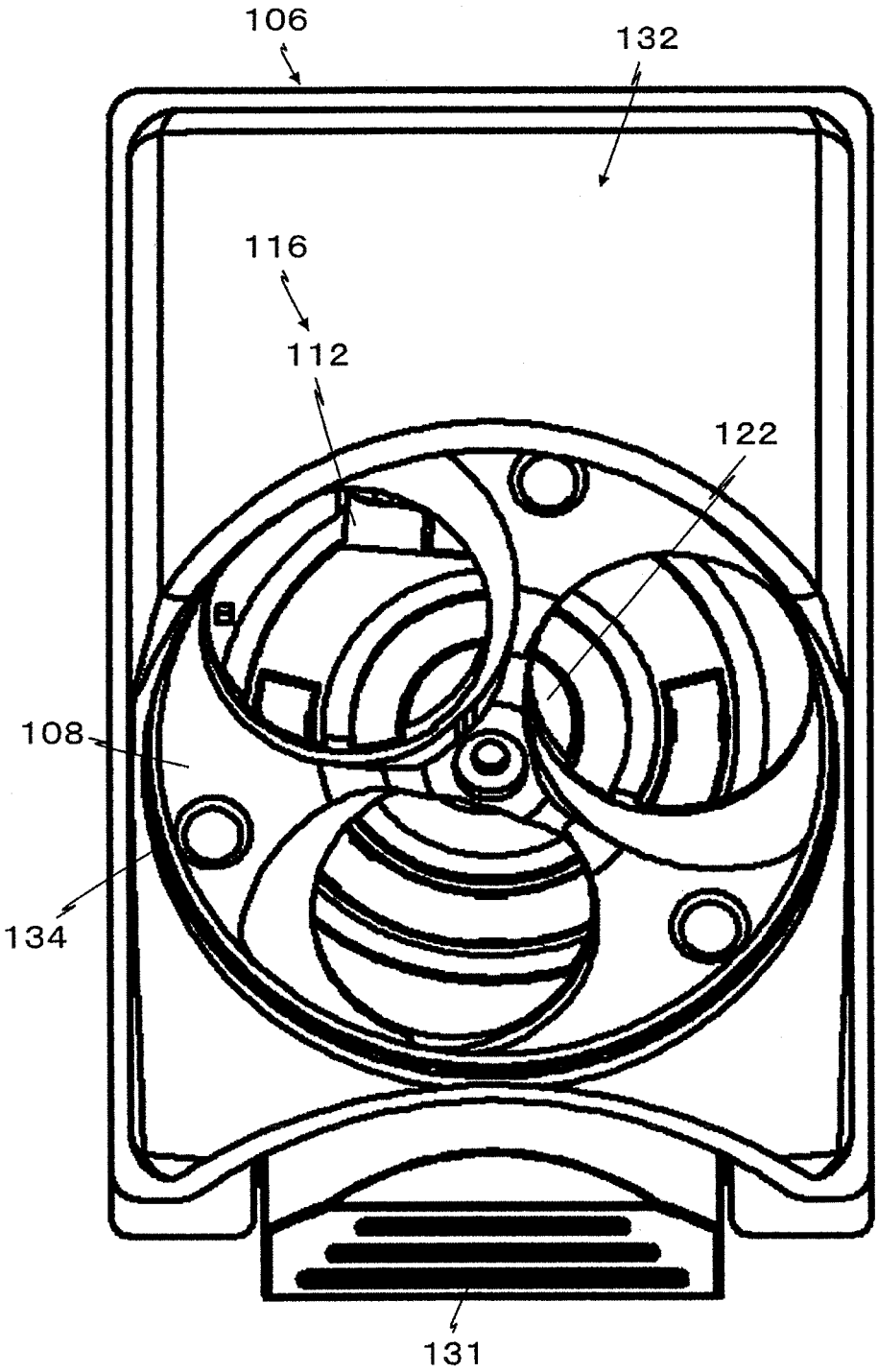
FIG. 5 is a plan view of the coin dispensing unit used for the coin dispensing apparatus according to the first embodiment of the present invention.
Figure 6:
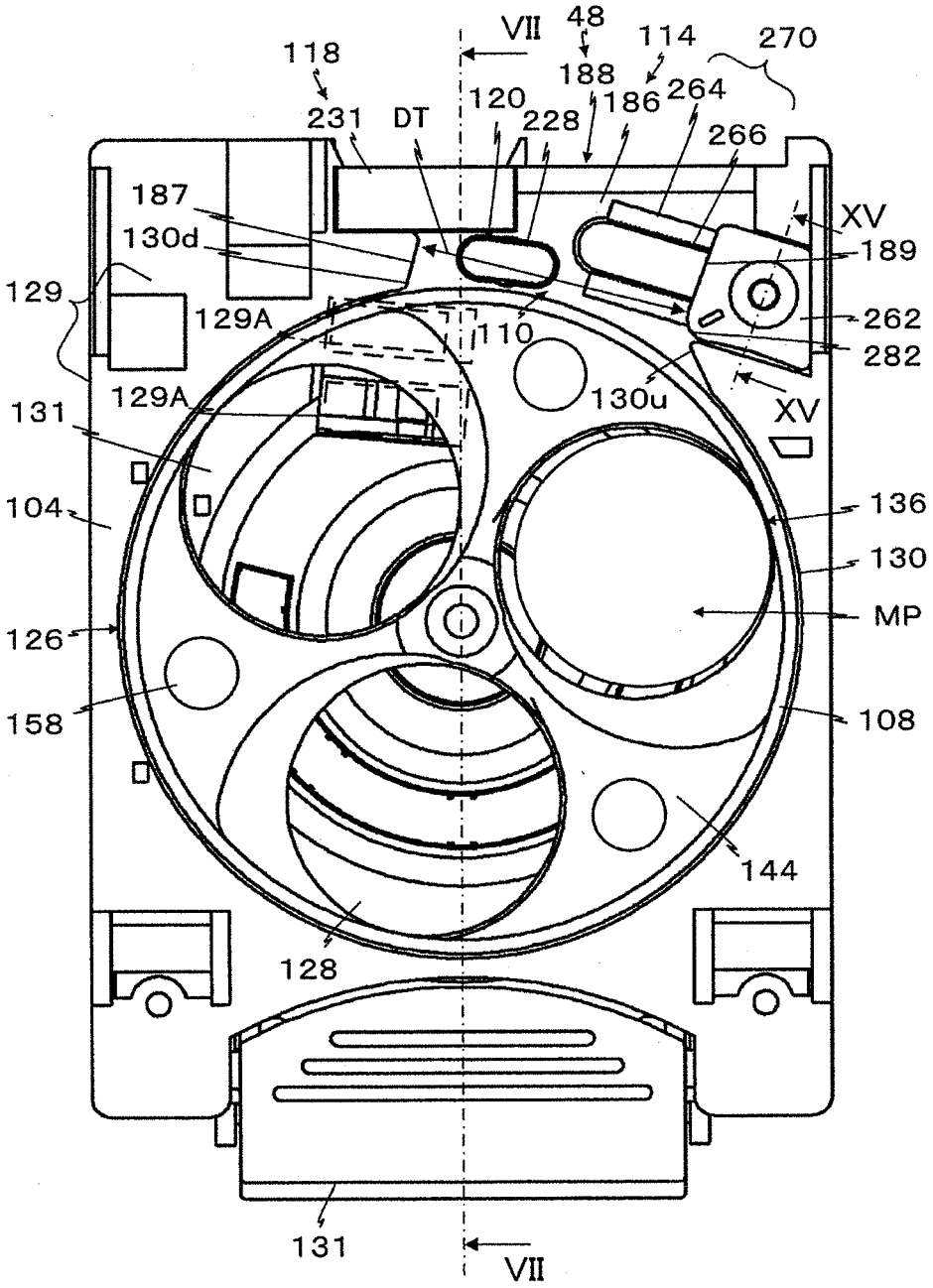
FIG. 6 is a plan view of the coin dispensing unit used for the coin dispensing apparatus according to the first embodiment of the present invention, which shows the state of the unit where the coin container is removed.

As shown in FIGS. 4 to 6, the coin dispensing unit 22 (22-100) for 100 yen coins 100 C comprises a frame 102, a base 104, a coin storing bowl or coin container 106, a rotary disk 108, a dispensing opening 110, a guide pin or guide member 112, a dispensing passage 114, an ejecting device 116, a coin sensor 118, a stopper or passage blocking member 120, and a control circuit 122. The frame 102, the base 104, the coin storing bowl 106, the rotary disk 108, the dispensing opening 110, the dispensing passage 114, and the coin sensor 118 have known structures, respectively. The feature of the coin dispensing unit 22 in this first embodiment relates to the guide pin or guide member 112 and the stopper or passage blocking member 120. However, it is essential for the present invention to include at least the stopper or passage blocking member 120. This is because the guide pin or guide member 112 can be omitted if the rotary disk 108 has a sufficiently large diameter.

Here, the base 104 (and the frame 102) may be termed the "body", because the rotary disk 108 is rotatably installed on the base 104, and various driving/controlling devices and members for the disk 108 (which will be described later) are mounted on the base 104. The body may comprise the frame 102 in addition to the base 104.

Since the coin storing bowl or coin container 106 serves as a coin source for supplying the coins to the disk 108, it may be termed a "coin source".

As shown in FIG. 4, the frame 102 has the structure on which the predetermined functional parts such as the base 104, the coin storing bowl 106, and the control circuit 122 can be attached or formed. In this first embodiment, the frame 102 is formed by a synthetic resin and comprises the shape like a hollow triangular pillar whose top end face is opened. The top end opening of the frame 102 is covered with the base 104.

The input shaft 46 (46-100) is rotatably supported by the base 104 in such a way as to be located in the middle part of the base 104. (See FIG. 3.) The input shaft 46 is almost perpendicularly protruded to the upper side of the base 104 through a circular through hole 124 which is located at the center of a circular disk receiving hole 126 (see FIGS. 6 and 7). The lower end of the input shaft 46 is reached to the lower side of the intermediate base 36 by way of a through hole (not shown) formed on the intermediate base 36. The driven spur gear 42 (42-100) is fixed to the lower end of the input shaft 46 (46-100) at a position below the intermediate base 36.

In this first embodiment, the base 104 is located to be inclined upward to the front end thereof (i.e., toward the dispensing opening 110). However, the base 104 may be inclined downward to the front end thereof and may be located horizontally. The dispensing opening 110 may be positioned on the upper or lower side of the inclined part of the base 104. The base 104 may be placed horizontally, in other words, may be placed parallel to the horizontal plane.

Figure 7:
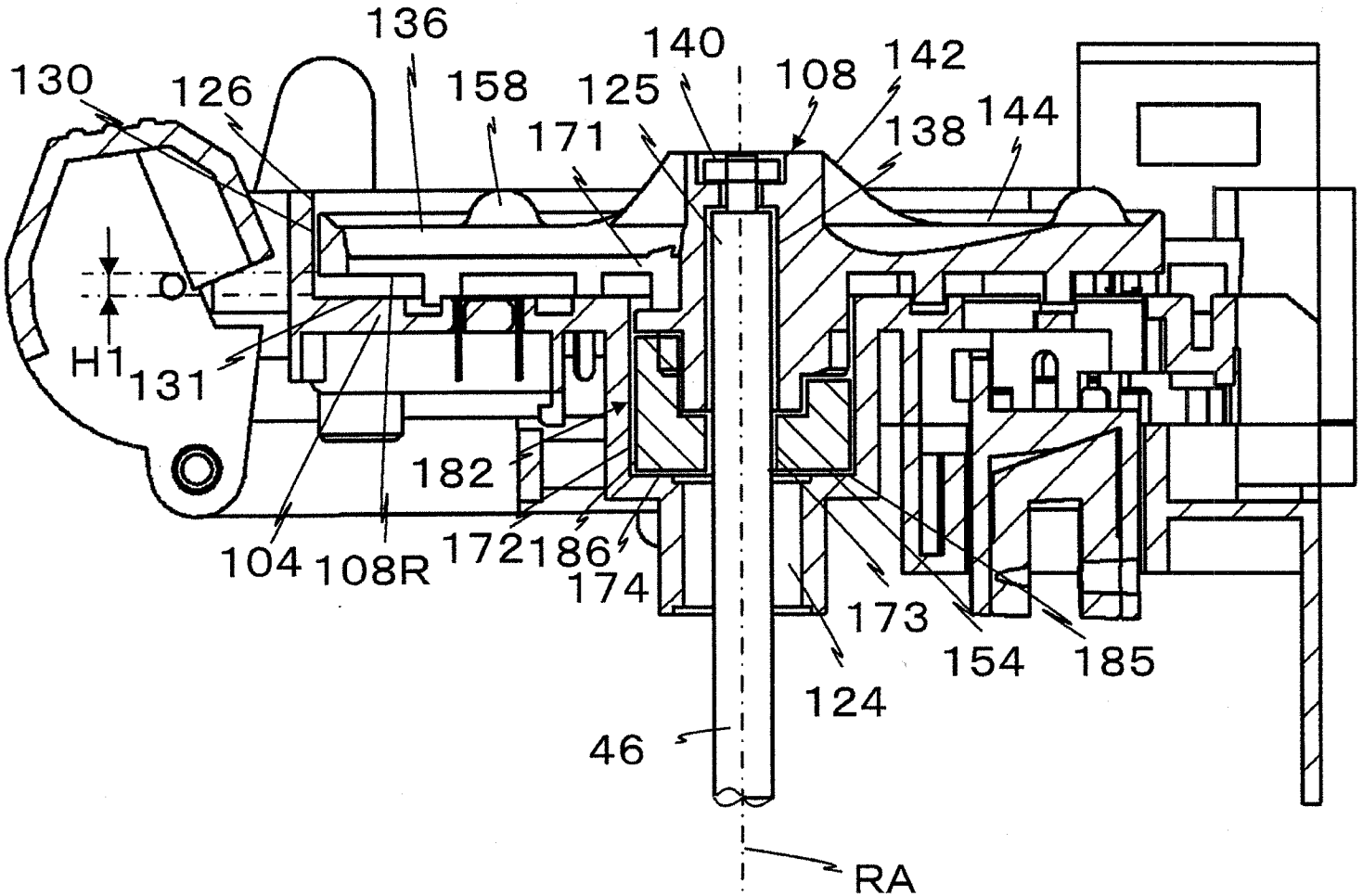
FIG. 7 is a cross-sectional view along the line VII-VII in FIG. 6.

As shown in FIGS. 6 and 7, the base 104 has a shape of a rectangular plate with a predetermined thickness. The disk receiving hole 126 is formed on the upper surface of the base 104. The base 104 has a function of holding the coin storing bowl or coin container 106 and a function of fixing the coin dispensing unit 22 onto the upper surface 34 of the chassis 24.

In this first embodiment, the disk receiving hole 126 is defined by a circular plate-shaped bottom face 128 and an annular coin guiding wall 130 extending along the periphery of the bottom face 128. In other words, the disk receiving hole 126 is formed by the combination of the bottom face 128 and the coin guiding wall 130. The disk receiving hole 126 has the shape of a circular pan in which the rotary disk 106 is placed rotatably. The depth of the disk receiving hole 126 is set to be slightly larger than the thickness of the rotary disk 108, and the bottom face 128 is formed to be approximately flat in such a way that the coin C is slid on the bottom face 128 while the surface or back of the coin C is in contact with the bottom face 128. The annular coin guiding wall 130, which is perpendicular to the bottom face 128 and which extends along the periphery of the bottom face 128, guides the annular peripheral face of the coin C.

It is preferred that the base 104 is formed by a metal such as stainless steel, or a flat plate made of a synthetic resin with abrasion resistance.

In this first embodiment, the circular disk receiving hole 126 is formed directly in the upper surface of the base 104. However, the present invention is not limited to this. The circular disk receiving hole 126 may be formed by the combination of two flat plates, i.e., by placing a perforated flat plate with a circular hole on another flat plate without holes.

The base 104 may be replaced with another member or structure having the same or similar function.

Here, the base 104 is detachably attached to the chassis 24, where the frame 102 which protrudes downwardly from the base 104 is inserted into an opening (not shown) formed in the upper surface 34 of the chassis 24. Therefore, the rotary disk 108 is placed in parallel to the upper surface 34.

As shown in FIG. 4, the coin storing bowl 106 has a function of storing a lot of coins C in the randomly collected state. In this first embodiment, the coin storing bowl 106 is made of a synthetic resin and has the shape like a vertically extending tube. The inside of the bowl 106 constitutes a coin storing section 132 which extends vertically. The horizontal cross section of the upper part 106A of the coin storing section 132 is rectangular. The horizontal cross section of the lower part 106U of the section 132 is the same as that of the circular bottom hole 134 formed in the lower part 106U. The middle part 106M of the section 132 between the upper and lower parts 106A and 106U thereof comprises an inclined wall on which the coins C can be slid down.

The lower end face of the coin storing bowl 106 (i.e., the lower end face of the lower part 106U) is opposed to the upper surface of the base 104. The lower end face of the bowl 106 is detachably attached to the base 104 with a fixing device 135 at a position where the central axis of the disk receiving hole 126 is in accordance with the axis of the circular bottom hole 134. The combination of the coin guiding wall 130 and the bottom hole 134 forms a cylindrical space.

The coin storing bowl 106 may be replaced with another device or structure having the same or similar functions (i.e., the storing and sending functions of the coins C).

[Rotary Disk of Coin Dispensing Unit]

Next, the rotary disk 108 (108-100) of the coin dispensing unit 22 (22-100) will be explained in detail with main reference to FIGS. 8 to 11.

The rotary disk 108 (108-100) is rotated at a predetermined speed, thereby stirring the coins C in the coin storing bowl 106. Due to this stirring, the coins C are dropped in apertures 136 formed at eccentric positions of the disk 108 and then, moved or rotated in conjunction with the rotation of the disk 108. In the event of a coin jam, in other words, when the state where the coins C are not dispensed due to jamming of the coins C occurs, the disk 108 is rotated in the reverse direction for the purpose of resolving the coin jam.

In this first embodiment, the rotary disk 108 is rotatably mounted in the disk receiving hole 126 formed in the upper surface of the base 104. The disk 108 is rotated at a predetermined speed in a counterclockwise direction in FIG. 5 by the electric motor 28 by way of the transmission device 26 during the dispensing period, and rotated at a predetermined speed in a clockwise direction in FIG. 5 within a predetermined period when a coin jam occurs. The top end of the input shaft 46 is inserted into an attaching hole 138 formed at the center of the rotary disk 108 and fixed by a nut 140 which is screwed into the threaded part of the input shaft 46, where the threaded part is formed at the top end of the shaft 46 (see FIG. 7).

Figure 8:
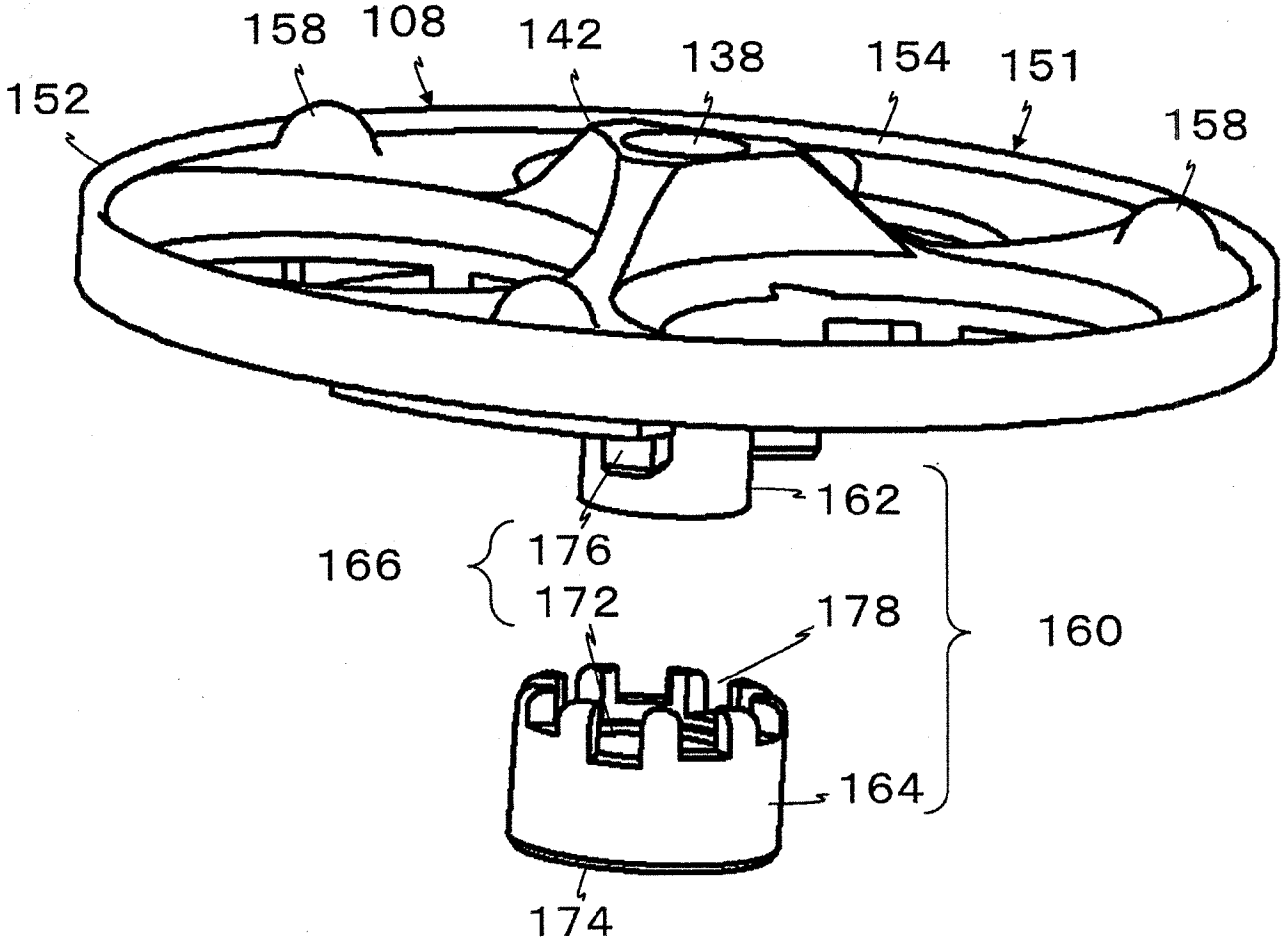
FIG. 8 is a perspective view of the rotary disk of the coin dispensing unit used for the coin dispensing apparatus according to the first embodiment of the present invention.

The rotary disk 108 comprises a stirring part 142 having a shape like a truncated pyramid which is formed on the upper surface of the rotary disk 108 (See FIGS. 7 and 8). The stirring part 142 is rotated in the bottom hole 134 of the bowl 106 in conjunction with the rotation of the disk 108. For this reason, the coins C in the bowl 106 can be stirred certainly and at the same time, the dropping of the coins C from the bowl 106 into the apertures 136 of the disk 108 can be facilitated.

In this first embodiment, the rotary disks 108 (108-10, 108-100, 108-50 and 108-500) prepared for the respective coin dispensing units 22-10, 22-100, 22-50 and 22-500 have the same diameter, and the apertures 136 formed in the respective disks 108 are the same in number and are arranged at the same angular position.

With the example shown in FIG. 5, the number of the apertures 136 is three and the angular positions of the apertures 136 are at equal angles of 120 degrees. The diameter of the apertures 136 may be determined in such a way as to be optimized for the respective denominations or the same for coins with similar diameters.

In this embodiment, the apertures 136 for 10 yen coins 10 C and those for 100 yen coins 100 C are set to be the same, and the apertures 136 for 50 yen coins 50 C and those for 500 yen coins 500 C are respectively optimized for the coins 50 C and 500 C.

In the coin dispensing apparatus 10 according to the first embodiment, the important point of the rotary disk 108 is that the number and angular position of the apertures 136 provided for the respective coin dispensing units 22-10, 22-100, 22-50 and 22-500 are the same. Since all of the rotary disks 108 of the four units 22 are simultaneously rotated and stopped, the coins C of all the denominations which are dropped into the apertures 136 need to be located at the same angular position in order to control the dispensing operation of the coins C. Therefore, it is important for the present invention that the number and angular position of the apertures 136 for the four units 22 are the same. Accordingly, the meaning that the angular positions of the apertures 136 for the respective units 22 are the same is not limited to its strict meaning but includes the range where the coins of all the denominations are processed in the same way. In other words, the angular positions of the apertures 136 for the respective units 22 need not be strictly the same; the angular positions of the apertures 136 for the respective units 22 may be different from each other if the coins of all the denominations can be processed in the same way.

As shown in FIGS. 7 and 8, a plurality of ribs 144 are formed among the apertures 136 of the rotary disk 108, and curved pressing members 146 are formed on the rear face 108R of the disk 108. Each pressing member 146 has a curved shape extending approximately radially with respect to the disk 108. The pressing members 146 are rotated in the disk receiving hole 126 in conjunction with the rotation of the disk 108.

Figure 10:
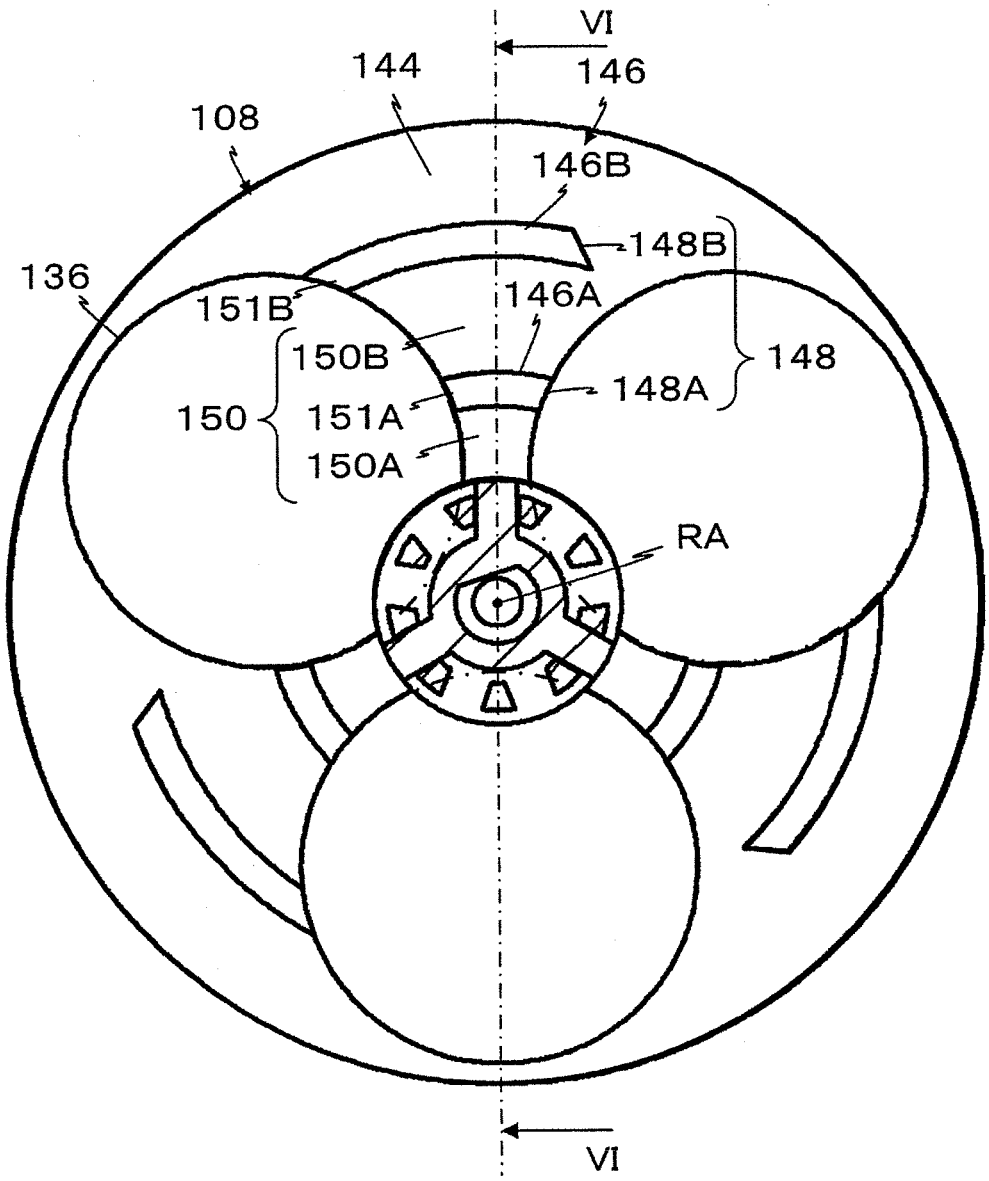
FIG. 10 is a rear view of the rotary disk of the coin dispensing unit used for the coin dispensing apparatus according to the first embodiment of the present invention.

As clearly shown in FIG. 10, the shape of the front face 148 of each pressing member 146 (i.e., the pressing face) is such that the front face 148 is shifted backward as it approaches the periphery of the disk 108. In detail, as the pressing members 146 in this first embodiment, first pressing members 146A are formed near the rotation axis RA and second pressing members 146B are formed near the periphery of the disk 108. To enable a first guide member portion 112A and a second guide member portion 112B, both of which constitute the guide member 112 which will be described in detail later, to pass through, arc-shaped first clearance grooves 150A are formed near the rotation axis RA and arc-shaped second clearance grooves 150B are formed between the first pressing members 146A and the second pressing members 146B. The front faces of the first pressing members 146A correspond to the first pressing faces 148A, and the front faces of the second pressing members 146B correspond to the second pressing faces 148B.

Figure 11:
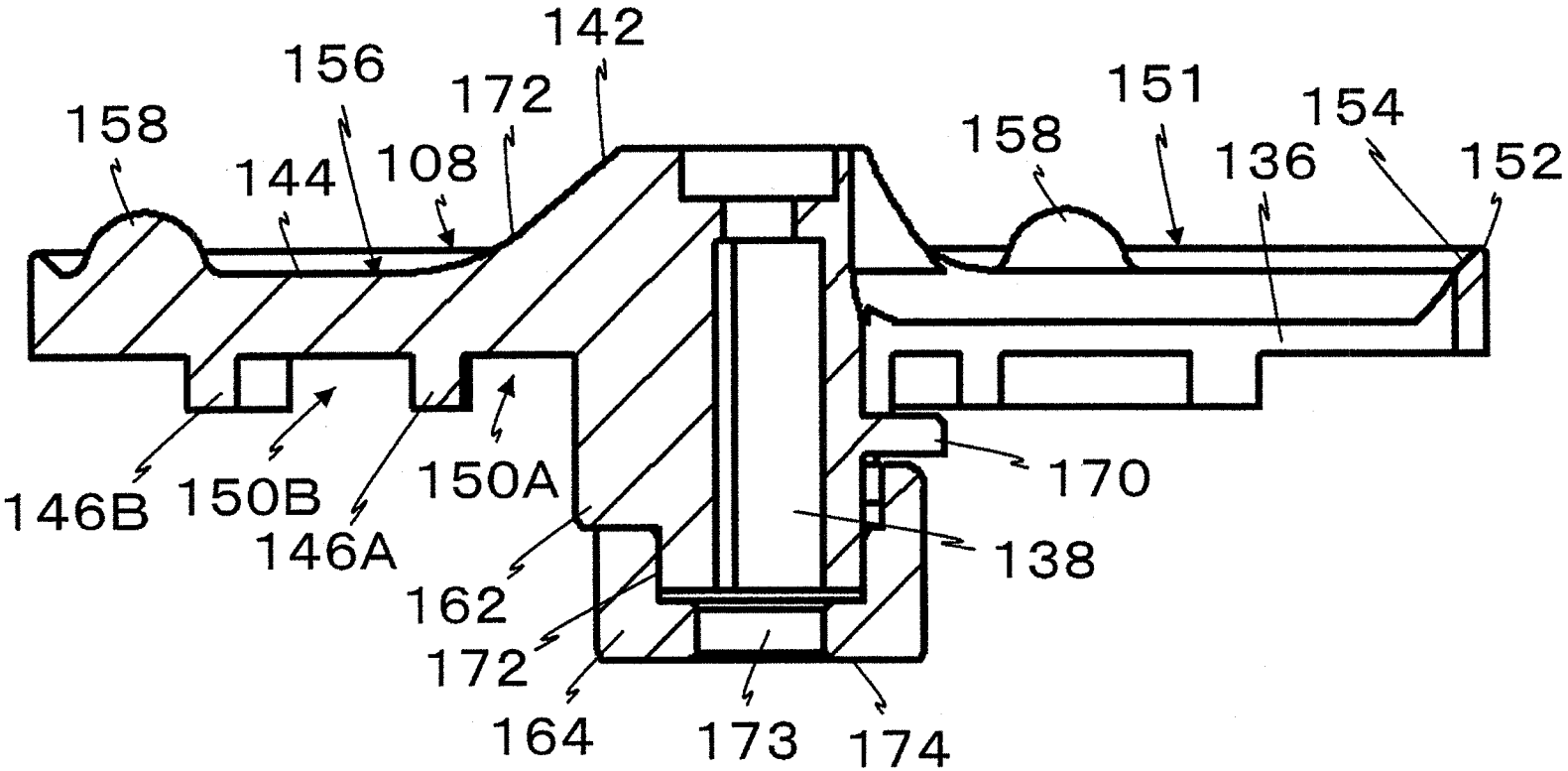
FIG. 11 is a cross-sectional view along the line XI-XI in FIG. 10.

On the upper surface 151 of the rotary disk 108, an inclined face 154, which is directed downward toward the central part of the disk 108 from the peripheral part 152 thereof, is formed, as shown in FIG. 11. The middle part 156, which is surrounded by the inclined face 154, is approximately flat. However, the neighborhood of the attaching hole 138 into which the input shaft 46 is inserted is mounded in such a way as to form a truncated pyramid, forming the stirring part 142.

In the vicinity of the peripheral part 152 of the rotary disk 108, stirring protrusions 158 are formed on the upper faces of the ribs 144.

[Height Adjusting Mechanism for Rotary Disk]

In the central part of the lower surface of the rotary disk 108, a height adjusting mechanism or device 160 for adjusting the height of the disk 108 is mounted, as shown in FIG. 8. The term "height" described here means the first distance H1 between the bottom face 128 of the base 104 and the rear face 108R of the disk 108, as shown in FIG. 7. The height adjusting mechanism 160 has the function of adjusting the first distance H1 to an appropriate interval corresponding to the thickness of the coin C.

In this first embodiment, the height adjusting mechanism 160 comprises an inner tube member 162 that protrudes downward from the center of the rear face 108R of the disk 108, an outer tube member 164 to be fitted on the outside of the inner tube member 162, and an engaging part 166 formed with reference to the inner and outer tube members 162 and 164.

The inner tube member 162 constituting a part of the height adjusting mechanism 160 is a cylindrical member having a predetermined radius whose center is located at the rotation axis RA and a predetermined length, where the member 162 is placed around the attaching hole 138 of the disk 108. In other words, the inner tube member 162 is a cylindrical member protruding downward from the central part of the rear face 108R of the disk 108. On the middle part of the inner tube member 162, a flange 170 with a predetermined thickness is formed to surround the member 162. The first height or distance H1 between the upper face of the flange 170 and the rear face 108R of the disk 108 is determined to be slightly larger than the second height H2 (see FIG. 9A) corresponding to the height of the pressing members 146. This means that the upper face of the flange 170 is not closer to the rear face 108R than the bottom face 128 of the disk receiving hole 126 even if the position of the disk 108 is determined corresponding to the maximum thickness of the coins C.

In addition, if the diameter of the apertures 136 of the rotary disk 108 in which the coins C are placed is small, the foot 171 of the stirring part 142 will be relatively large and as a result, the inner tube member 162 will be entirely overlaid on the foot 171. Therefore, in this case, the flange 170 is unnecessary to be formed.

The outer tube member 164 constituting another part of the height adjusting mechanism 160 is a cylindrical member having a predetermined length. The upper end of a fitting hole 172 formed in the outer tube member 164 can be fitted into the lower part of the inner tube member 162 (See FIGS. 9A and 9B).

As shown in FIG. 11, subsequent to the lower end of the fitting hole 172, a penetrating hole 173 having a diameter smaller than the fitting hole 172 is formed to be concentric with the fitting hole 172. In other words, as shown in FIG. 7, the fitting hole 172 and the penetrating hole 173 are formed continuously in the vertical direction, resulting in a stepped hole. The fitting hole 172 forming the upper part of the stepped hole has a larger diameter than the penetrating hole 173 forming the lower part thereof.

The lower end face 174 of the outer tube member 164 is a flat face parallel to the upper face 151 of the rotary disk 108. For this reason, when the disk 108 is rotated in such a way that the lower end face 174 is in surface contact with an opposing face, the disk 108 will be rotated in a plane parallel to this opposed face.

Figure 9A:
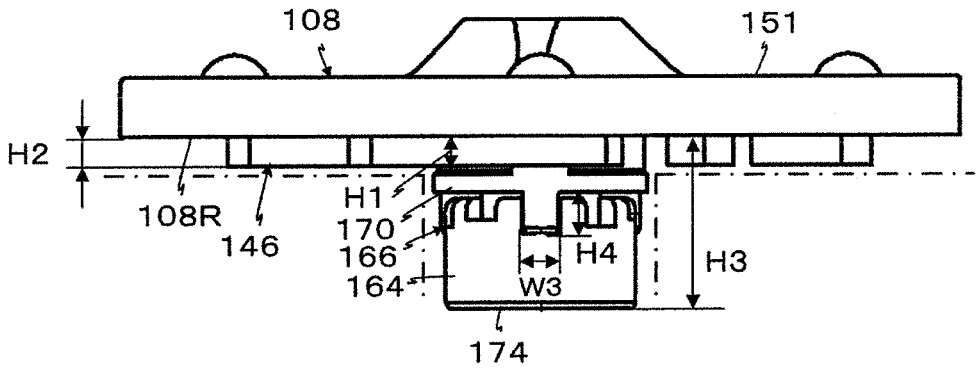
FIG. 9A is a side view of the rotary disk of the coin dispensing unit used for the coin dispensing apparatus according to the first embodiment of the present invention, where the height or gap adjusting device is attached to the rotary disk.
Figure 9B:
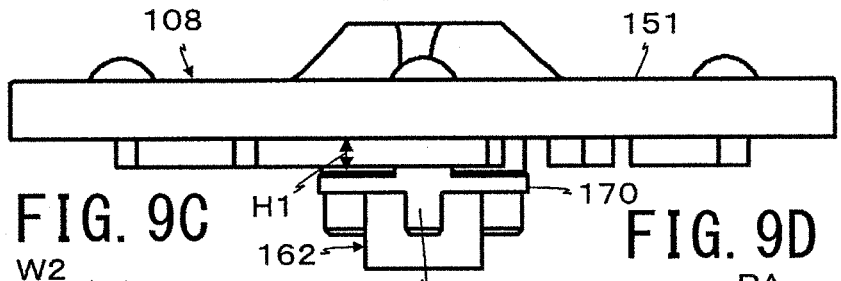
FIG. 9B is a side view of the rotary disk of the coin dispensing unit used for the coin dispensing apparatus according to the first embodiment of the present invention, where the height or gap adjusting device is detached from the rotary disk.

The engaging part 166 constituting the remaining part of the height adjusting mechanism 160 has the function of changing stepwise the second height or distance H2 between the lower end face 174 of the outer tube member 164 and the rear face 108R of the disk 108, and the function of eliminating the phase gap between the inner and outer tube members 162 and 164, as shown in FIGS. 8 and 9A. The engaging part 166 comprises a disk-side engaging subpart 176 and an outer tube-side engaging subpart 178, as shown in FIG. 8.

The disk-side engaging subpart 176 has the function of blocking relative rotation of the outer tube member 164 with respect to the inner tube member 162 in cooperation with the outer tube-side engaging subpart 178. The disk-side engaging subpart 176 is a protrusion having a rectangular cross section, which is protruded downward from the back of the flange 170 of the inner tube member 162. The disk-side engaging subpart 176 is extended from the outer surface of the inner tube member 162 in a radial direction of the member 162 to the vicinity of the peripheral part of the flange 170.

Figure 9C:
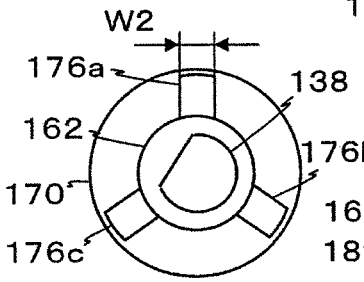
FIG. 9C is a bottom view of the height or gap adjusting device of the coin dispensing unit used for the coin dispensing apparatus according to the first embodiment of the present invention.
Figure 9C:
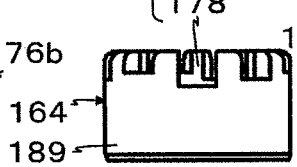

In this first embodiment, as clearly shown in FIG. 9C, the disk-side engaging subpart 176 is formed to have a Y-shaped structure by three elongated protrusions which have the same shape and which are arranged at equal angles of 120 degrees, i.e., a first elongated protrusion 176*a*, a second elongated protrusion 176*b*, and a third elongated protrusion 176*c*. In other words, the first elongated protrusion 176*a*, the second elongated protrusion 176*b*, and the third elongated protrusion 176*c* are formed to be radially with respect to the rotation axis RA. However, if the rotary disk 108 can be held to be parallel to the base 104 even during rotation, the count of these elongated protrusions may be one or two, or four or more.

In this first embodiment, the first, second, and third elongated protrusions 176*a*, 176*b* and 176*c* have the same rectangular cross section and the same length. The third widths W3 of the first, second, and third elongated protrusions 176*a*, 176*b* and 176*c* are set to be equal to each other, as shown in FIG. 9A.

The outer tube-side engaging subpart 178 has the function of setting stepwise the relative position of the outer tube member 164 with respect to the rear face 108R of the rotary disk 108, and the function of blocking relative rotation between the inner and outer tube members 162 and 164, both of which are realized in cooperation with the disk-side engaging subpart 176. The outer tube-side engaging subpart 178 comprises receiving recesses 180 having rectangular cross sections, which are formed on the disk-side end face (in other words, the upper end face) of the outer tube member 164. The count of the receiving recesses 180 is an integral multiple of the number of the disk-side engaging subparts 176. Specifically, when the number of the disk-side engaging subparts 176 is 2, the number of the outer tube-side engaging subparts 178 is set to be an integral multiple of 2, such as 4, 6, and 8; moreover, the positional relationship among the outer tube-side engaging subparts 178 is determined in accordance with the arrangement of the disk-side engaging subparts 176.

In this first embodiment, the count of the receiving recesses 180 is set to be three times as much as that of the disk-side engaging subparts 176. Concretely speaking, the number of the disk-side engaging subparts 176 is 3 and the count of the receiving recesses 180 is 9 (i.e., three times as much as 3). Thus, as shown in FIG. 9E, the first receiving recess 180*a*, the second receiving recess 180*b*, the third receiving recess 180*c*, the fourth receiving recess 180*d*, the fifth receiving recess 180*e*, the sixth receiving recess 180*f*, the seventh receiving recess 180*g*, the eighth receiving recess 180*h*, and the ninth receiving recess 180*i* are formed to have the same fourth width W4 at predetermined pitches on the upper face of the outer tube member 164.

Figure 9D:
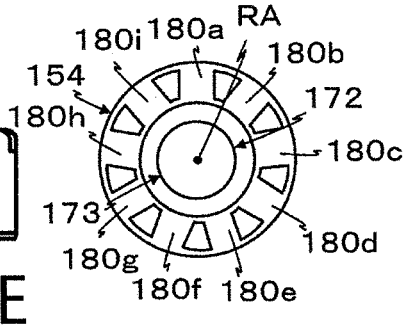
FIG. 9D is a plan view of the height or gap adjusting device of the coin dispensing unit used for the coin dispensing apparatus according to the first embodiment of the present invention.

As shown in FIG. 9D, the first to ninth receiving recesses 180*a* to 180*i* are formed to be radially with respect to the rotation axis RA of the rotary disk 108. Each of the first to ninth receiving recess 180*a* to 180*i* has one of the first, second, and third depths D1, D2, and D3, and every three ones of the first to ninth receiving recess 180*a* to 180*i* are equal in depth. Specifically, three of the first to ninth receiving recess 180*a* to 180*i* arranged at equal angles of 120 degrees, which are respectively opposed to the first, second, and third elongated protrusions 176*a*, 176*b*, and 176*c*, have the same depth of D1, D2 or D3. In this first embodiment, the first, fourth and seventh receiving recess 180*a*, 180*d* and 180*g* have the same depth of D1, the second, fifth and eighth receiving recess 180*b*, 180*e* and 180*h* have the same depth of D2, and the third, sixth and ninth receiving recess 180*c*, 180*f* and 180*i* have the same depth of D3.

Figure 9E:
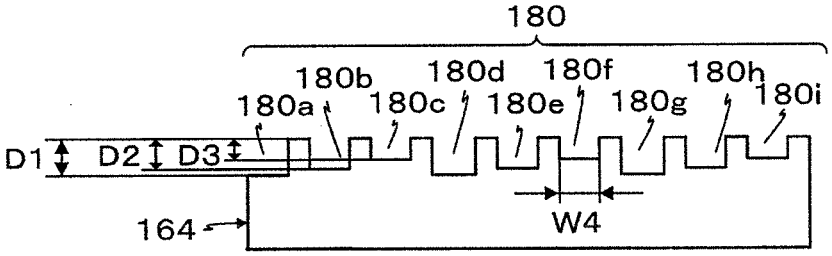
FIG. 9E is a developed view of the height or gap adjusting device of the coin dispensing unit used for the coin dispensing apparatus according to the first embodiment of the present invention.

Moreover, as shown in FIG. 9E, the widths of the first to ninth receiving recess 180*a* to 180*i* are set to be equal to the fourth width W4 in such a way as to be detachably engaged with and to be closely fitted to a corresponding one of the first, second, and third elongated protrusions 176*a*, 176*b*, and 176*c*.

In this first embodiment, the first to ninth receiving recess 180*a* to 180*i* have the same width of W4 and the depth of D1, D2 or D3. In accordance with the radial arrangement of the first, second, and third elongated protrusions 176*a*, 176*b*, and 176*c*, three of the receiving recess 180*a* to 180*i* arranged at every 120 degrees constitute one group.

If this is explained using the first receiving recess 180*a* as the reference, as shown in FIGS. 9D and 9E, the first, fourth and seventh receiving recess 180*a*, 180*d* and 180*g* constitute one group; the second, fifth and eighth receiving recess 180*b*, 180*e* and 180*h* constitute another group; and the third, sixth and ninth receiving recess 180*c*, 180*f* and 180*i* constitute a last group.

If the engaging subpart 166 is formed as described in this first embodiment, there is an additional advantage that the rear face 108R of the rotary disk 108 and the lower face 174 of the outer tube member 164 can be made parallel easily.

The width W4 of the first to ninth receiving recesses 180*a* to 180*i* is slightly wider than the width W3 of the first to third elongated protrusions 176*a* to 176*c* and therefore, each of the first to third elongated protrusions 176*a* to 176*c* can be fitted into a corresponding one of the first to ninth receiving recesses 180*a* to 180*i*. Moreover, the depths of the first to ninth receiving recesses 180*a* to 180*i* are set to be equal to each other for each of the aforementioned three groups of the receiving recesses as explained in detail below.

Concretely speaking, the first, fourth and seventh receiving recesses 180*a*, 180*d* and 180*g* arranged at equal angles of 120 degrees to form a Y shape have the first depth D1, which is the deepest. The second, fifth and eighth receiving recesses 180*b*,

180*e* and 180*h* arranged at equal angles of 120 degrees have the second depth D2, which is the second deepest. The third, sixth and ninth receiving recesses 180*c*, 180*f* and 180*i* arranged at equal angles of 120 degrees have the third depth D3, which is the shallowest.

The first depth D1 is larger than the fourth height H4 of the disk-side engaging subpart 176. This means that when the first, second and third elongated protrusions 176*a*, 176*b* and 176*c* are respectively fitted into the first, fourth and seventh receiving recess 180*a*, 180*d* and 180*g*, the end face of the outer tube member 164 abuts against the back of the flange 170 and at the same time, the lower ends of the first, second and third elongated protrusions 176*a*, 176*b* and 176*c* do not abut against the bottom faces of the first, fourth and seventh receiving recess 180*a*, 180*d* and 180*g*, respectively, resulting in gaps. Accordingly, the third distance H3 between the rear face 108R of the disk 108 and the lower end face 174 of the outer tube member 164 is set at the smallest first distance D1*d*. The first distance D1*d*, which is not shown in any figures, is generated by attaching "d" to the first distance D1 for the sake of explanation. The same manner is applied to the other distances in the following description.

When the first, second and third elongated protrusions 176*a*, 176*b* and 176*c* are respectively fitted into the second, fifth and eighth receiving recess 180*b*, 180*e* and 180*h*, the lower ends of the first, second and third elongated protrusions 176*a*, 176*b* and 176*c* abut against the bottom faces of the second, fifth and eighth receiving recess 180*b*, 180*e* and 180*h*, respectively. Accordingly, the third distance H3 between the rear face 108R of the disk 108 and the lower end face 174 of the outer tube member 164 is equal to the second distance D2*d* which corresponds to the second depth D2 and which is slightly larger than the first distance D1*d*.

When the first, second and third elongated protrusion 176*a*, 176*b* and 176*c* are respectively fitted into the third, sixth and ninth receiving recess 180*c*, 180*f* and 180*i*, the lower ends of the first, second and third elongated protrusions 176*a*, 176*b* and 176*c* abut against the bottom faces of the third, sixth and ninth receiving recess 180*c*, 180*f* and 180*i*, respectively. Accordingly, the third distance H3 between the rear face 108R of the disk 108 and the lower end face 174 of the outer tube member 164 is equal to the third distance D3*d* which corresponds to the third depth D3 and which is slightly larger than the second distance D2*d*.

In use, the inner tube member 152 and the outer tube member 164 are coupled together while the first, second and third elongated protrusions 176*a*, 176*b*, and 176*c* are respectively fitted into corresponding ones of the three groups of the first to ninth receiving recess 180*a* to 180*i* in accordance with the thickness of the coin C, resulting in the combination of the rotary disk 108 and the height adjusting mechanism 160. Then, this combination is mounted on the base 104 in such a way that the input shaft 46 is inserted into the attaching hole 138 of the disk 108 and that the outer tube member 164 is dropped into a circular bearing hole 182 formed at the center of the disk receiving hole 126.

In this way, the outer surface of the outer tube member 164 and the inner surface 172 of the bearing hole 182 are fitted closely and as a result, the rotary disk 108 can be rotated stably around the rotation axis RA. In this state, a nut 140 is screwed into the top end of the input shaft 46, thereby fixing the disk 108 to the input shaft 46. Therefore, an annular coin or carrying path MP is formed between the outer surface of the inner tube member 162 and the coin guiding wall 130, as shown in FIG. 6.

Since the lower end face 174 of the outer tube member 164 is supported by the bottom face 185 of the bearing hole 182, the interval between the rear face 108R of the disk 108 and the bottom face 128 of the disk receiving hole 126 is determined by the first distanced D1*d*, the second distance D2*d*, or the third distance D3*d* which is defined by the combination of the inner tube member 152 and the outer tube member 164. Accordingly, the 100 yen coins C dropped into the apertures 136 of the disk 108 are supported by surface contact of the surfaces or backs of the coins C with the base 104 and at the same time, the coins C are pressed and moved by the first pressing members 146A due to the rotation of the rotary disk 108, and guided by the coin guiding wall 130 of the disk receiving hole 126. In this way, the coins C are rotated along the coin carrying path MP in conjunction with the rotation of the disk 108.

In the event of a coin jam, the rotary disk 108 is rotated in the reverse direction. Due to this reverse rotation, the back faces 151 A and 151 B of the first pressing member 146A and the second pressing member 146B press the peripheral faces of the coins C, thereby moving the coins C in an opposite direction to that of the forward rotation.

Since the guide member 112 is moved to the non-guiding point NGP when the rotary disk 108 is rotated in the reverse direction, the guide member 112 does not block the movement of the coins C along the carrying path MP. Therefore, the coins C are rotated in conjunction with the disk 108 in the reverse direction and the coin jam is eliminated due to the stirring action of the disk 108, resulting in preparation for restart.

[Dispensing Opening of Coin Dispensing Unit]

The dispensing opening 110 is an opening through which the coins C that have been moved along the carrying path MP can be moved radially from the disk receiving hole 126. As shown in FIG. 6, the dispensing opening 110 is formed by removing a part of the circular coin guiding wall 130.

In FIG. 6, the dispensing opening 110 is an opening formed by removing a part of the coin guiding wall 130 of the base 104 (more specifically, an upper part of the inclined section of the base 104) in such a way as to have a size greater than the maximum coin diameter. Concretely speaking, the dispensing opening 110 is a slit-shaped sideways opening defined by an upstream-side edge 130*u* of the coin guiding wall 130 and a downstream-side edge 130*d* thereof. The interval between the upstream-side edge 130*u* and the downstream-side edge 130*d* is greater than the diameter of the maximum-diameter coin C to be dispensed and less than twice as much as the maximum coin diameter.

In this first embodiment, the interval between the upstream- and downstream-side edges 130*u* and 130*d* is set at about 1.2 times as much as the diameter of the maximum-sized 500 yen coin 500 C.

[Dispensing Passage of Coin Dispensing Unit]

The dispensing passage 114 is extended linearly from the dispensing opening 110 along one radius of the disk receiving hole 126, as shown in FIG. 6. The dispensing passage 114 has the function of guiding the coins C ejected from the dispensing opening 110 to a coin outlet 48. In this first embodiment, the dispensing passage 114, which has a recess-like shape, is formed by a passage bottom face 186 formed on an extension of the plane on which the bottom face 128 of the disk receiving hole 126 is positioned, a downstream-side guiding face 187 that defines the dispensing opening 110, and an upstream-side guiding face 189 of a dispensing opening adjustor 262 which will be described later.

However, the dispensing passage 114 does not need to have a recess-like shape and may be formed by a flat face only. This means that the dispensing passage 114 can be formed by the passage bottom face 186 only. The end 188 of the passage bottom face 186 constitutes the coin outlet 48.

In this first embodiment, the length of the dispensing passage 114 is approximately as much as the radius of the coin C; however, this length may be greater or less than the radius of the coin C.

[Guide member of Coin Dispensing Unit]

Next, the guide member 112 and its driving mechanism will be explained below with reference to FIGS. 12 to 15.

The guide member 112 has the function of guiding the coins C which are moved along the carrying path MP in conjunction with the rotation of the rotary disk 108 in a radial direction of the disk 108, in other words, a radial direction of the disk receiving hole 126. This function is a basic function and termed the "radial guiding function".

In this first embodiment, as an auxiliary function, the guide member 112 has the function of allowing the coins C to be moved in the reverse direction along the carrying path MP in the case where the rotary disk 108 is rotated in the reverse direction for solving a coin jam and in the case where the coins C pressed by the back faces 150 (FIG. 10) of the pressing members 146 are moved in the reverse direction along the carrying path MP. This function is termed the "reversal permitting function". However, this function is not an essential function for the present invention.

Moreover, the guide member 112 in this embodiment has the further function of selectively guiding the coins C or not, as another basic function. This function is termed the "selective guiding function".

Furthermore, the guide member 112 in this embodiment has the function of ejecting the coins C to the dispensing passage 114, as another auxiliary function. This function is termed the "ejecting function". However, this function may be carried out by any type of ejecting device provided in addition to the guide member 112.

In this first embodiment, the guide member 112 is configured to carry out the aforementioned four functions; however, the present invention is not limited to this. These four functions may be carried out separately, in other words, each of these four functions may be carried out by a single device. Two or three of these functions may be carried out by a single device also.

In this first embodiment, the guide member 112 is selectively positioned at a guiding position GP (see FIGS. 19A and 19B) or a non-guiding position NGP (see FIGS. 20A and 20B) by a position selecting device 190, thereby performing the selective guiding function.

If the guide member 112 is positioned at the guiding position GP, it performs the radial guiding function for guiding the coins C in a radial direction of the rotary disk 108. The guide member 112 constitutes the ejecting device 116 in cooperation with a resilience device 192 and a dispensing opening adjustor 262 which will be described later. The guide member 112 performs its ejecting function in this way.

Next, the guide member 112 will be explained in more detail below with reference to FIGS. 12 to 14.

Basically, the guide member 112 has the selective guiding function of guiding the coins C which are moved in conjunction with the rotation of the rotary disk 108 toward the dispensing opening 110. In this embodiment, however, the guide member 112 has the ejecting function also. Moreover, in this embodiment, the guide member 112 is a bar-shaped member whose side view is linear. The lower end of the guide member 112 is rockably supported by a supporting shaft 194 and the upper end thereof is formed to be like a two-pronged fork in a front view. Therefore, it may be said that the guide member 112 comprises a first guide member portion 112A and a second guide member portion 112B that constitute the shape like a two-pronged fork. The first and second guide member portions 112A and 112B are arranged in such a way as to be respectively overlapped with the arc-shaped first clearance grooves 150A and the arc-shaped second clearance grooves 150B.

It is needless to say that the number of the guide member portions that constitute the guide member 112 may be one or three or more as long as they can perform the radial guiding function.

On the top ends of the first and second guide member portions 112A and 112B, a first inclined face 196A and a second inclined face 196B are respectively formed in such a way as to be inclined at 45 degrees with respect to the horizontal plane in the state where the first and second guide member portions 112A and 112B stand upright. Just before ejecting the coins C, the first and second guide member portions 112A and 112B are inclined until the angle between the portions 112A and 112B and the horizontal plane reaches about 60 degrees.

The both ends of the supporting shaft 194 are fixed to a position selector 198 that constitutes a part of the position selecting device 190.

As shown in FIGS. 19A and 19B and FIGS. 20A and 20B, the guide member 112 is moved to the guiding position GP through an advance/retreat hole 129 formed at a position opposed to the carrying path MP of the base 104 and furthermore, moved to the non-guiding position NGP from the guiding position GP. In this embodiment, as the advance/retreat hole 129, a first advance/retreat hole 129A and a second advance/retreat hole 129B are provided, which are slit-shaped and opposed to the first and second guide member portions 112A and 112B, respectively.

[Position Selecting Device of Coin Dispensing Unit]

The position selecting device 190 has the function of selectively moving the guide member 112 to the guiding position GP or the non-guiding position NGP. Accordingly, the position selecting device 190 may be replaced with other device having a similar function.

Figure 12:
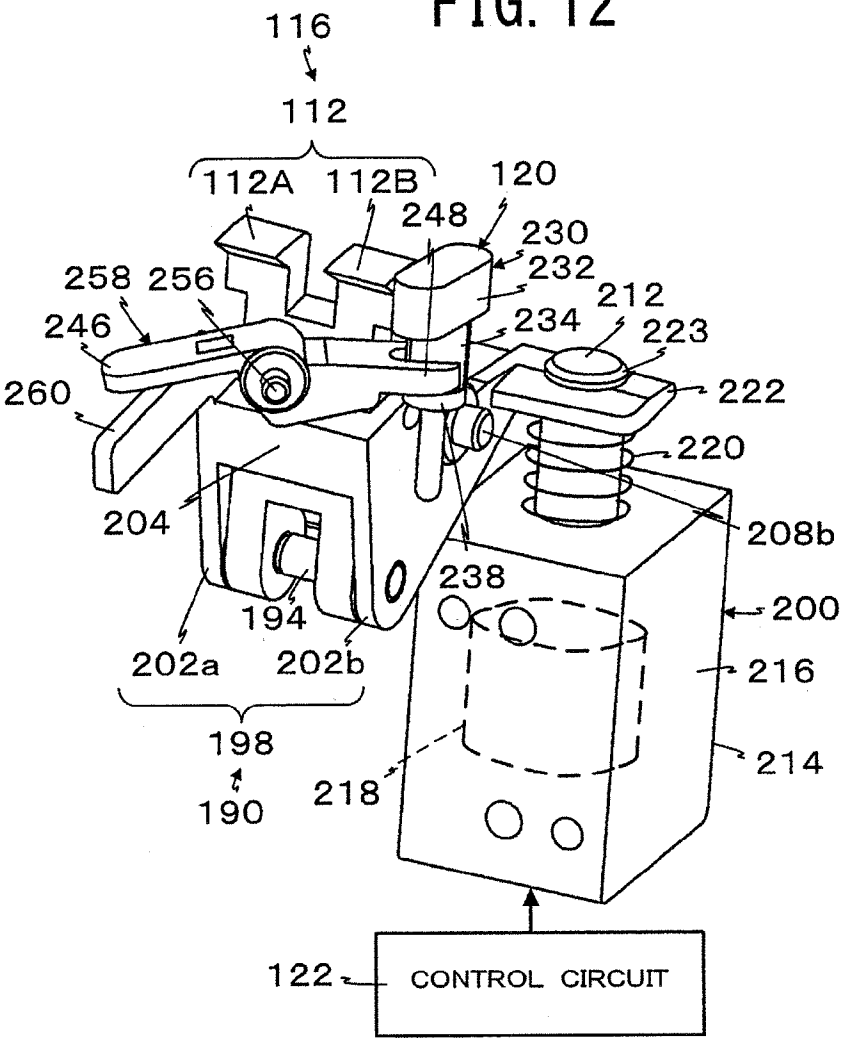
FIG. 12 is a perspective view of the guide member, the stopper, and the interlocking device of the coin dispensing unit used for the coin dispensing apparatus according to the first embodiment of the present invention, which is seen from the side of the stopper.
Figure 13:
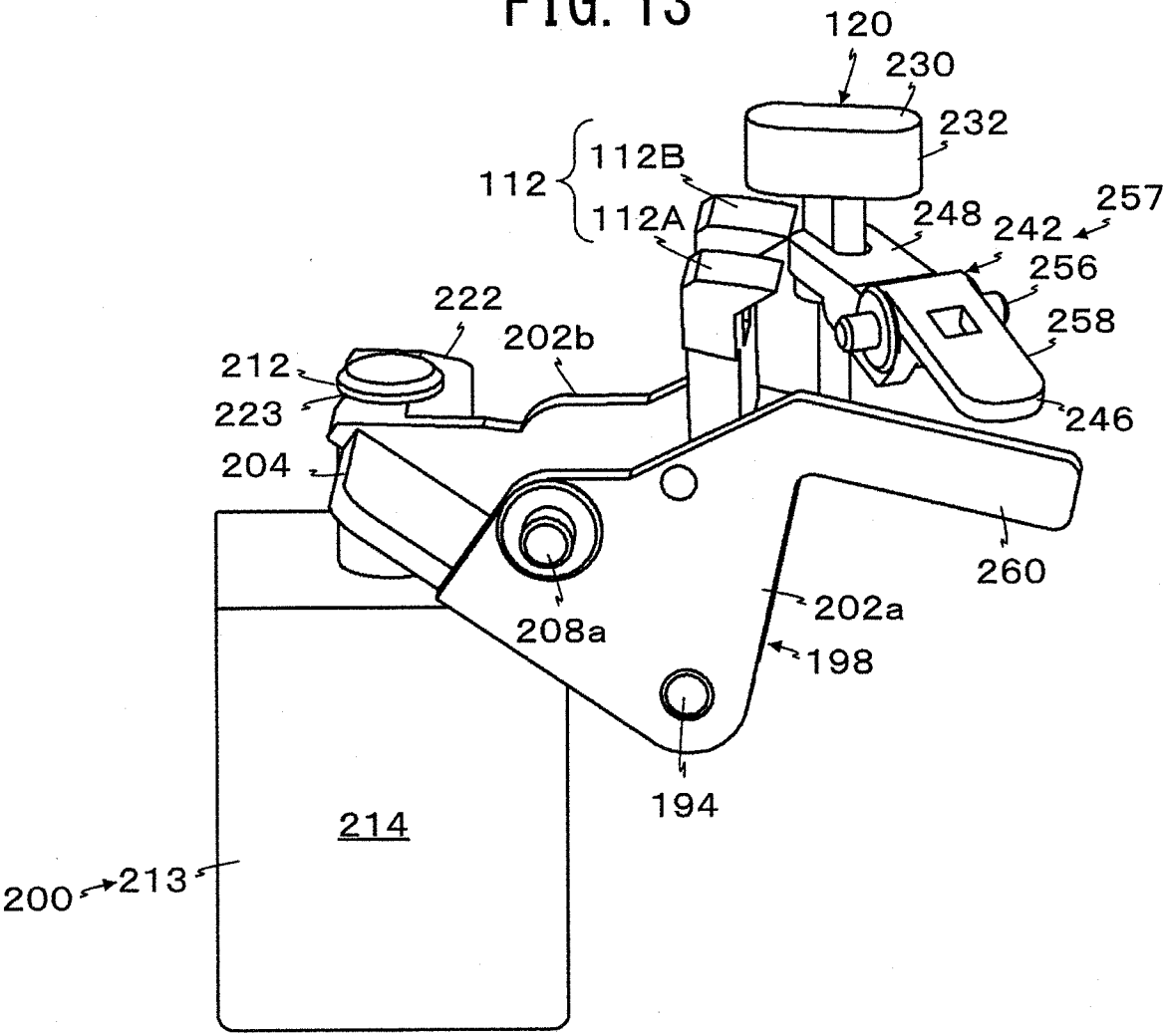
FIG. 13 is a perspective view of the guide member, the stopper, and the interlocking device of the coin dispensing unit used for the coin dispensing apparatus according to the first embodiment of the present invention, which is seen from the side of the guide member.
Figure 14:
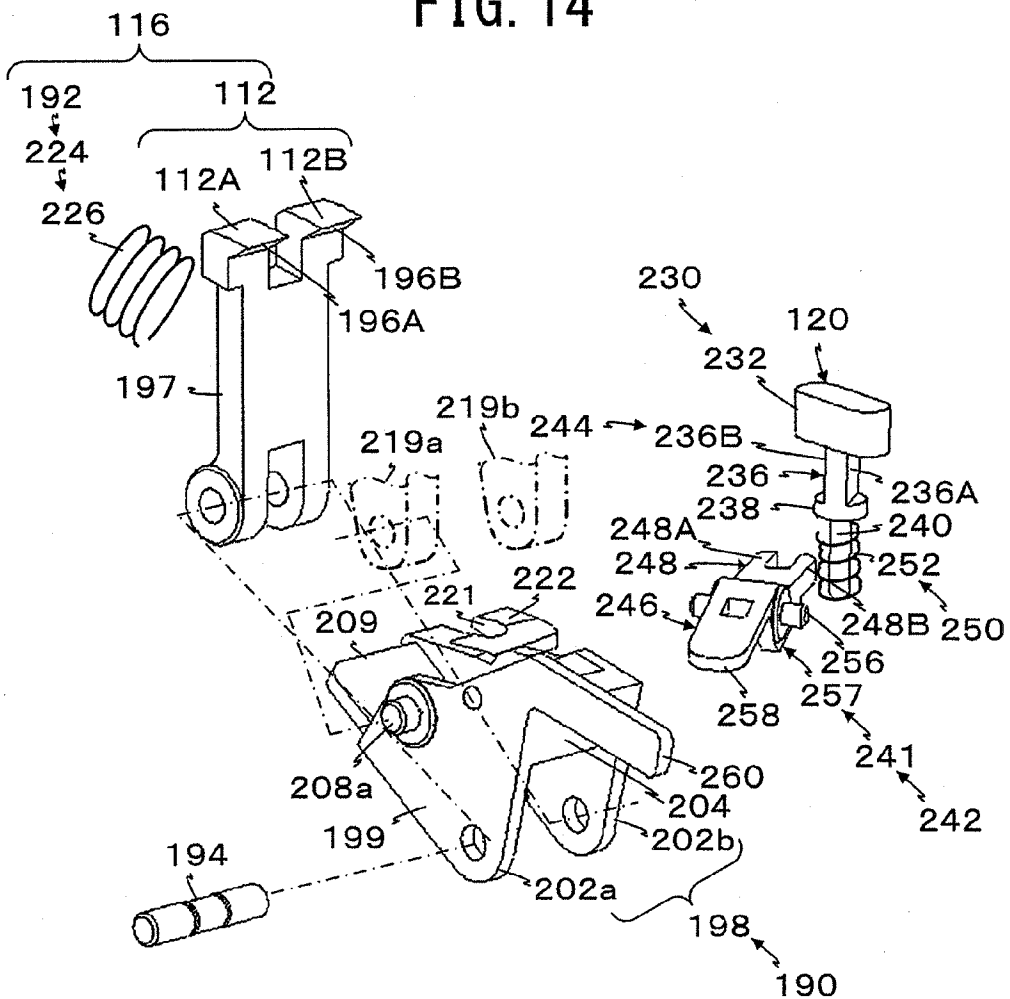
FIG. 14 is an exploded perspective view of the guide member, the stopper, and the interlocking device of the coin dispensing unit used for the coin dispensing apparatus according to the first embodiment of the present invention.

In this first embodiment, the position selecting device 190 comprises the position selector 198 and an actuator 200, as shown in FIGS. 12 to 14.

The position selector 198 of the position selecting device 190 has the function of selectively positioning the guide member 112 between the guiding position GP and the non-guiding position NGP. Concretely, when the position selector 198 is positioned at a dispensing assisting position AP (see FIG. 19B), the selector 198 makes the guide member 112 positioned at the guiding position GP. When the position selector 198 is positioned at a non-dispensing assisting position NAP (see FIG. 20B), the selector 198 makes the guide member 112 positioned at the non-guiding position NGP.

Figure 19A:
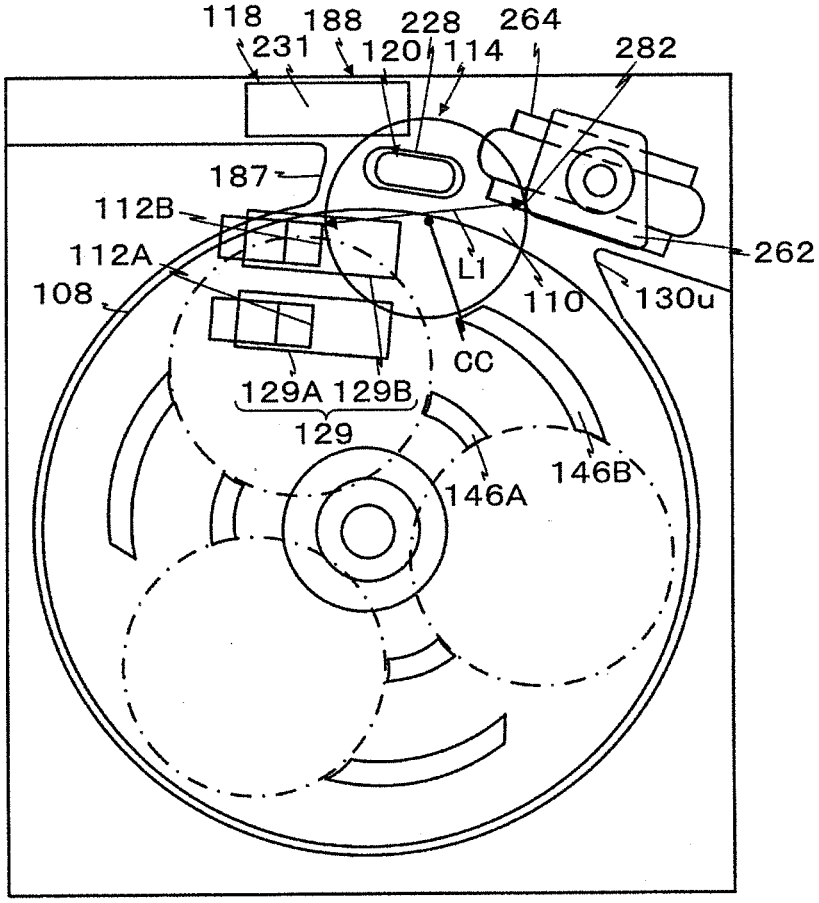
FIG. 19A is a plan view showing the operation of the coin dispensing unit used for the coin dispensing apparatus according to the first embodiment of the present invention in the non-dispensing period.
Figure 19B:
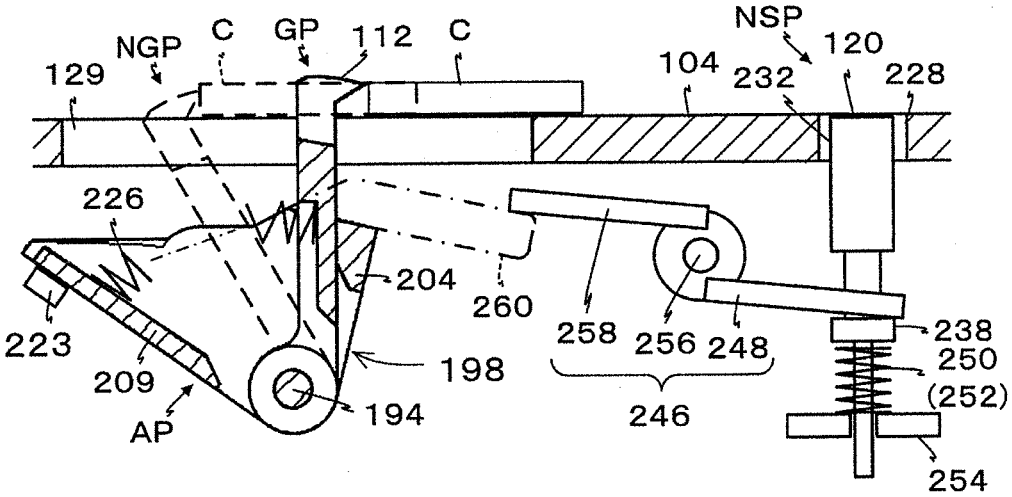
FIG. 19B is a schematic cross-sectional view showing the operation of the coin dispensing unit used for the coin dispensing apparatus according to the first embodiment of the present invention in the non-dispensing period.
Figure 20A:
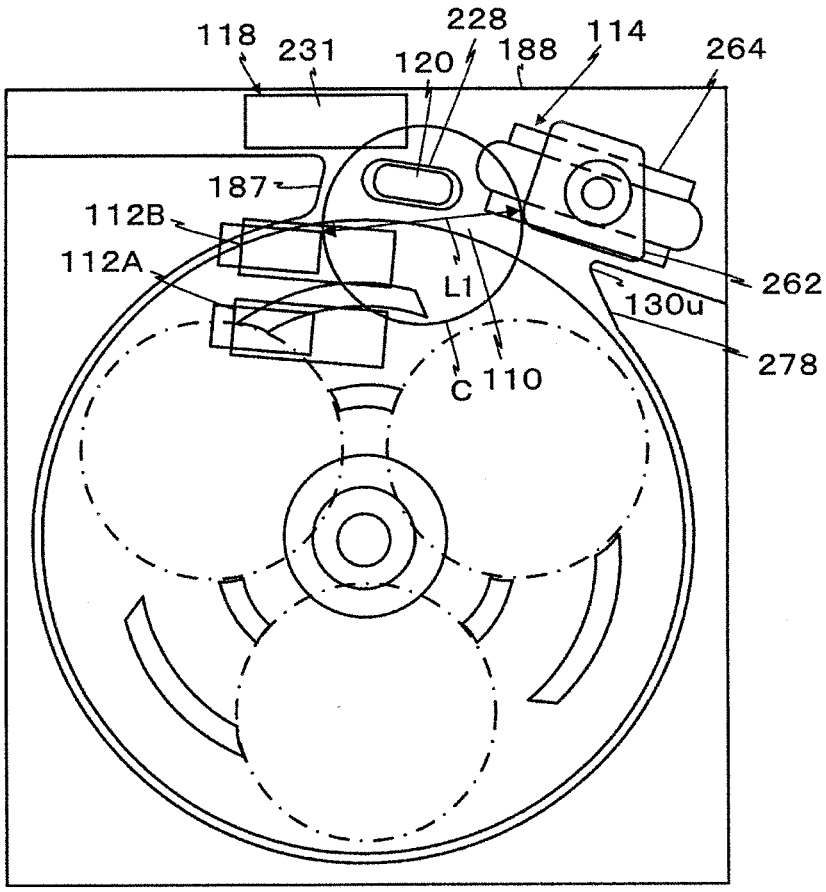
FIG. 20A is a plan view showing the operation of the coin dispensing unit used for the coin dispensing apparatus according to the first embodiment of the present invention in the dispensing period.
Figure 20B:
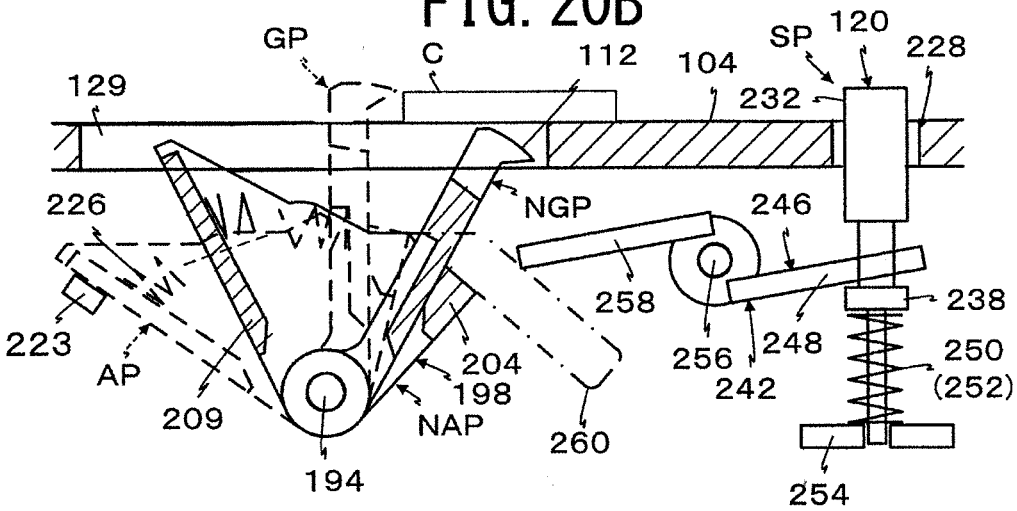
FIG. 20B is a schematic cross-sectional view showing the operation of the coin dispensing unit used for the coin dispensing apparatus according to the first embodiment of the present invention in the dispensing period.
Figure 21:
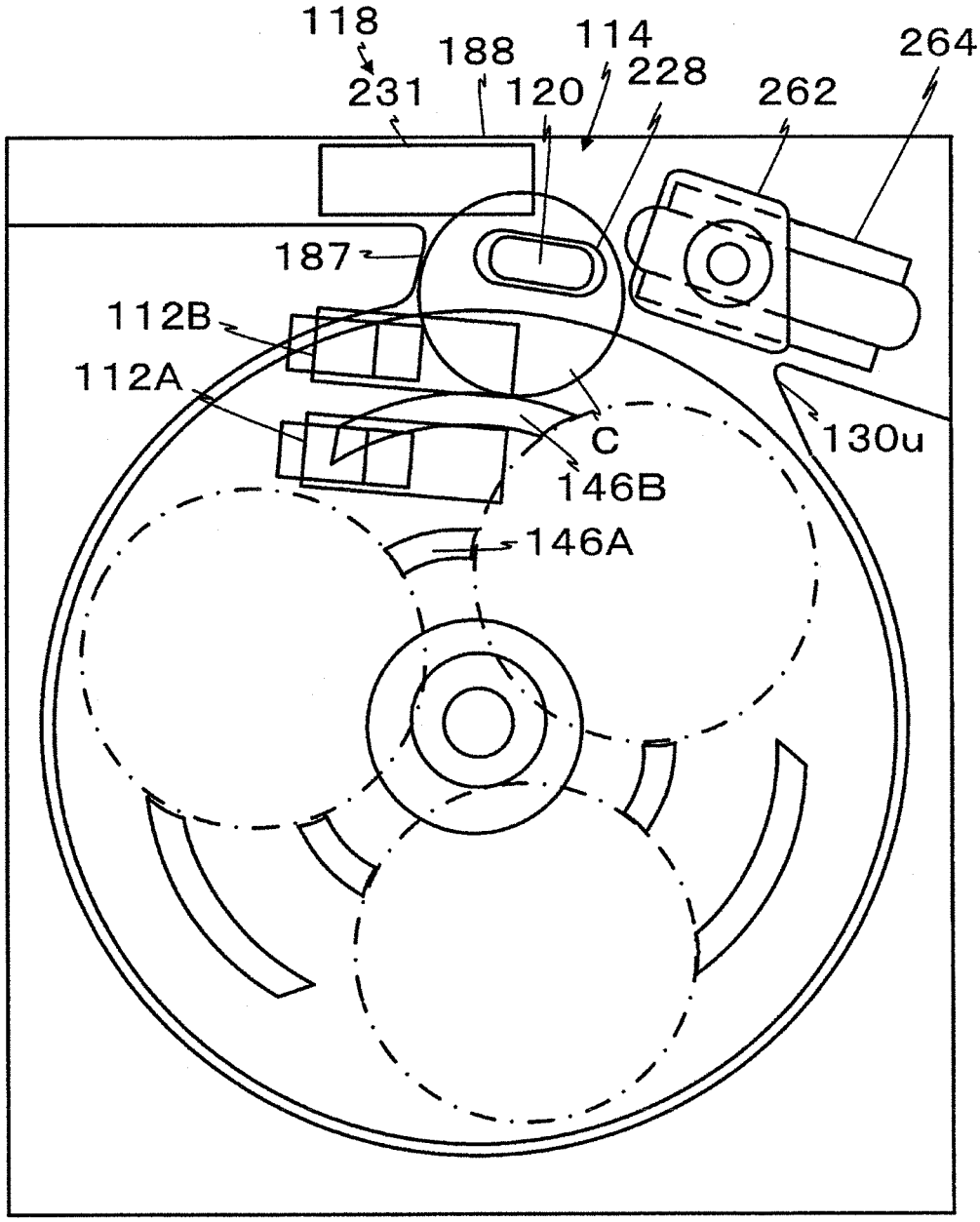
FIG. 21 is a plan view showing the operation of the coin dispensing unit used for the coin dispensing apparatus according to the first embodiment of the present invention, where small-sized coins are dispensed.

In this first embodiment, the position selector 198 comprises a pair of a first sidewall 202*a* and a second sidewall 202*b* the side views of which are inverted triangular and which are arranged in parallel at a predetermined distance in a vertical direction, a rocking motion limiter 204 that interconnects the first sidewall 202*a* and the second sidewall 202*b*, and a spring receiver 209, as shown in FIGS. 19B and 20B. The overall shape of the position selector 198 is like a hollow bag.

A large part of the guide member 112 is placed closely between the first sidewall 202*a* and the second sidewall 202*b*, thereby limiting the movement of the guide member 112 along the supporting shaft 194.

On the first and second sidewalls 202*a* and 202*b*, a first rocking shaft 208*a* and a second rocking shaft 208*b* are respectively provided to protrude outwardly from their middle portions along the same axis in opposite directions. The first and second rocking shafts 208*a* and 208*b* are rockably supported by a first bracket 219*a* and a second bracket 219*b*, respectively, as shown in FIG. 14. The first bracket 219*a* and the second bracket 219*b* are protruded downward from the back of the base 104 in such a way as to be parallel to each other at a predetermined interval.

Moreover, in the vicinity of the spring receiver 209 formed at the upper end of the second sidewall 202*b*, an attachment piece 222 having an engaging groove 221 is formed to protrude laterally from there. The engaging groove 221 is U-shaped in cross section.

The rocking motion of the position selector 198 is limited by a position limiter 223 that can be engaged with a part (the spring receiver 209) of the position selector 198 at the dispensing assisting position AP. The position limiter 223 is a member fixed on the lower surface of the base 104. When the position selector 198 is rocked to the dispensing assisting position AP by the actuator 200 which will be described later, the position limiter 223 is engaged with a part of the position selector 198, thereby stopping a further rocking motion of the position selector 198. In this way, the position selector 198 is kept at the dispensing assisting position AP.

The rocking motion limiter 204 is a bar-shaped member formed laterally in such a way as to interconnect the first and second sidewalls 202*a* and 202*b* at their upper ends. When the guide member 112 receives a rocking force from an ejecting spring 226, the rocking motion limiter 204 is engaged with the guide member 112 which has been rocked in a predetermined direction by this rocking force, thereby limiting the relative rocking motion of the guide member 112 with respect to the rocking motion limiter 204.

As seen from FIGS. 20A and 20B, the rocking motion limiter 204 has a trapezoidal cross section. The rocking motion limiter 204 is configured in such a way as to be in surface contact with the guide member 112 when the limiter 204 is engaged with the guide member 112.

The spring receiver 209 has the function of supporting fixedly one end of the ejecting spring 226 which gives a rocking force to the guide member 112. The spring receiver 209 is formed by a plate-shaped member that interconnects the first and second sidewalls 202*a* and 202*b* on the opposite side to the rocking motion limiter 204. The spring receiver 209 receives one end of the spring 226 stably at a flat surface of the receiver 209. The end of the spring 226 is fixed on this flat surface by an engaging member (not shown).

The attachment piece 222 is formed to be integrated with the position selector 198. The attachment piece 222 is a plate-shaped member that protrudes outward laterally from the side of the spring receiver 209 formed at the upper end of the second sidewall 202*b*. The attachment piece 222 has a grove 221 in which a part of the output rod 212 of the actuator 200 which will be described later is fitted and engaged.

The distance from the first and second rocking shafts 208*a* and 208*b* to the attachment piece 222 is shorter than the distance from the first and second rocking shafts 208*a* and 208*b* to a linking portion 260 which will be explained later. This is because the actuator 200 which can be placed in the small-sized coin dispensing unit 22-100 needs to be used.

The position selector 198 further comprises the linking portion 260. The linking portion 260 has the function of moving a rocking lever 257 which serves as an interlocking device 242 described later. In this first embodiment, the linking portion 260 is positioned at the upper end of the first sidewall 202*a* and is like a linear bar-shaped member that protrudes laterally from the vicinity of the rocking motion limiter 204. When the position selector 198 is positioned at the non-dispensing assisting position NAP, the linking portion 260 is moved to a position where the linking portion 260 does not move a driven lever 258 which will be described later. When the position selector 198 is positioned at the dispensing assisting position AP, the linking portion 260 is moved to a position where the linking portion 260 moves the driven lever 258.

Figure 16:
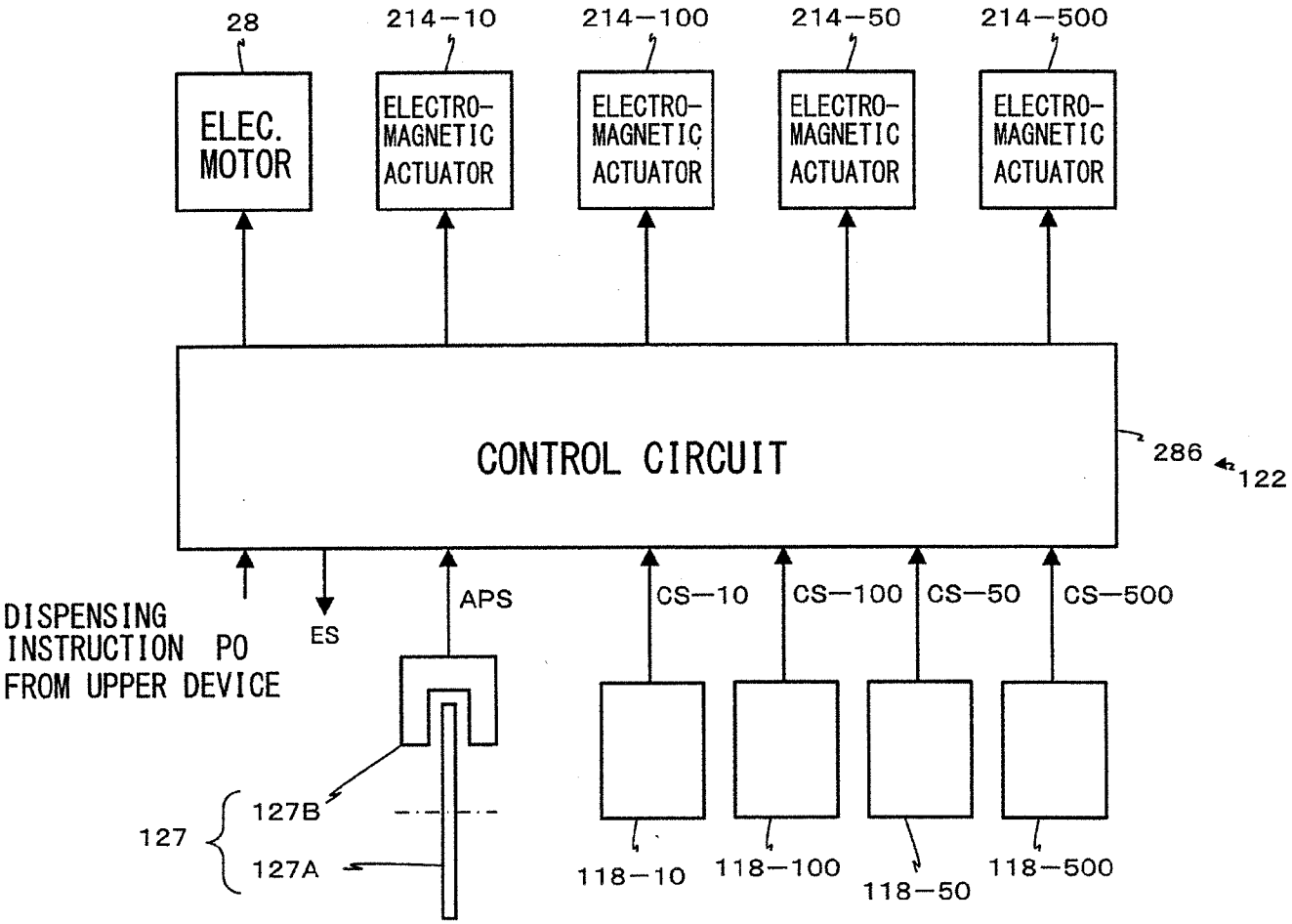
FIG. 16 is a functional block diagram of the controller (the control device) used in the coin dispensing apparatus according to the first embodiment of the present invention.

As shown in FIG. 12, the actuator 200 of the position selecting device 190 has the function of selectively positioning the position selector 198 at the dispensing assisting position AP or the non-dispensing assisting position NAP based on an instruction from the control circuit 122 shown in FIG. 16. This means that the actuator 200 advances or retreats (i.e., pushes out or pulls in) the output rod 212 based on an instruction from the control circuit 122, thereby positioning selectively the position selector 198 at the dispensing assisting position AP or the non-dispensing assisting position NAP. Accordingly, an electric actuator, a mechanical actuator, or a fluidic actuator may be used as the actuator 200.

An electric actuator 213 is preferably used as the actuator 200. The electric actuator 213 is a general term of actuators that provide or cause mechanical displacements by supplying currents, which includes the type where Joule heat is generated by supplying currents and the deformation amount of a shape-memory alloy is varied by using this heat and the type of linear motors.

In this first embodiment, an electromagnetic actuator 214 is used as the electric actuator 213. The electromagnetic actuator 214 comprises a rectangular pillar-shaped body 216, an electromagnet 218 placed in the body 216, and the output rod 212 mounted in the body 216 as a movable core. When the electromagnet 218 is magnetized, the output rod 212 is pulled into the body 216. When the electromagnet 218 is de-magnetized, the output rod 212 is pushed out from the body 216 by the action of a spring 220 mounted on the outside of the rod 212 like a sheath.

On the top end of the output rod 212 of the electromagnetic actuator 214, a large diameter part 223 is formed. A small diameter part is formed below the large diameter part 223, with which the groove 221 for the attachment piece 222 is engaged. The attachment piece 222 is pressed against the lower face of the large diameter part 223 by the spring 220. Therefore, if the electromagnet 218 is magnetized, the output rod 212 is lowered or pulled in and thus, the position selector 198 is rocked counterclockwise in FIGS. 19B and 20B to the dispensing assisting position AP by way of the large diameter part 23 and the attachment piece 222. As a result, the guide member 112 is positioned at the guiding position GP. If the electromagnet 218 is de-magnetized, the output rod 212 is raised or pushed out from the body 216 by the spring 220 and thus, the position selector 198 is rocked clockwise in FIGS. 19B and 20B to the non-dispensing assisting position NAP. As a result, the guide member 112 is positioned at the non-guiding position NGP.

If the guide member 112 is positioned at the non-guiding position NGP, the movement of the coins C along the carrying path MP is not prevented. Thus, the guide member 112 performs the reversal permitting function also in the event that the guide member 112 is positioned at the non-guiding position NGP.

[Ejecting Device of Coin Dispensing Unit]

As shown in FIGS. 12 and 14, the ejecting device 116 has the function of ejecting the coins C which have been guided to the dispensing opening 110 by the guide member 112 to the dispensing passage 114. This means that the ejecting device 116 has the "ejecting function". In this first embodiment, the ejecting device 116 comprises the guide member 112 and the resilience device 192.

Since the guide member 112 is already explained as above, the resilience device 192 will be explained here with reference to FIG. 14.

The resilience device 192 elastically biases the guide member 112 toward the side of the rocking motion limiter 204 of the position selector 198. When the guide member 112 is pressed by the coins C to be rocked around the supporting shaft 194, thereby accumulating a resilience force in the resilience device 192, the resilience force thus accumulated will cause the guide member 112 to rock around the shaft 194 in the reverse direction, thereby ejecting the coins C.

In this first embodiment, the resilience device 192 is a resilient spring 226 as an elastic member 224 which is placed between the spring receiver 209 and the guide member 112. Therefore, if the coin C presses the first and second inclined faces 196A and 196B of the first and second guide member portions 112A and 112B and as a result, the first and second guide member portions 112A and 112B are rocked around the supporting shaft 194, a resilience force is accumulated in the resilient spring 226. If the pressing motion to the guide member portions 112A and 112B by the coin C is eliminated at a predetermined moment, the guide member portions 112A and 112B will be rocked lively in the reverse direction due to the resilience force accumulated in the resilient spring 226. Because of this reverse rocking motion, the first and second inclined faces 196A and 196B (more specifically, the first inclined face 196A) will eject the coin C to the dispensing passage 114.

[Coin Sensor of Coin Dispensing Unit]

The coin sensor 118 has the function of detecting the coin C ejected by the ejecting device 116. In this first embodiment, a magnet-type metal sensor 231 is used as the coin sensor 118. Therefore, the coin sensor 118 may be replaced with other device having a similar function, such as a photoelectric sensor, a mechanical sensor, and so on.

In this embodiment, as shown in FIG. 6, the coin sensor 118 is located to be opposite to the dispensing passage 114. However, the coin sensor 118 may be located in the downstream side of the coin outlet 48.

[Passage Blocking Member of Coin Dispensing Unit]

Next, the passage blocking member or stopper 120 will be explained in detail below with main reference to FIGS. 12 to 14.

When the guide member 112 is located at the non-guiding position NGP, the passage blocking member 120 is located at the blocking position SP (FIG. 20), thereby blocking the coin C which is moved in conjunction with the rotation of the rotary disk 108 so as not to be moved to the dispensing passage 114 from the dispensing opening 110. When the guide member 112 is located at the guiding position GP, the passage blocking member 120 is located at the non-blocking position NSP (FIG. 19), thereby allowing the coin C to be moved to the dispensing passage 114 from the dispensing opening 110.

In this first embodiment, the passage blocking member 120 is movably inserted into an appearance/disappearance hole 228 formed in the passage bottom face 186 of the dispensing passage 114 which is adjacent to the dispensing opening 110. The passage blocking member 120 can be moved perpendicular to the passage bottom face 186.

At the blocking position SP, the passage blocking member 120 is protruded from the appearance/disappearance hole 228 to the dispensing passage 114, thereby blocking the movement of the coin C through the dispensing passage 114. At the non-blocking position NSP, the passage blocking member 120 is retracted from the dispensing passage 114 through the appearance/disappearance hole 228 (in other words, retracted to the downside of the dispensing passage 114), allowing the movement of the coin C through the dispensing passage 114.

In this first embodiment, the appearance/disappearance hole 228 has a shape of an elongated rectangle whose corners are rounded. The length of the hole 228 is set so as to cover about one-third (⅓) of the length of the dispensing opening 110. However, the size and shape of the passage blocking member 120 are not limited to these as far as the aforementioned functions can be realized.

In this first embodiment, the passage blocking member 120 is a bar-shaped member extending perpendicular to the passage bottom face 186, which comprises a stopper part 232 formed at the top end part 230, a cooperation part 236 extended downward from the top end part 230, a retainer part 238 located below the cooperation part 236, and a small diameter part 240 formed next to the retainer part 238, as shown in FIGS. 12 to 14.

The stopper part 232 (i.e., the top end part 230) of the passage blocking member 120 has the function of making contact with the coin C to thereby block its movement toward the dispensing passage 114. The stopper part 232 has a similar shape to the appearance/disappearance hole 228 in a plan view, which is slightly smaller than that of the hole 228. The thickness of the stopper part 232 is larger than the thickness of the base 104 in such a way that the stopper part 232 is guided by the inner wall face of the appearance/disappearance hole 228 to produce a linear reciprocating motion of the passage blocking member 120 along its longitudinal axis. However, the present invention is not limited to this. If the member 120 can produce a linear reciprocating motion along the longitudinal axis thereof in cooperating with other part(s) or member(s), the thickness of the stopper part 232 may be smaller than the thickness of the base 104. The shape of the member 120 also is not limited to this. The member 120 may have any other shape like a circular bar, a polygonal pillar, or a triangular pillar.

As shown in FIG. 14, the cooperation part 236 of the passage blocking member 120 has the function of moving the member 120 to the non-blocking position NSP or the blocking position SP in interlocking with the movement of the guide member 112 to the guiding position GP or non-guiding position NGP. In other words, the cooperation part 236 has the function of carrying the movement of the interlocking device 242 which will be described later to the member 120 in order to move the member 120 to the non-blocking position NSP or the blocking position SP in interlocking with the movement of the position selector 198 to the dispensing assisting position AP or the non-dispensing assisting position NAP. In this embodiment, the cooperation part 236 is formed by a guiding part 244 comprising a first face 236A and a second face 236B formed in parallel to each other at a predetermined interval.

The guiding part 244 serving as the cooperation part 236 is sandwiched by a U-shaped part 248 of an interlocking member 246 which will be described later. In other words, the first face 236A and the second face 236B of the guiding part 244 (the cooperation part 236) are respectively opposed to a first pinching portion 248A and a second pinching 248B formed in parallel to each other at a predetermined interval which constitute the U-shaped part 248.

Around the small diameter part 240 of the passage blocking member 120, a spring 252 serving as a biasing member 250 is mounted. The upper end of the spring 252 is abutted on the lower face of the retainer part 238 of the member 120, and the lower end thereof is abutted on a bracket 254 (see FIGS.

19B and 20B) which is formed on the back of the base 104 to be integrated therewith. Therefore, the passage blocking member 120 is biased upward with respect to the base 104 by the resilience force of the spring 252. In other words, the member 120 is biased in such a way as to be protruded upward from the passage bottom face 186 of the dispensing passage 114. However, the amount of protrusion of the member 120 is determined by abutting the retainer part 238 onto the interlocking member 246. In addition, due to the downward motion of the retainer portion 238 caused by rocking the interlocking member 246, the member 120 (the top end part 230) is pulled into the appearance/disappearance hole 228 until at least the top end face of the member 120 reaches the same level as the passage bottom face 186.

[Interlocking Device of Coin Dispensing Unit]

Next, the interlocking device 242 will be explained below with reference to FIGS. 13 and 14.

The interlocking device 242 has the function of interlocking the guide member 112 and the passage blocking member 120. In other words, the interlocking device 242 has the function of placing the passage blocking member 120 at the non-blocking position NSP if the guide member 112 is located at the guiding position GP, and placing the passage blocking member 120 at the blocking position SP if the guide member 112 is located at the non-guiding position NGP.

In this first embodiment, a mechanical linking mechanism 241 is used as the interlocking device 242. More specifically, the mechanical linking mechanism 241 is formed by the rocking lever 257 as the plate-shaped interlocking member 246. A third supporting shaft 256, which is rotatably supported by the bearings (not shown) protruded downward from the lower side face of the base 104, is provided at the middle part of the rocking lever 257.

At one end of the interlocking member 246 constituting the interlocking device 242 (the mechanical linking mechanism 241), the U-shaped part 248 is formed. The U-shaped part 248 is used to sandwich the cooperation part 236 of the passage blocking member 120 at the first face 236A and the second face 236B thereof. By this structure, when the interlocking member 246 is rocked clockwise in FIGS. 19B and 20B, the retainer portion 238 of the passage blocking member 120 is pressed down by the U-shaped part 248. Thus, the passage blocking member 120 is pressed down into the appearance/disappearance hole 228 to reach the non-blocking position NSP. At the other end of the interlocking member 246, a driven lever 258 is formed to extend linearly to have a predetermined length.

In this first embodiment, in response to the movement of the position selector 198 to the non-guiding position NGP, the pushing up action to the driven lever 258 is eliminated and as a result, the passage blocking member 120 is pushed upward by the spring 252 as the biasing member 250 to be moved to the blocking position SP. If the position selector 198 is moved to the dispensing assisting position AP, the passage blocking member 120 is moved downward against the resilience of the spring 252 and stopped at the blocking position SP defined in the dispensing passage 114 while protruding the stopper part 232 of the member 120 from the passage bottom face 186.

Therefore, if the electromagnet 218 of the electromagnetic actuator 214 is de-magnetized, the position selector 198 is located at the non-dispensing assisting position NAP and therefore, the linking portion 260 does not press the driven lever 258 from the downside. As a result, the passage blocking member 120 is pushed upward by the resilience force of the spring 252 and moved until the retainer part 238 is prevented from moving by the U-shaped part 248. In other words, the passage blocking member 120 is pushed upward and the top end part 230 of the member 120 is protruded from the passage bottom face 186, thereby placing the member 120 at the blocking position SP where the stopper part 232 crosses the dispensing passage 114. At this time, the position selector 198 is engaged by the position limiter 223.

If the electromagnet 218 is magnetized, the output rod 212 is pulled downward in FIG. 12 and therefore, the position selector 198 is rocked counterclockwise in FIG. 19B around the supporting shaft 194 to reach the dispensing assisting position AP. Consequently, the linking portion 260 pushes the driven lever 258 upward from the downside and the driven lever 258 (and therefore, the U-shaped part 248) pushes the retainer part 238 downward against the resilience of the spring 252. In this way, the stopper part 232 is pulled into the appearance/disappearance hole 228 and retracted from the dispensing passage 114, reaching the non-blocking position NSP.

In this first embodiment, as clearly seen from FIG. 13, the linking portion 260 and the interlocking member 246 are arranged so as to form an acute angle in a plan view. Because of this arrangement and structure, there is an advantage that the guide member 112 and the passage blocking member 120 can be interlocked with each other with a mechanical linking mechanism at a low cost even in the small-sized coin dispensing unit 22-100.

[Dispensing opening Adjustor of Coin Dispensing Unit]

Figure 15:
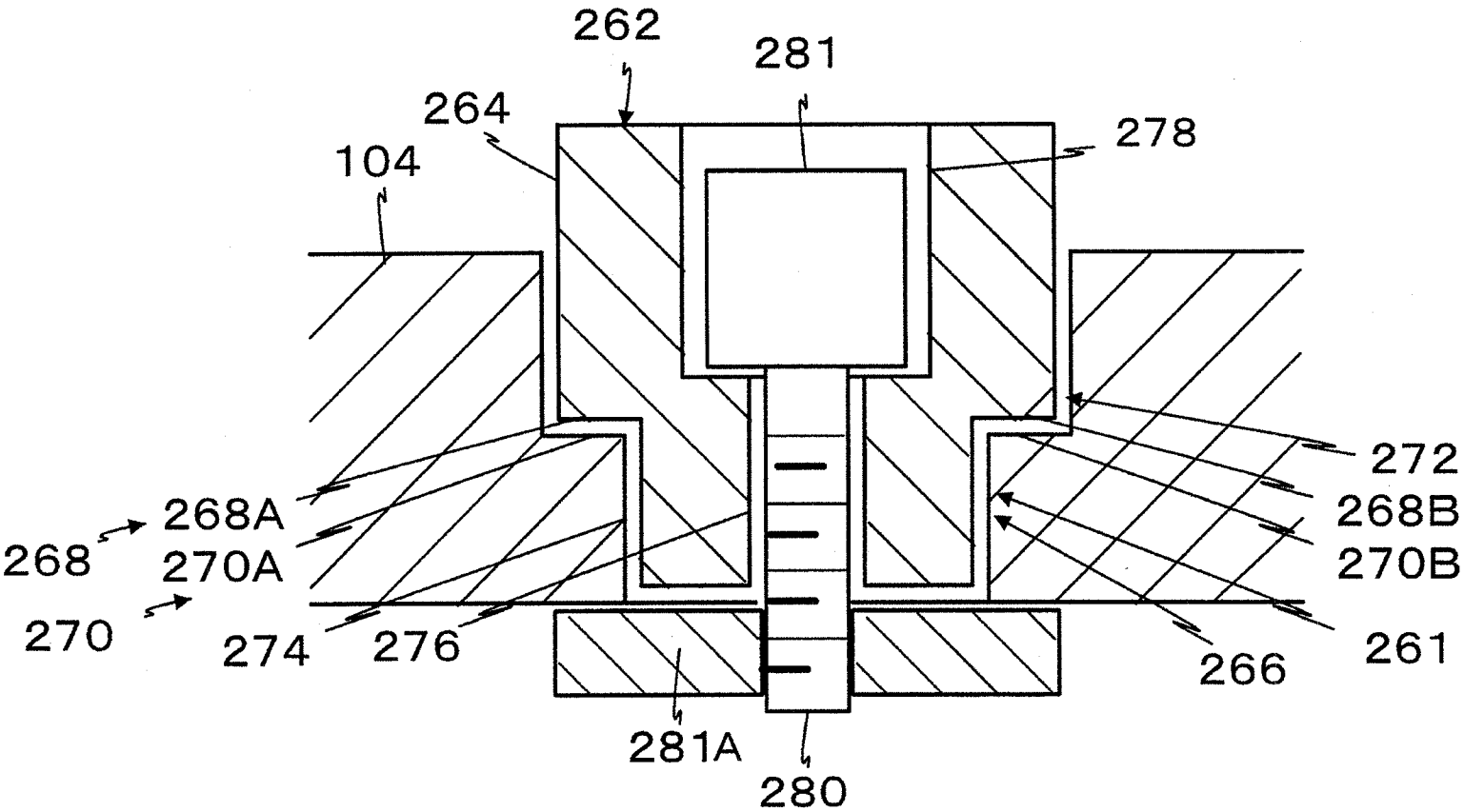
FIG. 15 is a cross-sectional view along the line XV-XV in FIG. 6.

Next, the dispensing opening adjustor 262 that constitutes a part of the ejecting device 116 will be explained below with reference to FIGS. 6 and 15.

The dispensing opening adjustor 262 has the function of adjusting the interval DT between adjustor 262 and the downstream-side guiding face 187 in accordance with the diameter of the coin C to define the dispensing opening 110 of the coin C. In this embodiment, the dispensing opening adjustor 262 further has the function of dispensing the coin C as a part of the ejecting device 116 also. This means that the dispensing opening adjustor 262 sandwiches the coin C in cooperation with the guide member 112 (specifically, the second guide member portion 112B) and finally, the second guide member portion 112B ejects the coin C.

In this first embodiment, the dispensing opening adjustor 262 is trapezoidal plate-shaped in a plan view. As seen from FIG. 15 showing the longitudinal cross section of the adjustor 262, the adjustor 262 comprises an upper part 264 and a lower part 266, where the upper part 264 is wider than the lower part 266. A boundary face 268A and a boundary face 268B are formed at the boundary between the upper and lower parts 264 and 266. Thus, the dispensing opening adjustor 262 has a stepped exterior.

On the passage bottom face 186 of the dispensing passage 114, as shown in FIG. 6, a position adjusting groove 270 is formed. This groove 270 is linearly extended toward the downstream-side edge 130*d* from the upstream-side edge 130*u* and reaches the center of the dispensing passage 114. The longitudinal cross section of the groove 270 comprises a relatively wider upper groove 272 and a relatively narrower lower groove 274, where a boundary face 270A and a boundary face 270B are formed between the upper and lower grooves 272 and 274. Thus, the position adjusting groove 270 forms a stepped hole.

The dispensing opening adjustor 262 is inserted into the position adjusting groove 270. Specifically, the lower and upper parts 266 and 264 of the dispensing opening adjustor 262 are slidably inserted closely in the lower and upper grooves 274 and 272 of the groove 270, respectively. In other words, the dispensing opening adjustor 262 is extended linearly along the groove 270 and can be contacted with the downstream-side guiding face 187.

At the central part of the dispensing opening adjustor 262, a penetrating threaded hole 276 is formed vertically. The top of the dispensing opening adjustor 262 is cylindrically depressed. This is to allow the head 281 of a fixing screw 280 to be buried in this depression 278. If the fixing screw 280 is penetrated through the threaded hole 276 of the adjustor 262, and a nut 281A which is abutted onto the back of the base 104 is thrust into the end of the screw 288, thereby sandwiching the base 104 (the boundary faces 270A and 270B) by the nut 281A and the dispensing opening adjustor 262. Thus, the dispensing opening adjustor 262 can be fixed on the base 104 at a suitable position in accordance with the diameter of the coin C. Concretely, the distance between a coin engaging part 282 of the dispensing opening adjustor 262 and the downstream-side edge 130*d* of the coin guiding wall 130 is set to be slightly larger than the diameter of the coin C, wherein the coin engaging part 282 is formed at a corner of the adjustor 262.

As shown in FIGS. 19A and 19B, in the event that the coin C is sandwiched by the guide member portion 112B and the coin engaging part 282, unless the guide member 112 is rocked around the supporting shaft 194 by a predetermined amount or more, the center CC of the coin C does not pass through the line L1 that connects the contact point of the second guide member portion 112B and the coin C and the contact point of the coin C and the coin engaging part 282. The positional relationship among the guide member portion 112B, the coin engaging part 282, and the supporting shaft 194 is determined in this way. This means that the coin C can be ejected as long as the resilience force of the resilience spring 226 that is applied to the guide member 112 is equal to a predetermined value or greater. Because of such the relationship, there is an advantage that dispensing errors of the coin C can be prevented from occurring.

If the position of the dispensing opening adjustor 262 is adjusted to a position corresponding to the 50 yen coin 50 C having the minimum diameter, the dispensing opening adjustor 262 is located at a position close to the passage blocking member 120. If the position of the adjustor 262 is adjusted to a position corresponding to the 500 yen coin 500 C having the maximum diameter, the adjustor 262 is located at a position shown in FIG. 6. Even in the latter case, the interval between the member 120 and the adjustor 262 is set to be smaller than the diameter of the minimum-sized 50 yen coin 50 C. This is to prevent the minimum-sized 50 yen coins 50 C to pass through this interval.

[Rotary Encoder of Coin Dispensing Unit]

Next, a rotary encoder 127 will be explained below with reference to FIG. 16.

The rotary encoder 127 has the function of outputting information about the angular position (phase) of the rotary disk 108. In other words, the rotary encoder 127 has the function of detecting the angular position (phase) of the disk 108 in order to prevent the disk 108 from being stopped in the state where the coin C moved in conjunction with the rotation of the disk 108 is overlaid on the advance/retreat hole 129 for the guide member 112. Thus, the rotary encoder 127 may be replaced with another device having a similar function.

In this first embodiment, the rotary encoder 127 is mounted below the intermediate base 36 and comprises a slit disk 127A and a photoelectric sensor 127B. The disk 127A is fixed to the reducer output shaft 32 and has slits 127S formed on its annular periphery at constant intervals. The photoelectric sensor 127B is fixed to the intermediate base 36 and detects the slits 127S on the disk 127A to output an angular position signal APS.

The rotary encoder 127 is not limited to the type of the first embodiment and may be provided at a position which is rotatable in synchronization with any one of the driven gears 42 for the other denominations.

In this first embodiment, three slits 127S are formed at equal intervals of 120 degrees. These slits 127S are used to detect the angular positions (phases) of the apertures 136 of the disks 108 (108-10, 108-100, 108-50 and 108-500).

[Control Circuit of Coin Dispensing Apparatus]

Next, the control circuit 122 of the coin dispensing apparatus 10 according to the first embodiment will be explained below with reference to FIG. 16. The control circuit 122 controls the coin dispensing apparatus 10 including the coin dispensing units 22-10, 22-100, 22-50 and 22-500.

The control circuit 122 has the function of receiving a dispensing instruction PO of the coins C from the control section (not shown) of an upper system or device (e.g., a POS register), an angular position signal APS of the rotary disks 108-10, 108-100, 108-50 and 108-500 from the rotary encoder 127, and coin signals CP-10, CP-100, CP-50, and CP-500 from the coin sensors 118-10, 118-100, 118-50 and 118-500, and turning on or off the electromagnetic actuators 214-10, 214-100, 214-50 and 214-500 in accordance with a predetermined program. This means that the control circuit 122 energizes or de-energizes the electromagnetic actuators 214-10, 214-100, 214-50 and 214-500. Moreover, the control circuit 122 has the function of instructing the electric motor 28 to rotate in the forward or reverse direction or to stop also.

In this first embodiment, the control circuit 122 is configured by a microcomputer 286.

When the control circuit 122 receives a dispensing signal PO of dispensing a designated amount of the coins C from the control section of the upper device, the control circuit 122 calculates necessary denominations and necessary numbers of the coins C to be dispensed, and magnetizes selectively the electromagnets 218 of the electromagnetic actuators 214-10, 214-100, 214-50 and/or 214-500 of the coin dispensing units 22-10, 22-100, 22-50 and/or 22-500 according to the necessity, thereby moving the position selectors 198 to the dispensing assisting positions AP by way of the output rods 202 and the attachment pieces 222, and moving the passage blocking members 120 to the non-blocking positions NSP by way of the interlocking devices 242. As a result, the guide members 112 are located at the guiding positions GP in the coin dispensing units 22-10, 22-100, 22-50 and/or 22-500.

Moreover, when receiving the dispensing signal PO, the control circuit 122 outputs a forward rotation signal to the electric motor 28 to rotate the reducer output shaft 32, the driving spur gear 38S, the idler gear 40-500, the driven spur gear 42S-500, the idler gear 40-50, the driven spur gear 42S-50, the idler gear 40-100, the driven spur gear 42S-100, the idler gear 40-10, and the driven spur gear 42S-10, thereby synchronously rotating the rotary disks 108-10, 108-100, 108-50 and 108-500. Furthermore, the control circuit 122 selectively magnetizes the electromagnetic actuators 214-10. 214-100, 214-50 and 214-500, thereby moving the guide members 112 to the dispensing assisting positions AP and the passage blocking members 120 to the non-blocking positions NSP in the coin dispensing units 22-10, 22-100, 22-50 and/or 22-500.

In this way, as described previously, the coins C moved in conjunction with the rotation of each of the rotary disks 108-10, 108-100, 108-50, and 108-500 are guided to the dispensing opening 110 by the guide member 112, sandwiched by the coin engaging part 282 of the dispensing opening adjustor 262 and the second guide member portion 112B, and finally ejected to the dispensing passage 114 by the resilience force of the resilience spring 226 applied to the second guide member portion 112B.

After the designated number of the coins C of the designated denominations are dispensed, to prevent a further dispensing of the coins C, the electromagnet 218 of each of the electromagnetic actuators 214 is de-magnetized, thereby moving the position selector 198 to the non-dispensing assisting position NAP and the guide member 112 to the non-guiding position NGP. After the guide member 112 is moved to the non-guiding position NGP, the supply of electric power to the electric motor 28 is stopped. In the event of stopping the rotation of each of the rotary disks 108, the timing for stopping the supply of electric power to the motor 28 is controlled based on the angular position signal APS from the encoder 127 and as a result, the movement of the coins C is stopped in such way that the coins C are not overlaid on the advance/retreat hole 129.

The coins C thus dispensed are detected by the respective metal sensors 118-10, 118-100, 118-50 and 118-500. In response to this, these sensors 118-10, 118-100, 118-50 and 118-500 output the coin signals CS-10, CS-100, CS-50 and CS-500 to the control circuit 122.

When receiving the coin signals CS-10, CS-100, CS-50 and CS-500, the control circuit 122 judges whether or not the coin signals CS-10, CS-100, CS-50 and CS-500 are equal to the numbers for the respective denominations designated by the dispensing instruction PO, in other words, whether or not the numbers included in the coin signals CS-10, CS-100, CS-50 and CS-500 are respectively equal to the designated numbers.

If the number included in any one of the coin signals CS-10, CS-100, CS-50 and CS-500 does not reach the designated number, the control circuit 122 keeps energizing the corresponding electromagnetic actuator 214. As a result, the guide member 112 is kept at the guiding position GP, thereby keeping the dispensing action of the coins C in the corresponding coin dispensing unit 22.

If the number included in any one of the coin signals CS-10, CS-100, CS-50 and CS-500 reaches the designated number, the control circuit 122 de-energizes the corresponding electromagnetic actuator 214 and therefore, the position selector 198 is moved to the non-dispensing assisting position NAP. As a result, the guide member 112 is moved to the non-guiding position NGP and the passage blocking member 120 is moved to the blocking position SP, thereby stopping the dispensing action of the coin C in the corresponding coin dispensing unit 22.

[Operation of Coin Dispensing Apparatus]

Figure 17:
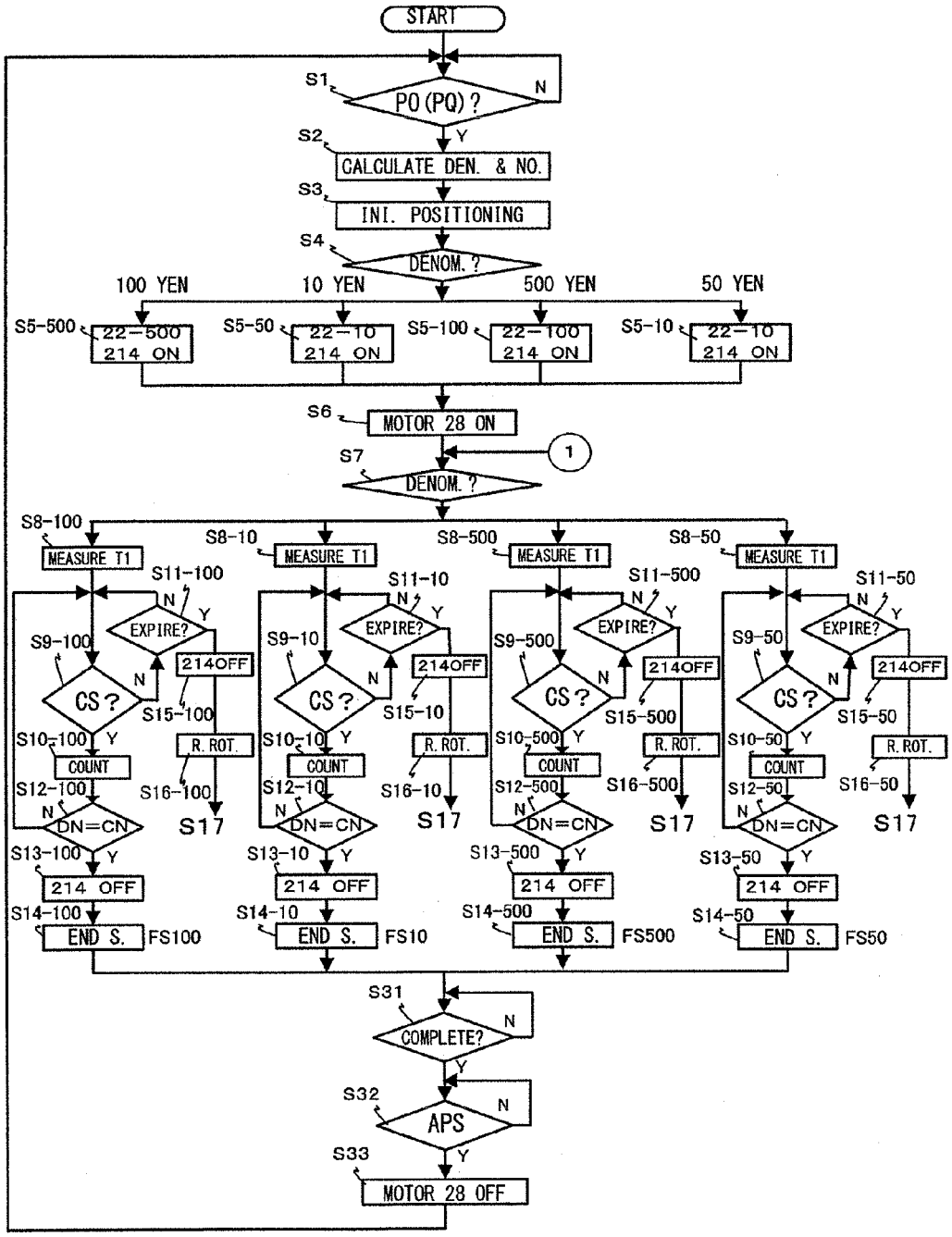
FIG. 17 is a flowchart showing the operation of the control circuit used in the coin dispensing apparatus according to the first embodiment of the present invention.
Figure 18:
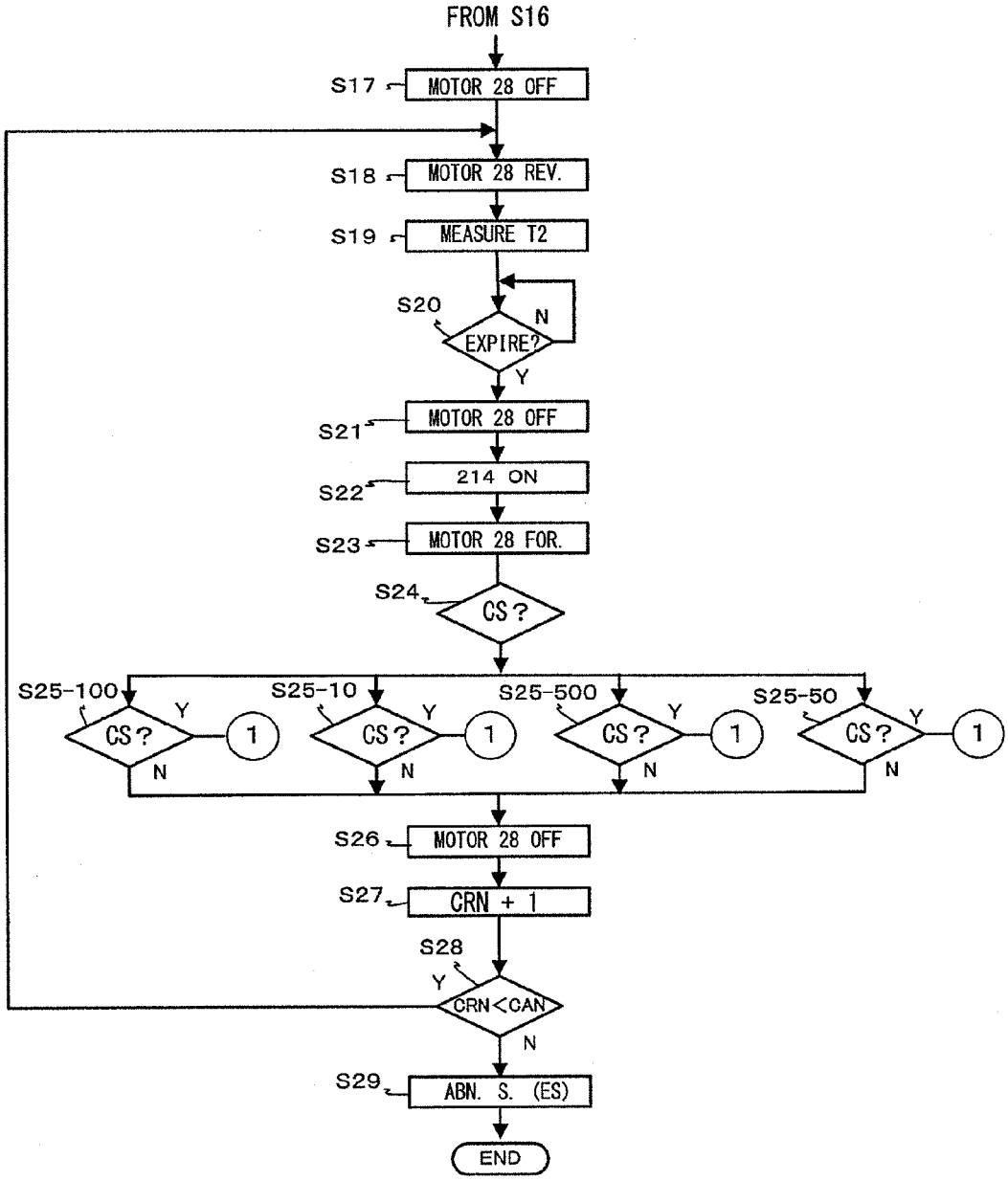
FIG. 18 is a flowchart showing the operation of the control circuit used in the coin dispensing apparatus according to the first embodiment of the present invention, which shows the state where the rotary disks are rotated in the reverse direction.

Next, the operation (i.e., the process performed by the control circuit 112) of the coin dispensing apparatus 10 according to the first embodiment of the present invention will be explained below with reference to the flowcharts shown in FIGS. 17 and 18.

First, in the step S1, it is judged whether the dispensing instruction PO (i.e., the dispensing amount PQ of the coins C) is outputted or not from the control section of the upper system. If the dispensing instruction PO is outputted, the operation flow advances to the step S2, and if the dispensing instruction PO is not outputted, the step S1 is repeatedly carried out so as to make a loop, in other words, the waiting state is continued.

In this first embodiment, it is supposed that the designated dispensing amount PQ is set at 870 yen as an example.

Next, in the step S2, the control circuit 122 calculates the denomination and number of the coins C corresponding to the designated dispensing amount PQ, and outputs them thus calculated. Thereafter, the operation flow advances to the step S3.

In this example where the designated dispensing amount PQ is 870 yen, the calculated number of the 500 yen coin 500 C is one, the calculated number of the 100 yen coin 100 C is three, the calculated number of the 50 yen coin 50 C is one, and the calculated number of the 10 yen coin 10 C is two.

Next, in the step S3, the initial positioning process by reverse rotation is carried out. Then, the operation flow advances to the step S4.

Here, the "initial positioning process by reverse rotation" is a process for surely preventing the state where the coins C dropped into the apertures 136 of the disks 108-10, 108-100, 108-50, and 108-500 are overlaid on the advance/retreat holes 129 through which the guide members 112 are protruded or retracted in the coin dispensing units 22-10, 22-100, 22-50 and 22-500. Concretely speaking, the common electric motor 28 is rotated in the reverse direction to synchronously rotate all the disks 108-10, 108-100, 108-50 and 108-500 until a first detection signal ES is outputted from the photoelectric sensor 127B. When the output of a first detection signal ES is detected, the reverse rotation of the motor 28 is stopped.

Naturally, at the position where each of the disks 108-10, 108-100, 108-50 and 108-500 is stopped after the initial positioning process by reverse rotation is completed, the coins C dropped into the apertures 136 are not overlaid on the advance/retreat holes 129. At this time, the electromagnetic actuator 214 is not magnetized and therefore, the guide member 112 is positioned at the non-guiding positon NGP and the passage blocking member 120 is positioned at the blocking position SP. Accordingly, even if the coins C reach the dispensing opening 110 due to the revere rotation of the disk 108-10, 108-100, 108-50 or 108-500, the coins C cannot pass through the opening 110, which means that the coins C are not dispensed through the coin outlets 48.

Next, in the step S4, it is judged which denomination of the coins C is to be dispensed in accordance with the denomination and number of the coins C calculated in the step S2. Thereafter, the operation flow advances to the step S5 for individually controlling the coin dispensing units 22 which are assigned to the respective denominations.

In each of the steps S5-10, S5-100, S5-50 and S5-500, the electromagnetic actuator 214 of the coin dispensing unit 22 is magnetized according to the judgment result in the previous step S4. Specifically, if the unit 22 deals with the denomination to be dispensed, the electromagnetic actuator 214 of the said unit 22 is magnetized, and if the unit 22 does not deal with the denomination to be dispensed, the electromagnetic actuator 214 of the said unit 22 is not magnetized. Thereafter, the operation flow advances to the step S6.

In this example, since the designated dispensing amount PQ is 870 yen, all the denominations (i.e., 500 yen, 100 yen, 50 yen and 10 yen) need to be dispensed. Therefore, the electromagnets 218 of the actuators 214-500, 214-50, 214-100 and 214-10 of all the coin dispensing units 22-500, 22-50, 22-100 and 22-10 are magnetized and thereafter, the step 6 is carried out. It is needless to say that if at least one of the four denominations (i.e., 500 yen, 100 yen, 50 yen and 10 yen) is not to be dispensed, the electromagnet(s) 218 of the actuator(s) 214 of the unit(s) 22 concerned is/are not magnetized.

Due to magnetization of the electromagnet 218 of the actuator 214 in each of the coin dispensing units 22, the output rod 212 of the actuator 214 is pulled into the body 216 thereof. Then, the position selector 198 is rocked counterclockwise in FIG. 20B by way of the attachment piece 222 engaged with the output rod 212, reaching the dispensing assisting position AP. As a result, the guide member 112 is moved to the guiding position GP and the linking portion 260 presses the driven lever 258 upward. Thus, the rocking lever 257 (the interlocking member 246) is rocked around the third supporting shaft 256, and the U-shaped part 248 presses the retainer portion 238 of the passage blocking member 120 downward. As a result, the top end of the member 120 is retreated into the appearance/disappearance hole 228.

Next, in the step S6, the electric motor 28 is activated in each of the coin dispensing units 22. Thereafter, the operation flow advances to the step S7.

In the step S6, due to the activation of the motor 28, the output shaft 32 of the reducer 30 is rotated at a predetermined speed and as a result, the driving gear 38 and the slit disk 127A of the rotary encoder 127 are rotated at predetermined speeds. Due to rotation of the driving gear 38, the driven spur gear 42S-500 is rotated by way of the idler gear 40-500 which is engaged with the driving gear 38 is rotated, the driven spur gear 42S-50 is rotated by way of the idler gear 40-50 which is engaged with the driven gear 42-500, the driven spur gear 42S-100 is rotated by way of the idler gear 40-100 which is engaged with the driven gear 42-50, and the driven spur gear 42S-10 is rotated by way of the idler gear 40-10 which is engaged with the driven gear 42-100, at the same speed in the same direction.

By the rotations of the driven spur gears 42S-500, 42S-100, 42S-50 and 42S-10, the rotary disks 108-500, 108-100, 108-50 and 108-10 are rotated by way of the input shafts 46-500, 46-100, 46-50 and 46-10, respectively. As a result, the apertures 136 formed in the respective disks 108-500, 108-100, 108-50 and 108-10 are respectively rotated in the forward direction by the same angle.

By the rotations of the disks 108-500, 108-100, 108-50 and 108-10 in the forward direction, the coins C placed in the apertures 136 are then pressed by the pressing members 146 to be moved along the carrying paths MP formed on the base 104. In this way, the 100 yen coins 100 C which are being moved by the first pressing members 146A are guided toward the side of the dispensing opening 110 by the first and second guide member portions 112A and 112B.

Due to the movement of the coins C toward the side of the dispensing opening 110, the coins 100 C will be able to be guided by the coin engaging part 282 of the dispensing opening adjustor 262. During such the time period, the pressing action of the first pressing members 146A to the coins C is maintained. For this reason, the second guide member portion 112B is rocked against the resilience force of the resilience spring 226 to reach the position shown by a broken line in FIG. 20B.

During this process, the 100 yen coins 100 C are further moved along the radial direction of the disk receiving hole 126. In this state, the coins 100 C are moved by only the second pressing members 146B. Finally, the center CC of the coin 100 C exceeds the first line L1 that connects the contact point of the second guide member portion 112B and the periphery of the coin 100 C and the contact point of the coin 100 C and the coin engaging part 282 at the position shown in FIG. 20A. As a result, the coin 100 C that has exceeded the line L1 is vigorously ejected by the resilience force of the spring 226 to the dispensing passage 114.

The 100 yen coin 100 C thus ejected to the dispensing passage 114 is detected by the metal sensor 118. In response, the metal sensor 118 outputs the coin signal CS.

After the coin 100 C is ejected to the dispensing passage 114 in this way, the guide member 112 is rocked until the guide member 112 is engaged with the rocking motion limiter 204 due to the resilience force of the spring 226, returning to the guiding position GP.

In the case where the guide member 112 is kept at the guiding position GP subsequently to this return, the 100 yen coins 100 C are ejected in the same way as described above one by one.

The aforementioned explanation for the step S6 about the 100 yen coins 100 C is applicable to the coins C of 10 yen, 50 yen and 500 yen.

If at least one of the denominations assigned to the coin dispensing units 22-500, 22-50, 22-100 and 22-10 is not to be dispensed, the electromagnet(s) 218 of the actuator(s) 214 of the coin dispensing unit(s) 22 concerned is/are not magnetized. For this reason, in the coin dispensing unit(s) 22 concerned, the guide member 112 is positioned at the non-guiding positon NGP and the passage blocking member 120 is positioned at the blocking position SP. Accordingly, even if the coin C reaches the dispensing opening 110 due to the revere rotation of the disk 108, the coin C cannot pass through the opening 110, which means that the coin C is not dispensed through the coin outlet 48 and kept being moved along the carrying path MP.

In the step S7, the denomination of the coins C to be dispensed is discriminated. Then, the operation flow advances to the step S8.

The following steps S8 to S14 relate to the dispensing processes of the individual coin dispensing units 22-500, 22-50, 22-100 and 22-10, where the coins C are separated and dispensed in the respective units 22. Therefore, the steps S8 to S14 are carried out in parallel in the individual units 22-500, 22-50, 22-100 and 22-10.

To represent the steps S8 to S14 carried out in the respective units 22, a hyphen and the denomination will be attached to the same step number, e.g., S8-100, S8-10, S8-500 and S8-50. In addition, since the content or operation in each of the steps S8 to S14 is the same, the content or operation in the coin dispensing unit 22-100 will be explained below and that of the other units 22-500, 22-50 and 22-10 is omitted for the sake of simplification.

In the step S8-100, measurement of the dispensing judging time T1 is started. Thereafter, the flow advances to the step S9-100.

The "dispensing judging time T1" is a reference time for judging whether it is an abnormal state or not. For example, the abnormal state is the state where the 100 yen coins 100 C supposed to have been dispensed are not detected by the metal sensor 118 through the whole dispensing judging time T1, in other words, none of the coins 100 C are not dispensed to the dispensing passage 114 in spite of the state where the coins 100 C are to be dispensed. The dispensing judging time T1 is usually set at about 3 seconds, for example.

In the step S9-100, it is judged whether the coin signal CS is outputted from the metal sensor 118 or not. If the coin signal CS is outputted from the sensor 118, the flow advances to the step S10-100, and if the coin signal CS is not outputted from the sensor 118, the flow advances to the step S11-100. As explained above, when the sensor 118 detects the coin 100 C and outputs the coin signal CS, the coin dispensing unit 22-100 operates successfully or normally and thus, the flow advances to the next step S10-100 for the normal operation.

In the step S11-100, it is judged whether the dispensing judging time T1 has expired or not. If the dispensing judging time T1 has not expired, the flow is returned to the step S9-100. If the time T1 has expired, the flow advances to the step S15-100. Specifically, since the guide member 112 is located at the guiding position GP in the step S5-100 and the rotary disk 108-100 is rotated in the step S6, the 100 yen coin 100 C is to be dispensed and the coin signal CS is to be outputted from the metal sensor 118 within the dispensing judging time T1 in the step S9-100. However, if the coin signal CS is not outputted even after the dispensing judging time T1 has expired in the step S11-100, it is judged that a coin jam has occurred and then, a request for reverse rotation of the rotary disk 108-100 which is described in the automatic solution subroutine is issued in order to eliminate the coin jam automatically in the step S16-100.

In the step S10-100, the number of the coin signals CS is counted whenever the coin signal CS is outputted. Thereafter, the flow advances to the step S12-100. In the step S10-100, since this is the first time, "1" is counted. In other words, the number of the dispensed coins C is counted as "1".

In the step S12-100, it is judged whether the dispensing number CN of the 100 yen coins 100 C (the counted value in the step S10-100) is equal to the designated dispensing number DN or not, in other words, whether the dispensing number CN of the coins 100 C has reached the designated dispensing number DN or not. If the dispensing number CN has reached the designated dispensing number DN, the flow advances to the step S13-100. If the dispensing number CN has not reached the designated dispensing number DN, the flow returns to the step S9-100. This means that whether the designated predetermined number of the 100 yen coins 100 C was dispensed or not is judged in the step S12-100.

In this embodiment, the designated dispensing number DN is set at 3. Since the dispensing number CN thus counted from the coin signal CS this time is 1, it is judged that the dispensing number CN has not reached the designated dispensing number DN. So, the flow is returned to the step S9-100 and the dispensing action of the 100 yen coins 100 C continues. In the event that the dispensing action of the coins 100 C continues, as explained above, the coins 100 C are ejected by the guide member 112 one by one, and the coin signal CS is outputted from the metal sensor 118-100 at every dispensing action. Therefore, when two more coins 100 C are further dispensed later and the dispensing number CN thus counted reaches 3, the flow advances to the step S13-100.

In the step S13-100, the electromagnetic actuator 214-100 is de-energized. Thereafter, the flow advances to the step S14-100.

In the step S13-100, due to the de-energization of the actuator 214-100, the position selector 225 is moved to the non-dispensing assisting position NAP by the resilience force of the spring 220 and the guide member 112 is moved to the non-guiding position NGP. In conjunction with this movement of the position selector 225, the pressing action of the linking portion 250 to the rocking lever 257 (the interlocking member 246) is eliminated. Thus, the passage blocking member 120 is pushed upward by the biasing force of the spring 252 as the biasing member 250, and the stopper part 232 of the member 120 is protruded from the appearance/disappearance hole 228 to the dispensing passage 114 adjacent to the dispensing opening 110. In this way, the member 120 is located at the blocking position SP.

In this state where the guide member 112 is located at the non-guiding position NGP and the passage blocking member 120 is located at the blocking position SP, even if the rotation of the rotary disk 108-100 continues, there arises no possibility that the coins 100 C moved by the pressing members 146 in conjunction with the rotation of the disk 108-100 are guided toward the dispensing opening 110 by the guide member 112. Even if, by any chance, one of the coins 100 C thus moved reaches the dispensing opening 110, this coin 100 C is prevented from being moved furthermore by the passage blocking member 120 located at the blocking position SP. Therefore, the coin 100 C is unable to be moved to the dispensing passage 114. In this case, the coins 100 C are merely circulated along the carrying path MP.

In the step S14-100, a dispensing completion signal FS100 is outputted. Thereafter, the flow advances to the step S31.

On the other hand, after it is judged that the dispensing judging time T1 has expired in the step S11-100, the step S15-100 is carried out, wherein the electromagnet 218 of the electromagnetic actuator 214-100 is de-magnetized. Thereafter, the flow advances to the step S16-100.

In the step S15-100, due to de-magnetization of the electromagnet 218, as explained previously, the guide member 112 is located at the non-guiding position NGP and the dispensing judging 120 is located at the blocking position SP, thereby preventing the coins 100 C from being dispensed. Subsequently, in the next step S16-100, a request for reverse rotation of the rotary disk 108-100 is issued to eliminate a coin jam automatically. Thereafter, the coin jam eliminating process in the step S17 and later will be performed.

The aforementioned coin dispensing process from the step S8-100 to the step S16-100 in the coin dispensing unit 22-100 is carried out in the coin dispensing units 22-500, 22-50 and 22-10 also. In this way, the calculated denominations and numbers of the 500 yen coins 500 C, the 50 yen coins 50 C and the 10 yen coins 10 C corresponding to the designated dispensing amount PQ of 870 yen are dispensed.

Specifically, in this first embodiment, in the same way as described for the coin dispensing unit 22-100, one 500 yen coin 500 C is dispensed from the coin dispensing unit 22-500 and then, a dispensing completion signal FS 500 is outputted. Similarly, one 50 yen coin 50 C is dispensed from the coin dispensing unit 22-50 and then, a dispensing completion signal FS 50 is outputted. Two 10 yen coins 10 C are dispensed from the coin dispensing unit 22-10 and then, a dispensing completion signal FS10 is outputted.

These coins 100 C, 10 C, 500 C and 50 C thus dispensed are dropped on the conveying belt 16 and conveyed to the reception tray 12 by the belt 16, as shown in FIG. 1.

Subsequently, in the next steps S31, it is judged whether all the dispensing completion signals FS100, FS10, FS500 and FS50 are outputted or not. If all the dispensing completion signals FS100, FS10, FS500 and FS50 are outputted, the flow advances to the step S32. If all the dispensing completion signals FS100, FS10, FS500 and FS50 are not outputted, the step S31 is repeatedly carried out so as to make a loop, in other words, the waiting state is continued.

In the step S32, it is judged whether the angular position signal APS which is suitable to halt of the rotary disks 108 has been outputted or not from the rotary encoder 127. If such the signal APS has been outputted, the operation flow advances to the step S11, and if such the signal APS has not been outputted, the step S32 is repeated. This is to detect the timing of halting the supply of electric power to the electric motor 28 in such a way that the rotary disks 108 do not stop in the state where the respective coins 10 C, 100 C, 50 C and 500 C are respectively opposed to the guide members 112 in the coin dispensing units 22-10, 22-100, 22-50 and 22-500.

In the step S33, the supply of electric power to the electric motor 28 is stopped and thereafter, the coin dispensing operation is finished. Since the supply of electric power to the motor 28 is stopped, the rotation of the rotary disks 108-10, 108-100, 108-50 and 108-500 will stop synchronously after some rotation(s) caused by inertia. Since the timing of stopping the electric power supply is adjusted in such a way that all the coins 10 C, 100 C, 50 C and 500 C are not overlaid on the corresponding advance/retreat holes 129, there arises no inconvenience for a next dispensing operation.

Accordingly, the initial positioning process by reverse rotation in the step S3 may be omitted; however, in the case where the dispensing operation is not carried out for a long time, there is a possibility that at least one of the disks 108 is rotated by an external force so that the coin C is overlaid on a corresponding one of the advance/retreat holes 129. Therefore, it is preferred to perform this initial positioning process.

Next, the reverse rotation process of the rotary disks 108 for automatic elimination of a coin jam in the step S17 and later will be explained below with reference to FIG. 18.

First, in the step S17, the supply of electric power to the electric motor 28 is stopped. Because of stopping the electric power supply, the rotation of all the disks 108 is stopped, thereby preventing the dispensing operation of the coins C. Subsequently, the operation flow advances to the step S18.

In the step S18, all the disks 108 are rotated in the reverse direction by way of the transmission device 26 due to the reverse rotation of the motor 28. Thus, all the coins C are also moved in the reverse direction along the carrying path MP because these coins C are pressed by the back faces 151A and 151B of the first and second pressing members 146A and 146B. In this step, the guide members 112 are located at the non-guiding positions NGP and therefore, the coins C are moved in the reverse direction without any inconvenience and/or any problem. Subsequently, the flow advances to the step S19.

In the step S19, measurement of the reverse rotation time T2 is started. The "reverse rotation time T2" determines the rough amount of the reverse rotation of the disks 108. It is sufficient for the disks 108 to be reverse rotated by at least about 30 degrees. However, it is preferred that the disks 108 are designed to be reverse-rotated by approximately one turn. Thereafter, the flow advances to the step S20.

In the step S20, it is judged whether the reverse rotation time T2 has reached or not the "standard reverse rotation time ST2" which is determined in advance. If the reverse rotation time T2 has reached the standard reverse rotation time ST2, the flow advances to the step S21. If the reverse rotation time T2 has not reached the standard reverse rotation time ST2, the step S20 is repeated so as to form a loop. For this reason, the disks 108 are reverse-rotated during the standard reverse rotation time ST2.

In the step S21, the reverse rotation of the motor 28 is stopped. Because of stopping the supply of electric power to the motor 28, the reverse rotation of all the disks 108 will stop after some rotation(s) caused by inertia. Thereafter, the flow advances to the step S22.

In the step S22, all the electromagnets 218 of the electromagnetic actuators 214 are magnetized. Due to magnetization of the electromagnets 218, all the position selectors 198 are rocked counterclockwise in FIG. 19B to reach the dispensing assisting positions AP. Therefore, the guide members 112 are moved to the guiding positions AP, and the stopper parts 232 of the passage blocking members 120 are pulled into the appearance/disappearance holes 228 and retracted from the dispensing passages 114 to reach the non-blocking positions NSP by the linking portions 260. Thus, the coin dispensing operations are enabled in all the coin dispensing units 22. Thereafter, the flow advances to the step S23.

In the step S23, the motor 28 is rotated in the forward direction. Due to the forward rotation of the motor 28, all the disks 108 are rotated in the forward direction by way of the transmission device 26. This is to verify whether or not the coin jam has been eliminated by the first-time reverse rotation of the disks 108. Thereafter, the flow advances to the step S24.

In the step S24, it is judged whether or not the coin signal CS is outputted from any one of the coin sensors 118 of the coin dispensing units 22 in the dispensing judging time T1. If the coin signal CS is outputted, the flow advances to the steps S25-500, S25-50, S25-100 and S25-10. If the coin signals CS are not outputted, the step S24 is repeatedly carried out so as to make a loop. This is because it can be supposed that the disk 108 is rotated normally if the coin signal CS is outputted.

In the steps S25-500, S25-50, S25-100 and S25-10, it is judged whether or not the coin signal CS is outputted from the coin sensor 118 in the dispensing judging time T1 in the coin dispensing unit(s) 22 in which the coin signal CS has not been outputted in the step S24. If the coin signal CS is outputted in the step S25-500, S25-50, S25-100 or S25-10, the flow returns to the step S7. This is because it is presumed that the disk 108 in the corresponding unit 22 is being rotated normally. In this case, forward the rotation of the motor 28 is continued and the undispensed number of the coins C will be dispensed.

If the coin signal CS is not outputted in the steps S25-500, S25-50, S25-100 and S25-10, the flow advances to the step S26. This is because it is presumed that all the disks 108 are not being rotated normally.

In the step S26, the rotation of the motor 28 is stopped. Due to the stop of the motor 28, the dispensing operation of the coins C is stopped. Thereafter, the flow advances to the step S27.

In the step S27, the reverse rotation number CRN is counted. In this step, the reverse rotation number CRN is incremented by "1" whenever the reverse rotation is performed once. Since this is the first-time reverse rotation, "1" is added to the value of the reverse rotation number CRN and stored. Thereafter, the flow advances to the step S28.

In the step S28, the reverse rotation number CRN is compared with the reverse rotation acceptable number CAN. If the reverse rotation number CRN is equal to or less than the reverse rotation acceptable number CAN, the flow is returned to the step S18. If the reverse rotation number CRN is greater than the reverse rotation acceptable number CAN, the flow advances to the step S29.

In this embodiment, the reverse rotation acceptable number CAN is set at 3. Since this is the first-time reverse rotation, the reverse rotation number CRN is 1 and less than the value 3 of CAN. Thus, the flow is returned to the step S18.

In the case where the flow is returned to the step S18, the reverse rotation process from the step S18 to the step S28 is carried out again. Then, in the step S27, the reverse rotation number CRN is incremented by 1 to have the value of 2. Since this is the second-time reverse rotation, it is judged that reverse rotation number CRN of 2 is less than the value 3 of CAN. Thus, the flow is returned to the step S18 again and the coins C are dispensed again.

In this way, the coin dispensing process and the reverse rotation process are carried out 4 times in total and thereafter, the flow advances to the step S29. In the step S29, an abnormal state signal ES is outputted to the upper system and then, the coin dispensing operation is finished.

With the coin dispensing apparatus 10 according to the first embodiment of the present invention, since the aforementioned structure is provided, the rotary disks 108 of the four coin dispensing units 22 are simultaneously rotated or stopped by the common driving device 20 by way of the transmitting device 26. Due to the rotation of the disks 108, the coins C are dropped in the apertures 136 of the respective disks 108 and then, sent to the coin outlets 48 in the respective coin dispensing units 22.

The passage blocking member 120 is provided in the dispensing opening 110 of each of the coin dispensing units 22 in such a way as to be selectively positioned at the non-blocking position NSP or the blocking position SP while simultaneously rotating the disks 108 of the four coin dispensing units 22. Thus, if the coins C need to be dispensed from one of the coin dispensing units 22, the passage blocking member 120 of the corresponding coin dispensing unit 22 is positioned at the non-blocking position NSP, allowing the coins C to pass through the dispensing passage 110. On the other hand, if the coins C need not to be dispensed from the corresponding coin dispensing unit 22, the passage blocking member 120 of the corresponding unit 22 is positioned at the blocking position SP, preventing the coins C from passing through the dispensing passage 110.

When the guide member 112 provided in the carrying path MP is located at the guiding position GP, the passage blocking member 120 is located at the non-blocking position NSP, and when the guide member 112 is located at the non-guiding position NGP, the passage blocking member 120 is located at the blocking position SP. Therefore, even if the coins C are not naturally moved to the dispensing passage 110, the coins C can be surely guided and sent to the dispensing passage 110 by the guide member 112. On the other hand, when the coins C need not to be dispensed, the passage blocking member 120 is located at the blocking position SP and the guide member 112 is located at the non-guiding position NGP. As a result, the movement of the coins C toward the dispensing passage 110 can be surely prevented by the passage blocking member 120, thereby avoiding false dispensing of the coins C.

Moreover, since the rotary disks 108 of all the coin dispensing units 22 are simultaneously rotated or stopped by the common driving device 20 by way of the transmitting device 26, the rotation of the disks 108 are kept until the coins C of the necessary denominations are completely dispensed by prescribed numbers by the coin dispensing units 22. This means that the dispensing operations of the coins C in the respective units 22 are carried out in parallel.

Therefore, the dispensing operations of all the coin dispensing units can be completed within a shorter time than the case where the dispensing operations of all the coin dispensing units 22 are carried out in series.

Furthermore, since it is sufficient for the rotation of the rotary disks 108 of the coin dispensing units 22 to provide the common driving device 20 and the transmitting device 26, the fabrication cost of the coin dispensing apparatus 10 can be lowered.

Accordingly, the coin dispensing apparatus 10 according to the first embodiment of the present invention is capable of dispensing the coins C of a plurality of denominations surely and more quickly compared with the aforementioned prior-art apparatuses and capable of being fabricated at a low cost.

In addition, the four coin dispensing units 22 are aligned closely along the conveying belt 16, and the rotary disks 108 of all the coin dispensing units 22 are driven by the common electric motor 28 by way of the transmission device 26. Therefore, the coin dispensing apparatus 10 according to the first embodiment is easy to be downsized.

Moreover, all the coin dispensing units 22 and the common electric motor 28 are mounted on the intermediate base 36, and the transmission device 26 is placed in the space existing below the intermediate base 36. Therefore, inspection and maintenance activities of the coin dispensing apparatus 10 according to the first embodiment are easy to be done.

Second Embodiment

Next, a coin dispensing apparatus 10A according to the second embodiment of the present invention will be explained below with reference to FIGS. 22 to 28.

In the aforementioned coin dispensing apparatus 10 according to the first embodiment, the transmission device 26 is configured by a series of spur gears. Unlike this, in the coin dispensing apparatus 10A according to the second embodiment, a transmission device 26A is configured by using bevel gears.

In the case where bevel gears are used, the diameter of each gear can be set smaller than the case where spur gears are used. Therefore, the gears used for the transmission device 26A can be downsized and as a result, there is an additional advantage that the coin dispensing apparatus 10A can be decreased in size compared with the coin dispensing apparatus 10 of the aforementioned first embodiment.

In addition, the rotary disks 108 are mounted horizontally in the coin dispensing apparatus 10A of the second embodiment, which is unlike the coin dispensing apparatus 10 of the first embodiment where the disks 108 are mounted obliquely. However, the overall configuration and operation of the apparatus 10A of the second embodiment is substantially the same as those of the apparatus 10 of the first embodiment other than the attitude of the disks 108 and the configuration of the transmission device 26A.

Accordingly, explanation about the same configuration and operation is omitted here by attaching the same reference numerals to the same or corresponding parts or elements as used in the first embodiment. Explanation about the different configuration will be given below.

Figure 22:
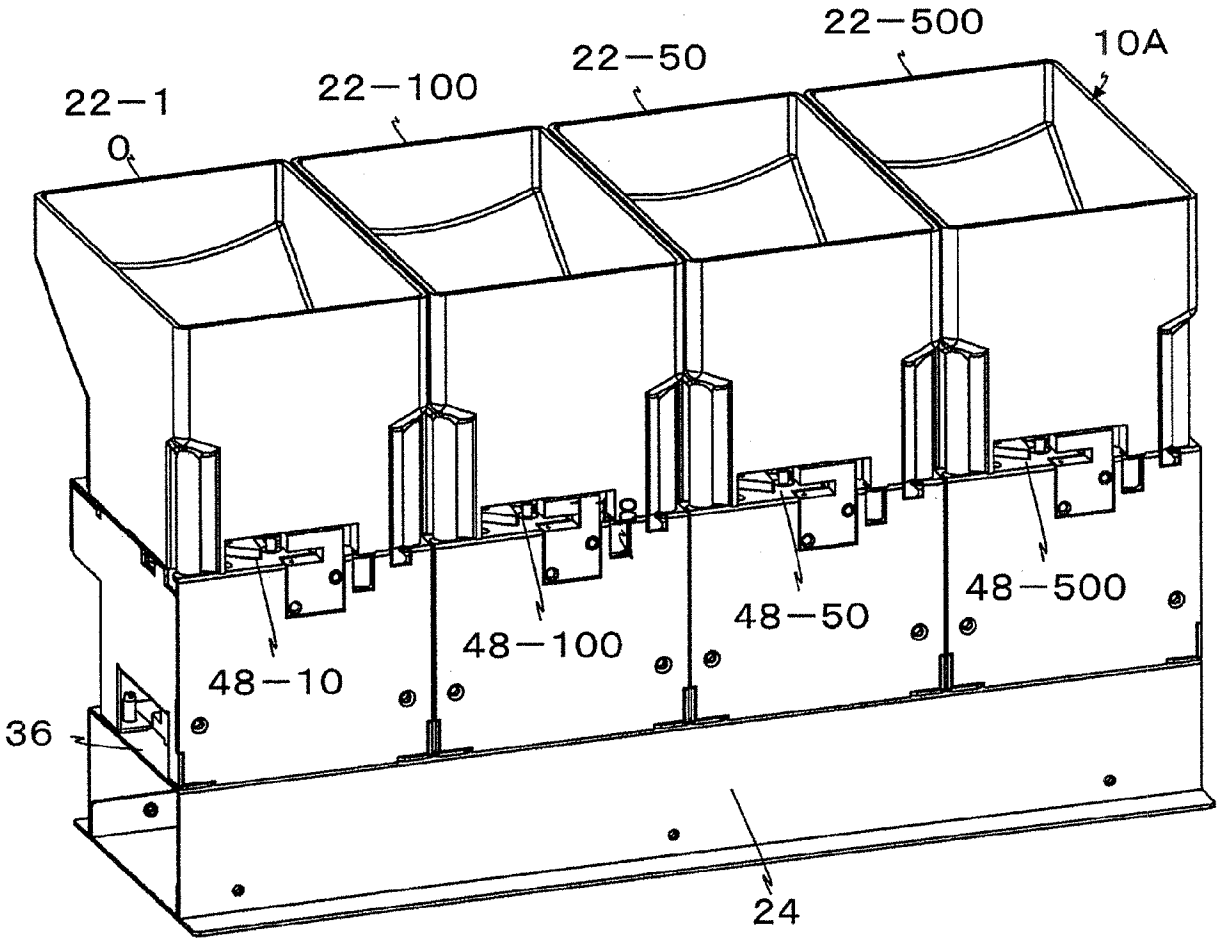
FIG. 22 is a perspective view of the coin dispensing apparatus according to the second embodiment of the present invention, which is seen from the front upper side.
Figure 23:
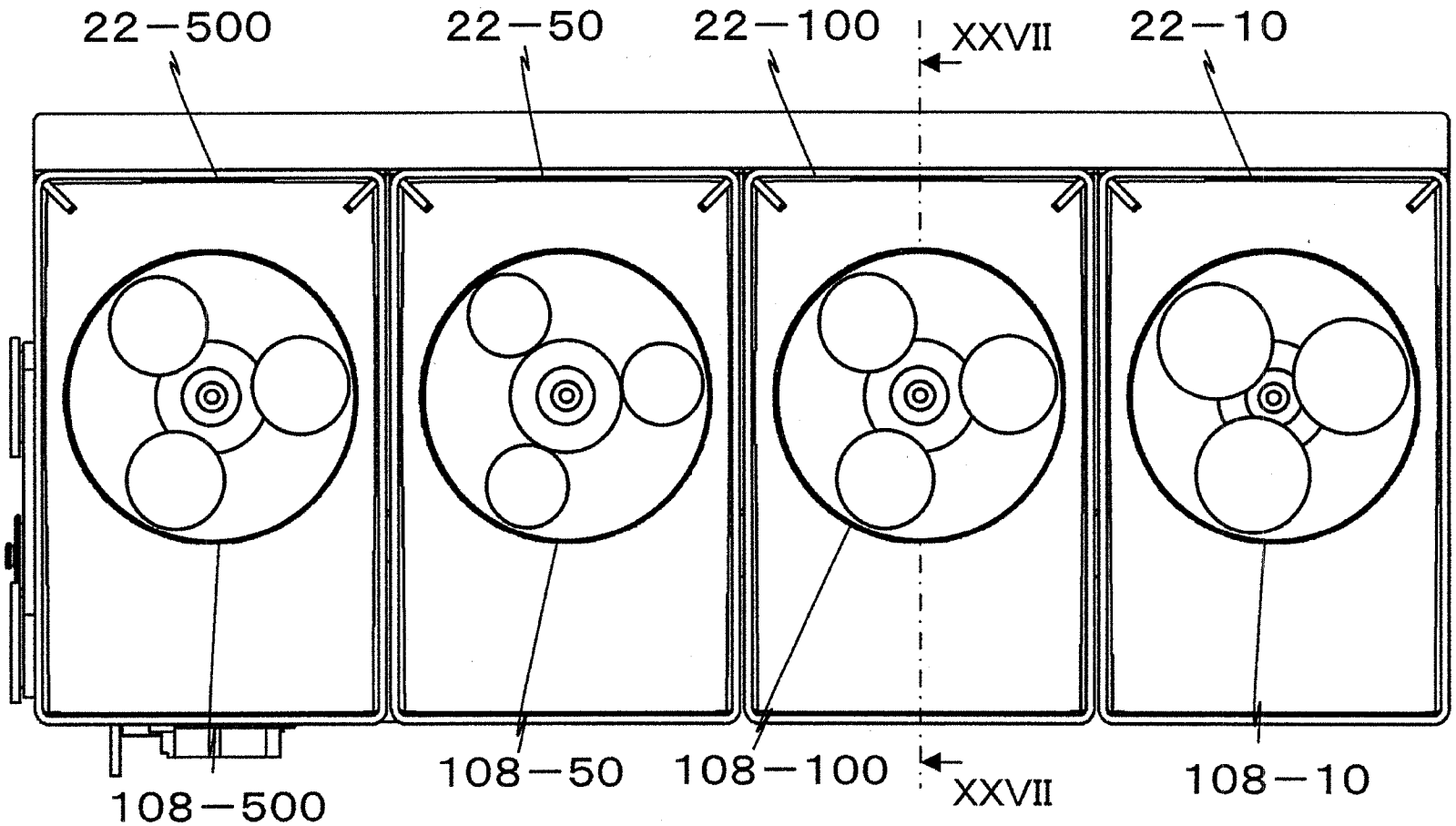
FIG. 23 is a plan view of the coin dispensing apparatus according to the second embodiment of the present invention.
Figure 24:
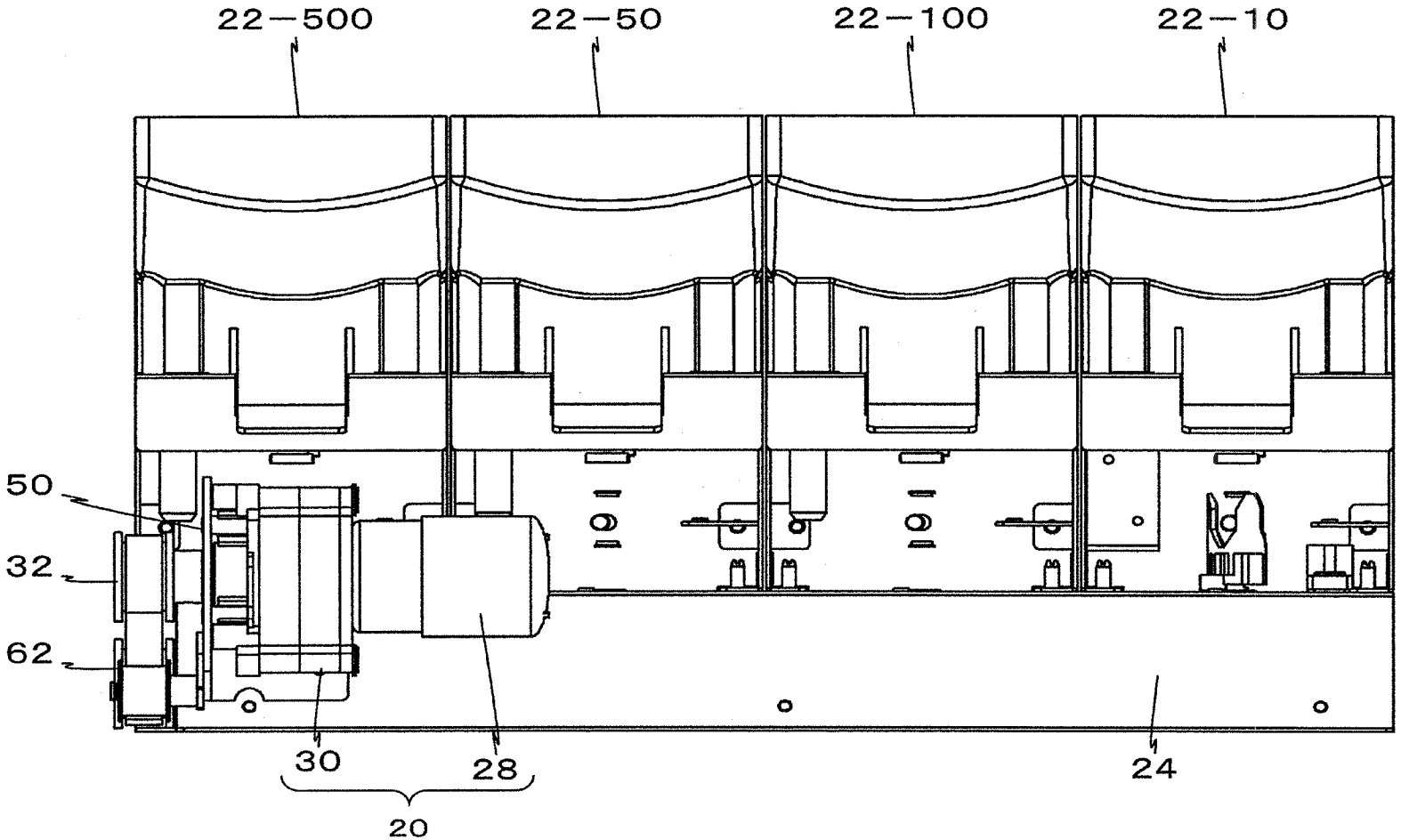
FIG. 24 is a rear view of the coin dispensing apparatus according to the second embodiment of the present invention.
Figure 27:
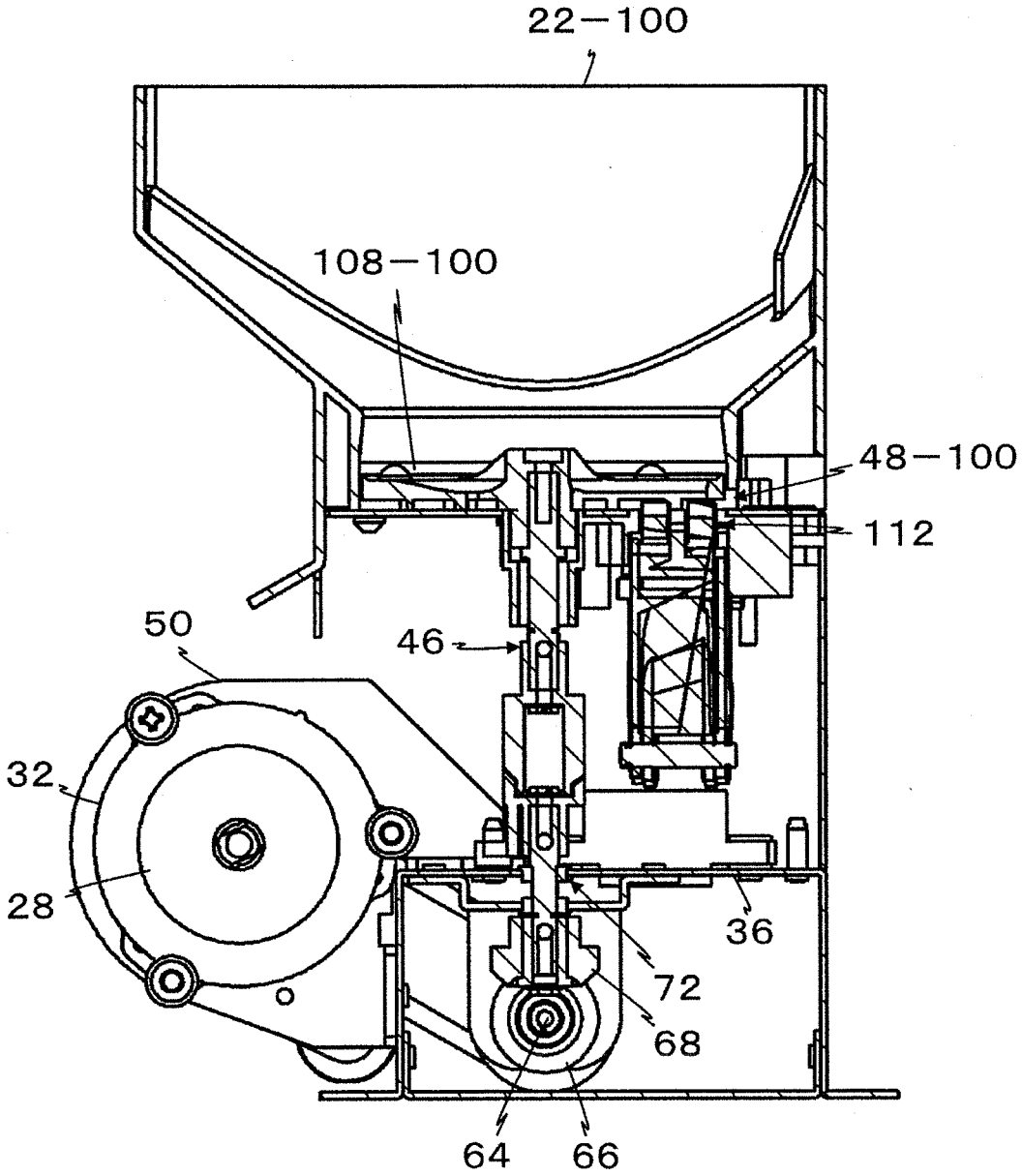
FIG. 27 is a cross-sectional view along the line XXVII-XXVII in FIG. 23.

In the coin dispensing apparatus 10A of the second embodiment, the speed reducer 30 is fixed laterally on a plate-shaped bracket 50 that protrudes backward from the chassis 24, as shown in FIGS. 24 and 27. The four coin dispensing units 22 (22-10, 22-100, 22-50 and 22-500) are arranged closely along the straight line on the chassis 24 in this order, as shown in FIG. 22. In this way, the common electric motor 28 also, which is fixed on the speed reducer 30, is placed laterally, as shown in FIG. 27. The output shaft 32 of the reducer 30 penetrates through the bracket 50, protruding laterally.

Next, the transmission device 26A will be explained below. The transmission device 26A in the second embodiment has the same function as that of the transmission device 26 in the first embodiment and comprises at least a common driving shaft transmission device 52 shown in FIG. 26 and a coin dispensing unit driving device 54 shown in FIG. 25.

First, the common driving shaft transmission device 52 will be explained below first with reference to FIG. 26.

Figure 26:
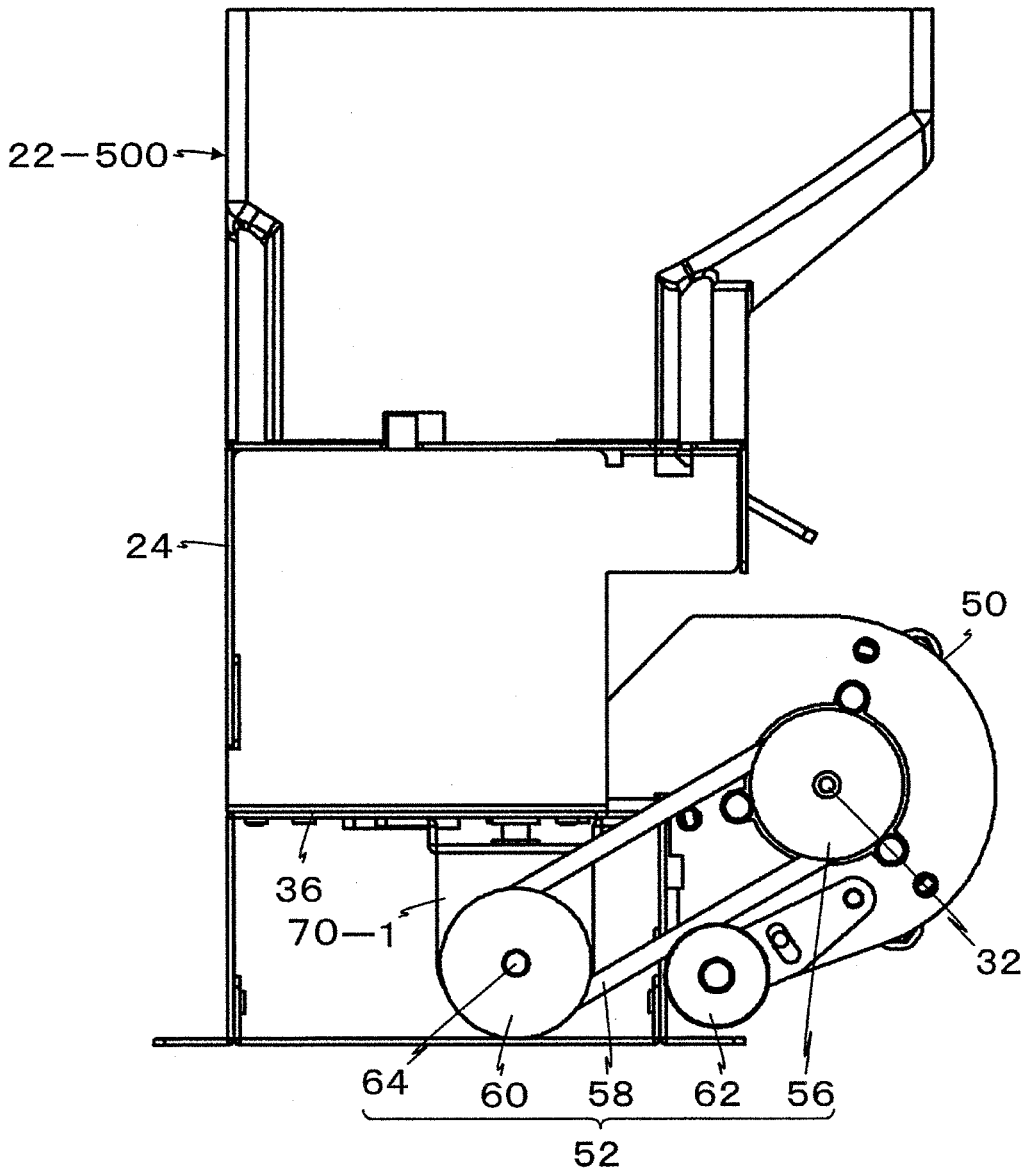
FIG. 26 is a right side view of the coin dispensing apparatus according to the second embodiment of the present invention.

As shown in FIG. 26, the common driving shaft transmission device 52 has the function of transmitting the rotation of the output shaft 32 of the reducer 30 to the coin dispensing unit driving device 54. In this second embodiment, the device 52 comprises a driving pulley 56, a driving belt 58, a driven pulley 60 and a tension roller 62.

The driving pulley 56 is fixed onto the top end of the reducer output shaft 32. The driven pulley 60 is fixed to one end of a common driving shaft 64. The common driving shaft 64 constitutes a part of the coin dispensing unit driving device 54 and will be described later. The driving belt 58 is stretched between the driving pulley 56 and the driven pulley 60. The tension roller 62 is mounted to apply a pressing force to the driving belt 58 in order to maintain a predetermined tension.

Figure 25:
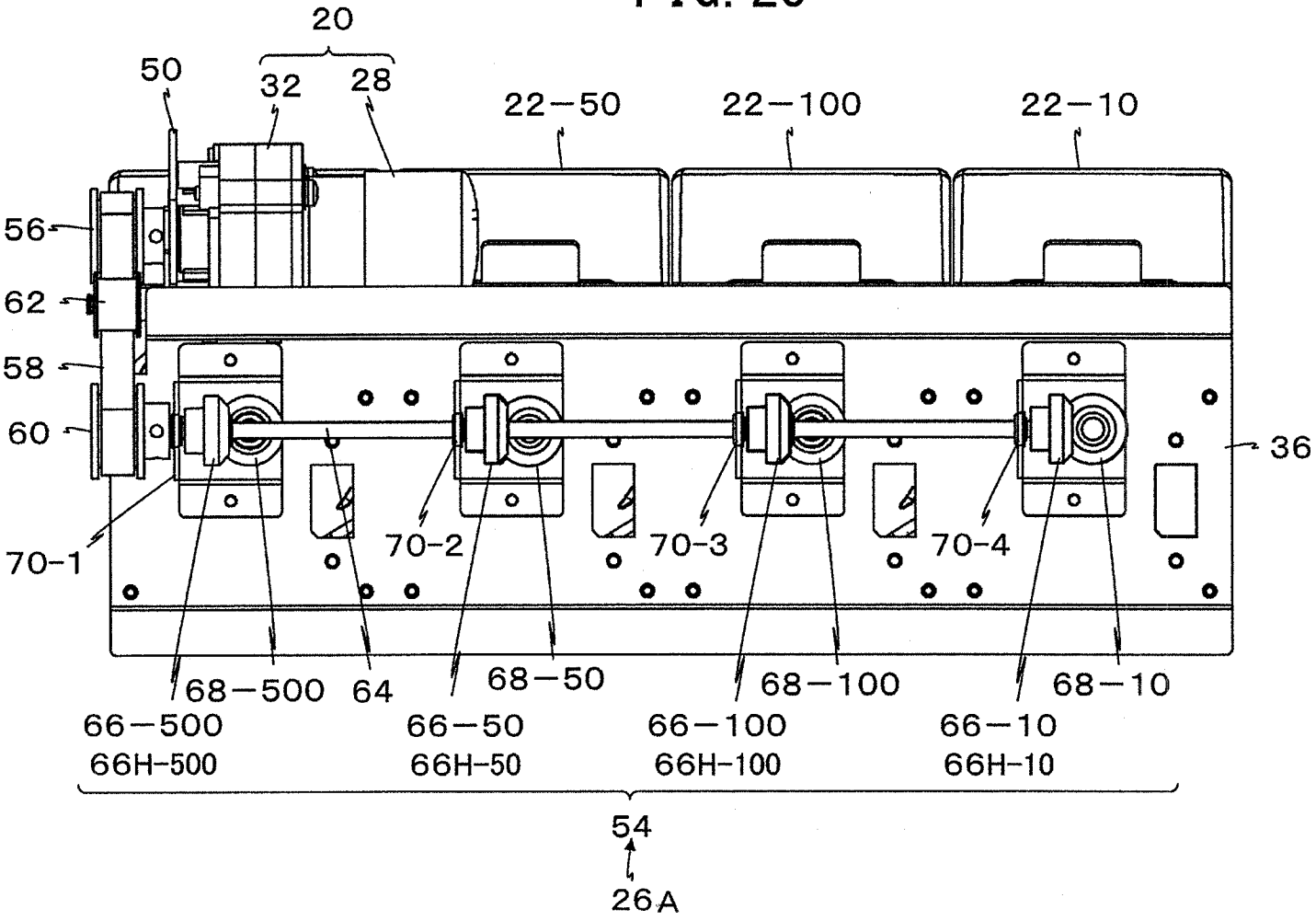
FIG. 25 is a bottom view of the coin dispensing apparatus according to the second embodiment of the present invention.

Therefore, the common driving shaft 64 is driven by the driving device 20 (i.e., the electric motor 28 and the speed reducer 30) by way of the common driving shaft transmission device 52. Since the common driving shaft transmission device 52 is provided between the common driving shaft 64 and the driving device 20, the driving device 20 can be placed in parallel to the arrangement line of the four coin dispensing units 22, as shown in FIGS. 24 and 25. This leads to an advantage that the length of the arrangement line of the units 22 can be shortened. If the length of the arrangement line of the units 22 is not taken into consideration, it is possible to omit the common driving shaft transmission device 52 and to directly drive the common driving shaft 64 by the reducer output shaft 32.

Next, the coin dispensing unit driving device 54 will be explained below with reference to FIG. 25.

As shown in FIG. 25, the coin dispensing unit driving device 54 has the function of transmitting the driving force of the driving device 20 to the input shafts 46 (46-10, 46-100, 46-50 and 46-500) of the coin dispensing units 22 (22-10, 22-100, 22-50 and 22-500). Here, the device 54 comprises the aforementioned common driving shaft 64, four driving bevel gears 66-10, 66-100, 66-50 and 66-500, and four driven bevel gears 68-10, 68-100, 68-50 and 68-500.

The common driving shaft 64 has a function of rotating the driving bevel gears 66-10, 66-100, 66-50 and 66-500. Here, the common driving shaft 64 is rotatably supported by four bearings 70-1, 70-2, 70-3 and 70-4 so as to be parallel to the intermediate base 36. These bearings 70-1, 70-2, 70-3 and 70-4 are arranged at predetermined intervals along the arrangement line of the coin dispensing units 22 and fixed in a downward direction to the back side of the intermediate base 36. Therefore, the common driving shaft 64 is parallel to the arrangement line of the units 22.

The driving bevel gears 66 (66-10, 66-100, 66-50 and 66-500) have a function of rotating the driven bevel gears 68 (68-10, 68-100, 68-50 and 68-500). These driving bevel gears 66 are fixed to the common driving shaft 64 so as to be concentric with the same in the vicinity of the bearings 70-1, 70-2, 70-3 and 70-4. Here, spiral bevel gears 66H-10, 66H-100, 66H-50 and 66H-500 are respectively used as the bevel gears 66-10, 66-100, 66-50 and 66-500. The reason why spiral bevel gears are selected here is that spiral bevel gears, which may be termed "Hypoid gears" (registered trademark), are engaged with each other in such a way that a plurality of teeth of one spiral bevel gear are simultaneously meshed with a plurality of teeth of the other, thereby dispersing the force applied to each tooth. This leads to an advantage that endurance and silence are excellent.

The driven bevel gears 68 are respectively driven by the driving bevel gears 66 and has a function of driving the coin dispensing units 22, in other words, a function of rotating the rotary disks 108 thereof. Here, the driven bevel gears 68 are fixed to the lower ends of the input shafts 46 and are respectively engaged with the driving bevel gears 66. Here, spiral bevel gears 6811-10, 68H-100, 6811-50 and 68H-500 are respectively used as the bevel gears 68-10, 68-100, 68-50 and 68-500.

In this second embodiment, the driving bevel gears 66 and the driven bevel gears 68 are the same in structure, material and size. This is to reduce the fabrication cost due to mass production effects of parts and to prevent false assembling.

Figure 28:
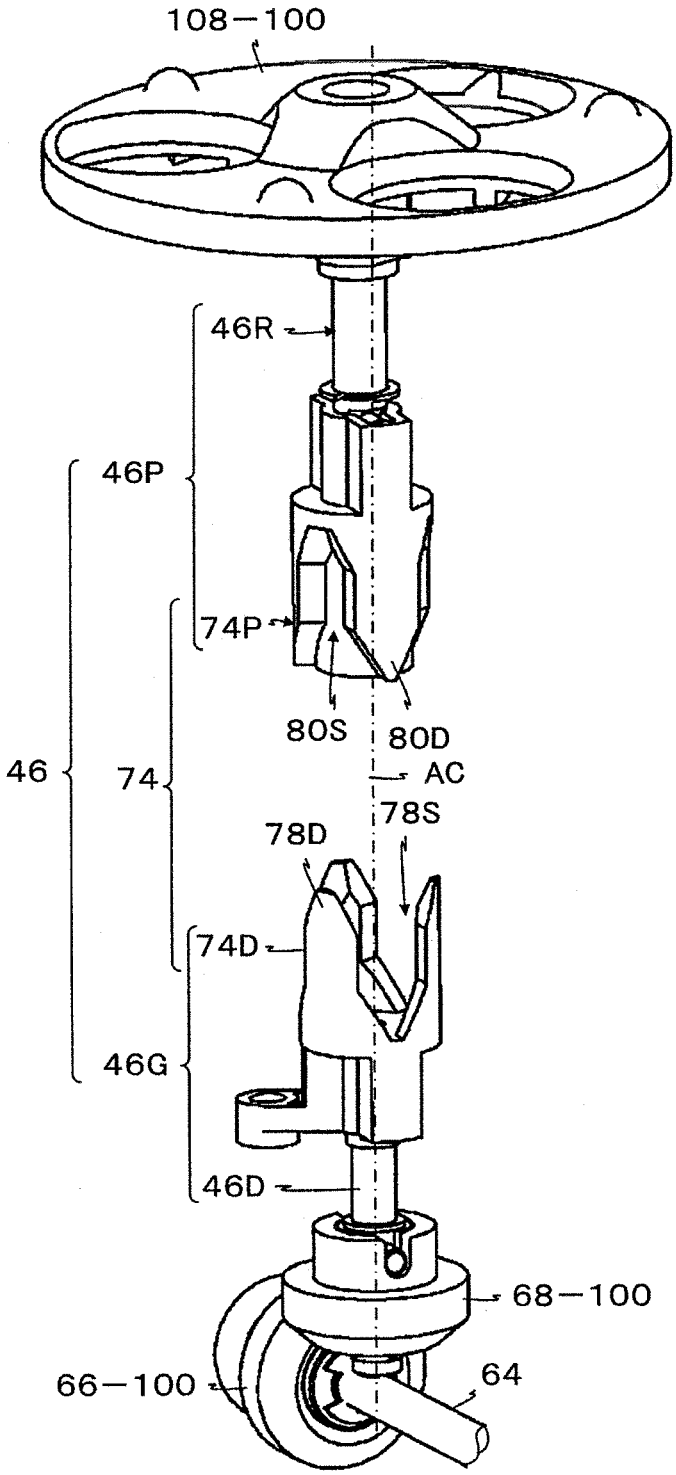
FIG. 28 is a partially enlarged perspective view showing the transmitting device of the coin dispensing apparatus according to the second embodiment of the present invention.

In this second embodiment, as shown in FIG. 28, each of the input shafts 46 (46-10, 46-100, 46-50 and 46-500) is formed by a driven-side part 46P and a driving-side part 46G. The driving-side parts 46G are commonalized. This is to reduce the fabrication cost due to commonalization of the parts for the chassis 24 and to facilitate the fabrication processes.

First, the driving-side part 46G will be explained below.

As shown in FIG. 28, the driving-side part 46G is formed by a driving-side input shaft part 46D and a driving-side clutch part 74D. The driven bevel gear 68 (68-100) is fixed to the lower end of the driving-side input shaft part 46D, and the driving-side clutch part 74D is fixed to the upper end of the input shaft part 46D. The intermediate part of the input shaft part 46D is rotatably supported by an input bearing 72 fixed to the intermediate base 36, as shown in FIG. 27. The input shaft part 46D is extended along the vertical direction with respect to the intermediate base 36. The upper end of the input shaft part 46D, which is a disk-side end of the driving-side part 46G, is directed toward the rotary disk 108 (108-100). The driving-side clutch part 74D that constitutes a part of an engaging clutch 74 is located at the upper end of the input shaft part 46D.

The driving-side clutch part 74D comprises pen tip-shaped protrusions 78D and pen tip-shaped voids 78S. The clutch part 74D needs to have at least one combination of the protrusion 78D and the void 78S. The protrusions 78D and the voids 78S are formed by forming arrow-shaped notches along the axial line AC in the driving-side cylindrical member which is fixed onto the upper end of the input shaft part 46D.

Next, the driven-side part 46P will be explained below.

As shown in FIG. 28, the driven-side part 46P is formed by a disk-side input shaft part 46R and a driven-side clutch part 74P. The rotary disk 108 (108-100) is fixed to the upper end of the disk-side input shaft part 46R, and the driven-side clutch part 74P is fixed to the lower end of the input shaft part 46R. The driven-side clutch part 74P has the same shape as that of the driving-side clutch part 74D. Specifically, the driven-side clutch part 74P comprises pen tip-shaped protrusions 80D and pen tip-shaped voids 80S. The number of the combinations of the protrusion 80D and the void 80S is the same as that of the protrusion 78D and the void 78S.

In this second embodiment, the driving-side clutch part 74D has three pairs of the pen tip-shaped protrusions 78D and the pen tip-shaped voids 78S, and the driven-side clutch part 74P also has three pairs of the pen tip-shaped protrusions 80D and the pen tip-shaped voids 80S. The protrusions 78D of the driving-side clutch part 74D are fitted into the corresponding voids 80S of the driven-side clutch part 74P, and the protrusions 80D of the driven-side clutch part 74P are fitted into the corresponding voids 78S of the driving-side clutch part 74D.

Accordingly, when the coin dispensing units 22-10, 22-100, 22-50 and 22-500 are attached to the chassis 24, by inserting the pen tip-shaped protrusions 80D of the driven-side clutch part 74P into the corresponding pen tip-shaped voids 78S of the driving-side clutch part 74D, the driven-side clutch part 74P (which is relatively smaller in rotational resistance than the driving-side clutch part 74D) is pressed and turned by the protrusions 80D to result in an engaged connection between the clutch parts 74D and 74P. In this state, due to rotation of the common driving shaft 64, the rotary disks 108 of the four coin dispensing units 22 are synchronously rotated by way of the clutches 74.

In this way, the rotation of the reducer output shaft 32 as the output shaft of the driving device 20 is transmitted to the common driving shaft 64 by way of the driving pulley 56, the driving belt 58, and the driven-pulley 60, as shown in FIG. 26. Due to the rotation of the common driving shaft 64, the driving bevel gears 66 (66-10, 66-100, 66-50 and 66-500) are rotated and then, the driven bevel gears 68 (68-10, 68-100, 68-50 and 68-500) which are engaged with the driving bevel gears 66 are rotated. The rotation of the driven bevel gears 68 are transmitted to the rotary disks 108 (108-10, 108-100, 108-50 and 108-500) of the coin dispensing units 22 (22-10, 22-100, 22-50 and 22-500) by way of the driving-side input shaft parts 46D, the driving-side clutch parts 74D, the driven-side clutch parts 74P which are engaged with the clutch parts 74D, and the driven-side part 46P.

The coins C are dispensed by the rotation of the disks 108 (108-10, 108-100, 108-50 and 108-500) in the same way as that of the aforementioned first embodiment.

Since the operations of the other structural elements, such as the guide member 112, the passage blocking member 120, and the control circuit 122, in the coin dispensing apparatus 10A according to the second embodiment are the same as those of the coin dispensing apparatus 10 according to the first embodiment, explanation about these elements are omitted here.

With the coin dispensing apparatus 10A according to the second embodiment of the present invention, the structure and operation are substantially the same as those of the coin dispensing apparatus 10 according to the first embodiment except for the transmission device 26A and the attitude of the rotary disks 108. Therefore, it is apparent that the same advantages as those of the apparatus 10 according to the first embodiment are obtained.

Moreover, the coin dispensing apparatus 10A of the second embodiment has an additional advantage that the apparatus 10A can be decreased in size compared with the apparatus 10 of the first embodiment, because the bevel gears are used for the transmission device 26A.

Other Embodiments

It is needless to say that the present invention is not limited to the above-described embodiments and their variations. Any other modification is applicable to these embodiments and variations.

For example, with the above-described first and second embodiments of the present invention and their variations, the guide member and the passage blocking member are bar-shaped. However, the present invention is not limited to this. The guide member and the passage blocking member may have any other shape as long as their necessary functions are realized.

Moreover, the structure of the transmission device is not limited to the aforementioned embodiments and their variations. Any other type of gears and/or pulleys and belts may be used for this purpose.

While the preferred forms of the present invention have been described, it is to be understood that modifications will be apparent to those skilled in the art without departing from the spirit of the invention. The scope of the present invention, therefore, is to be determined solely by the following claims.

What is claimed is:

1. A coin dispensing apparatus comprising: a plurality of coin dispensing units each including a rotary disk having apertures for receiving coins which are supplied from a coin source;

a circular carrying path, formed in each of the coin dispensing units, along which the coins received in the apertures are moved in conjunction with rotation of the disk;

a dispensing opening, formed in each of the coin dispensing units, through which the coins are moved from the carrying path toward a coin outlet; a common driving device for commonly rotating the disks of the coin dispensing units; a transmission device for transmitting a driving force of the driving device to the disks of the coin dispensing units;

a passage blocking member formed in a dispensing opening of each of the coin dispensing units, wherein the passage blocking member is movable between a non-blocking position where the coins are able to pass through the dispensing opening and a blocking position where the coins are unable to pass through the dispensing opening;

a guide member movable between a guiding position where the guide member is protruded from the carrying path and a non-guiding position where the guide member is retracted from the carrying path; and an interlocking device including an electrical actuator for interlocking the passage blocking member and the guide member in such a way that when the passage blocking member is located at the blocking position, the guide member is located at the non-guiding position, and when the passage blocking member is located at the non-blocking position, the guide member is located at the guiding position;

wherein when the guide member is located at the guiding position, the passage blocking member is selectively positioned at the non-blocking position, and when the guide member is located at the non-guiding position, the passage blocking member is selectively positioned at the blocking position while simultaneously rotating the disks of the coin dispensing units, thereby dispensing the coins using rotation of the disks based on a dispensing instruction.

2. The coin dispensing apparatus according to claim 1, wherein the apertures of the rotary disks of the coin dispensing units have a same count and a same angular position.

3. The coin dispensing apparatus according to claim 1, wherein the coin dispensing units are adjacently arranged along an arrangement line;

the transmission device is placed along the arrangement line; and the transmission device comprises a common driving shaft rotated by the driving device, driving bevel gears fixed to the common driving shaft, and driven bevel gears which are respectively engaged with the driving bevel gears and which are respectively connected to the rotary disks of the coin dispensing units.

4. The coin dispensing apparatus according to claim 1, wherein the coin dispensing units are adjacently arranged along an arrangement line;

the transmission device is placed along the arrangement line; and the transmission device comprises a common driving shaft rotated by the driving device, driving spiral bevel gears fixed to the common driving shaft, and driven spiral bevel gears which are respectively engaged with the spiral driving bevel gears and which are respectively connected to the rotary disks of the coin dispensing units.

5. The coin dispensing apparatus according to claim 1, wherein the transmitting device comprises a driving spur gear rotated by the driving device, and driven spur gears respectively connected to the rotary disks of the coin dispensing units; and the driving spur gear is engaged with an adjacent one of the driven spur gears by way of an idler gear, and wherein the driven spur gears are engaged with each other by way of an idler gear or gears.

6. A coin dispensing apparatus comprising:

a plurality of coin dispensing units each including a rotary disk having apertures for receiving coins which are supplied from a coin source;

a circular carrying path, formed in each of the coin dispensing units, along which the coins received in the apertures are moved in conjunction with rotation of the disk;

a dispensing opening, formed in each of the coin dispensing units, through which the coins are moved from the carrying path toward a coin outlet;

a common driving device for commonly rotating the disks of the coin dispensing units;

a transmission device for transmitting a driving force of the driving device to the disks of the coin dispensing units;

a passage blocking member formed in a dispensing opening of each of the coin dispensing units, wherein the passage blocking member is movable between a non-blocking position where the coins are able to pass through the dispensing opening and a blocking position where the coins are unable to pass through the dispensing opening;

a guide member movable between a guiding position where the guide member is protruded from the carrying path and a non-guiding position where the guide member is retracted from the carrying path; and an interlocking device including a mechanical linking mechanism for interlocking the passage blocking member and the guide member in such a way that when the passage blocking member is located at the blocking position, the guide member is located at the non-guiding position, and when the passage blocking member is located at the non-blocking position, the guide member is located at the guiding position, wherein when the guide member is located at the guiding position, the passage blocking member is positioned at the non-blocking position, and when the guide member is located at the non-guiding position, the passage blocking member is positioned at the blocking position, while simultaneously rotating the disks of the coin dispensing units, thereby dispensing the coins using rotation of the disks based on a dispensing instruction.

7. The coin dispensing apparatus according to claim 6, wherein the apertures of the rotary disks of the coin dispensing units have a same count and a same angular position.

8. The coin dispensing apparatus according to claim 6, wherein the coin dispensing units are adjacently arranged along an arrangement line;

the transmission device is placed along the arrangement line; and the transmission device comprises a common driving shaft rotated by the driving device, driving bevel gears fixed to the common driving shaft, and driven bevel gears which are respectively engaged with the driving bevel gears and which are respectively connected to the rotary disks of the coin dispensing units.

9. The coin dispensing apparatus according to claim 6, wherein the coin dispensing units are adjacently arranged along an arrangement line;

the transmission device is placed along the arrangement line; and the transmission device comprises a common driving shaft rotated by the driving device, driving spiral bevel gears fixed to the common driving shaft, and driven spiral bevel gears which are respectively engaged with the spiral driving bevel gears and which are respectively connected to the rotary disks of the coin dispensing units.

10. The coin dispensing apparatus according to claim 6, wherein the transmitting device comprises a driving spur gear rotated by the driving device, and driven spur gears respectively connected to the rotary disks of the coin dispensing units; and the driving spur gear is engaged with an adjacent one of the driven spur gears by way of an idler gear, and wherein the driven spur gears are engaged with each other by way of an idler gear or gears.

11. The coin dispensing apparatus according to claim 6, further comprising a control circuit;

wherein under control of the control circuit, the guide member is located at the guiding position and the passage blocking member is located at the non-blocking position and thereafter, the disk is started to be rotated, dispensing the coins; and the guide member is moved to the non-guiding position and the passage blocking member is moved to the blocking position while simultaneously the rotating the disks, thereby stopping dispensing of the coins.

12. The coin dispensing apparatus according to claim 6, further comprising a rotary encoder for detecting an angular position of the disk;

wherein based on an angular position signal from the rotary encoder, rotation of the disk is stopped such that the coins moved along the carrying path are not overlaid on the blocking position of the passage blocking member.

13. A coin dispensing apparatus comprising:

a plurality of coin dispensing units each including a rotary disk having apertures for receiving coins which are supplied from a coin source;

a circular carrying path, formed in each of the coin dispensing units, along which the coins received in the apertures are moved in conjunction with rotation of the disk;

a dispensing opening, formed in each of the coin dispensing units, through which the coins are moved from the carrying path toward a coin outlet;

a common driving device for commonly rotating the disks of the coin dispensing units;

a transmission device for transmitting a driving force of the driving device to the disks of the coin dispensing units;

a passage blocking member formed in a dispensing opening of each of the coin dispensing units; wherein the passage blocking member is movable between a non-blocking position where the coins are able to pass through the dispensing opening and a blocking position where the coins are unable to pass through the dispensing opening;

a guide member movable between a guiding position where the guide member is protruded from the carrying path and a non-guiding position where the guide member is retracted from the carrying path; and an interlocking device for interlocking the passage blocking member and the guide member in such a way that when the passage blocking member is located at the blocking position, the guide member is located at the non-guiding position, and when the passage blocking member is located at the non-blocking position, the guide member is located at the guiding position;

wherein when the guide member is located at the guiding position, the passage blocking member is positioned at the non-blocking position, and when the guide member is located at the non-guiding position, the passage blocking member is positioned at the blocking position, while simultaneously rotating the disks of the coin dispensing units, thereby dispensing the coins using rotation of the disks based on a dispensing instruction.

14. The com dispensing apparatus according to claim 13, wherein the passage blocking member comprises a bar-shaped member which is protruded into the carrying path at the blocking position and retracted from the carrying path at the non-blocking position; and the guide member comprises a bar-shaped member which is movably supported by a shaft and which is moved by an actuator between the guiding position and the non-guiding position.

15. The coin dispensing apparatus according to claim 13, further comprising a position selector for selectively positioning the guide member between the guiding position and the non-guiding position;

wherein the position selector is rockably supported by a shaft and is rocked around the shaft by an actuator between a dispensing assisting position and a dispensing assisting position; and wherein when the position selector is located at the dispensing assisting position, the guide member is located at the guiding position, and when the position selector is located at the non-dispensing assisting position, the guide member is positioned at the non-guiding position.

16. The coin dispensing apparatus according to claim 13, further comprising a control circuit;

wherein under control of the control circuit, the guide member is located at the guiding position and the passage blocking member is located at the non-blocking position and thereafter, the disk is started to be rotated, dispensing the coins; and the guide member is moved to the non-guiding position and the passage blocking member is moved to the blocking position while simultaneously the rotating the disks, thereby stopping dispensing of the coins.

17. The coin dispensing apparatus according to claim 13, further comprising a rotary encoder for detecting an angular position of the disk;

wherein based on an angular position signal from the rotary encoder, rotation of the disk is stopped such that the coins moved along the carrying path are not overlaid on the blocking position of the passage blocking member.

* * * * *